US009335650B2

(12) United States Patent
Aoyama et al.

(10) Patent No.: US 9,335,650 B2
(45) Date of Patent: May 10, 2016

(54) IMAGE FORMING APPARATUS AND PROCESS CARTRIDGE UTILIZING A POROUS CHARGING MEMBER

(71) Applicant: CANON KABUSHIKI KAISHA, Tokyo (JP)

(72) Inventors: Takehiko Aoyama, Suntou-gun (JP); Tomohito Taniguchi, Suntou-gun (JP); Noboru Miyagawa, Suntou-gun (JP); Taichi Sato, Numazu (JP); Atsushi Uematsu, Fuji (JP); Masahiro Watanabe, Mishima (JP); Yoshitaka Suzumura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/316,040

(22) Filed: Jun. 26, 2014

(65) Prior Publication Data

US 2015/0003874 A1 Jan. 1, 2015

(30) Foreign Application Priority Data

Jun. 27, 2013 (WO) ..... PCT/JP2013/067722

(51) Int. Cl.
*G03G 15/02* (2006.01)

(52) U.S. Cl.
CPC ..... *G03G 15/0233* (2013.01)

(58) Field of Classification Search
CPC ..... G03G 15/0233
USPC ..... 399/168, 174, 176, 252; 430/109.1, 430/110.1, 105, 902
See application file for complete search history.

(56) References Cited

U.S. PATENT DOCUMENTS

| | | | | |
|---|---|---|---|---|
| 6,477,344 | B1 | 11/2002 | Asakura et al. | |
| 7,811,734 | B2 | 10/2010 | Ogawa et al. | |
| 2006/0222982 | A1 | 10/2006 | Fujikawa | |
| 2010/0135695 | A1* | 6/2010 | Mayuzumi et al. | 399/168 |
| 2011/0305481 | A1 | 12/2011 | Taniguchi et al. | |
| 2013/0316282 | A1* | 11/2013 | Ishigami et al. | 430/111.33 |
| 2014/0295336 | A1* | 10/2014 | Miyagawa | G03G 21/18 430/56 |

(Continued)

FOREIGN PATENT DOCUMENTS

| | | | |
|---|---|---|---|
| JP | 2003316112 | A | 11/2003 |
| JP | 2006107375 | A | 4/2006 |

(Continued)

*Primary Examiner* — Walter L Lindsay, Jr.
*Assistant Examiner* — Ruth LaBombard
(74) *Attorney, Agent, or Firm* — Canon U.S.A., Inc., IP Division

(57) ABSTRACT

There are provided an image forming apparatus in which the generation of lateral streak images due to a decrease in the in-nip discharge intensity is suppressed while at the same time the generation of spot-like images due to abnormal discharge caused by smudges on the surface of a charging member is suppressed, and a process cartridge.

The image forming apparatus and the process cartridge each has:

a charging member containing a resin particle having a plurality of pores inside thereof; and a toner in which the coverage ratio X1 of a surface of the toner with silica fine particles is 50.0 area % or more and 75.0 area % or less, and when a theoretical coverage ratio with the silica fine particles is X2, a diffusion index represented by formula 1 satisfies formula 2.

diffusion index$=X1/X2$ (formula 1)

diffusion index$\geq -0.0042\times X1+0.62$ (formula 2)

16 Claims, 8 Drawing Sheets

(56) References Cited

U.S. PATENT DOCUMENTS

| | | | | |
|---|---|---|---|---|
| 2014/0301754 | A1* | 10/2014 | Uematsu | G03G 15/0233 399/176 |
| 2014/0308607 | A1* | 10/2014 | Taniguchi | G03G 5/04 430/57.1 |
| 2015/0003872 | A1* | 1/2015 | Taniguchi | G03G 15/0233 399/176 |
| 2015/0301469 | A1* | 10/2015 | Aoyama | G03G 15/0233 399/176 |

FOREIGN PATENT DOCUMENTS

| | | | |
|---|---|---|---|
| JP | 2008276026 | A | 11/2008 |
| JP | 2009175427 | A | 8/2009 |
| JP | 2011053429 | A | 3/2011 |
| JP | 2011107375 | A | 6/2011 |
| JP | 2011-248353 | A | 12/2011 |
| JP | 2012-037875 | A | 2/2012 |
| JP | 2012-141386 | A | 7/2012 |
| JP | 2013047754 | A | 3/2013 |
| JP | 2013134447 | A | 7/2013 |

* cited by examiner

IMAGE FORMING APPARATUS AND PROCESS CARTRIDGE UTILIZING A POROUS CHARGING MEMBER

TECHNICAL FIELD

The present invention relates to an image forming apparatus and a process cartridge.

BACKGROUND ART

An image forming apparatus which employs an electrophotographic system mainly includes an electrophotographic photosensitive member, a charging device, an exposure device, a developing device, a transfer device, a cleaning device, and a fixing device. The charging device employs a system in which a surface of the electrophotographic photosensitive member (hereafter also referred to as "a photosensitive member") is charged by applying a voltage (direct voltage or voltage obtained by superimposing alternating voltage on direct voltage) to a charging member which contacts or is closely disposed on the surface of the photosensitive member. A contact-type charging method is preferably used in order to stably perform charging and reduce the amount of ozone generated. In the case of the contact-type charging method, a roller-shaped charging member is preferably used.

In recent years, high speed, high image quality, high durability, and downsizing have been required for image forming apparatuses. To achieve this, PTL 1 or 2 discloses a technique of forming a surface layer having projections on a surface of a charging member, the projections being derived from resin particles or the like. In this technique, the uniform chargeability is believed to be improved by performing in-nip discharge near the projections as described in PTL 3. This can suppress the generation of images of lateral streaks formed due to nonuniformity of electrical resistance (hereafter referred to as "lateral streak images").

However, if such projections derived from resin particles are formed on the surface layer as described above in a trend of increasing the speed, image quality, and durability and decreasing the size, the photosensitive member tends to contact only the top portions of the projections. Therefore, the contact area is small and the contact pressure is concentrated, which sometimes causes slippage between the charging member and the photosensitive member. In the case where a toner (hereafter also referred to as "a residual toner") left on the surface of the photosensitive member after a transfer step is not removed in a cleaning step, the unremoved toner is rubbed in the sliding between the photosensitive member and the charging member due to the slippage of the charging member and thus is fixed on the surface of the charging member. The fixation of the toner degrades the discharge performance of the charging member. As a result, the lateral streak images and spot-like images formed by abnormal discharge in toner-fixed portions (hereafter referred to as "spot-like images") are easily generated. The solution to this problem is not described in PTL 1 or 2.

CITATION LIST

Patent Literature

PTL 1: Japanese Patent Laid-Open No. 2003-316112
PTL 2: Japanese Patent Laid-Open No. 2009-175427
PTL 3: Japanese Patent Laid-Open No. 2008-276026

In recent years, higher speed has been required for image forming apparatuses and also such image forming apparatuses have been used in a wide range of environments.

In particular, in low-temperature and low-humidity environments, the frictional property of the charging member degrades and thus the slippage easily occurs, which facilitates the fixation of a toner on the surface of the charging member. Consequently, the spot-like images tend to become apparent. Furthermore, even if a more spherical toner is used to achieve high image quality that has been required in recent years, the spot-like images tend to become apparent.

As a result of appearance of downsized image forming apparatuses with high speed, high image quality, high durability, and the like, the lateral streak images and the spot-like images that have not been formed sometimes become apparent. Thus, the inventors of the present invention have recognized that more stable electrophotographic performance is achieved by suppressing the slippage of the charging member while maintaining the in-nip discharge.

SUMMARY OF INVENTION

The present invention is directed to providing a charging member of an image forming apparatus in which the generation of lateral streak images due to a decrease in the in-nip discharge intensity is suppressed while at the same time the generation of spot-like images due to abnormal discharge caused by smudges on the surface of the charging member is suppressed.

Further, the present invention is directed to providing a process cartridge and an image forming apparatus including the charging member.

According to one aspect of the present invention, there is provided an image forming apparatus including a photosensitive member, charging means for charging the photosensitive member with a charging member, exposure means for forming an electrostatic latent image on a surface of the charged photosensitive member, and developing means for supplying the photosensitive member on which the electrostatic latent image is formed with a toner to form a toner image on the surface of the photosensitive member, wherein the charging member comprises an electro-conductive substrate and an electro-conductive resin layer, the resin layer comprising a binder resin C and a resin particle that roughens a surface of the charging member, the resin particle having a plurality of pores inside thereof, and a surface of the charging member has a plurality of projections derived from the resin particle, and wherein the toner comprises toner particles, each of which contains a binder resin T and a colorant, and inorganic fine particles; the inorganic fine particles are silica fine particles; the toner contains the silica fine particles in an amount of 0.40 parts by mass or more and 1.50 parts by mass or less based on 100 parts by mass of the toner particles; the silica fine particles are treated with 15.0 parts by mass or more and 40.0 parts by mass or less of a silicone oil based on 100 parts by mass of a silica raw material, and a fixation ratio (%) of the silicone oil on the basis of an amount of carbon is 70% or more; and a coverage ratio X1 of a surface of the toner with the silica fine particles, as determined by X-ray photoelectron spectrometer (ESCA), is 50.0 area % or more and 75.0 area % or less, and when a theoretical coverage ratio by the silica fine particles is X2, a diffusion index represented by the following formula 1 satisfies the following formula 2.

$$\text{diffusion index}=X1/X2 \quad \text{(formula 1)}$$

$$\text{diffusion index}\geq -0.0042\times X1+0.62 \quad \text{(formula 2)}$$

Further features of the present invention will become apparent from the following description of exemplary embodiments with reference to the attached drawings.

DESCRIPTION OF EMBODIMENTS

Figure 1A:
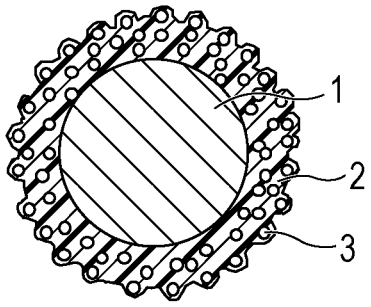
FIGS. 1A to 1C show cross-sectional views of charging members (roller shape) according to the present invention.

The inventors of the present invention have studied the contact state and discharge state obtained when a photosensitive member is charged by the charging member described in each of PTLs 1 and 2. In the course of this study, they have observed a nip portion between the charging member and the photosensitive member in detail. Consequently, the following has bee found. The contact between the photosensitive member and the charging member is limited to a narrow region near the top of each projection. If high-speed image forming is performed in such a state, slippage occurs in a contact portion near the top of each projection. It has been also found that vibration is generated by the slippage and the vibration is transferred to the photosensitive member.

As a result of further studies conducted by the inventors of the present invention, the following has been found. First, the vibration generated by the slippage causes vibration of the photosensitive member. A toner left on the surface of the photosensitive member after a transfer step is not removed by a cleaning member by passing through minute gaps formed by the vibration of the photosensitive member. Furthermore, when a more spherical toner is used, the passage of a toner significantly occurs. At the same time, the passage of a toner readily occurs in a portion in which an aggregated residual toner collides with the cleaning member.

As a result of studies conducted by the inventors of the present invention, it has been confirmed that if the projections are not formed, the slippage does not occur and the vibration caused by the slippage also does not occur. However, it has been found that, in this case, the in-nip discharge is not generated, which makes it difficult to suppress generation of the lateral streak images.

The inventors of the present invention have conducted studies on suppressing the generation of the slippage while maintaining the in-nip discharge. In the course of the studies, it has been found that when a plurality of pores are formed in the resin particles constituting the projections, the projections easily deform, which increases the contact area between the projections of the charging member and the photosensitive member. The deformation of the projections increases as the porosity of the resin particles increases. Consequently, the contact area can be increased. This results in a reduction in pressure concentration near the top of each projection, and thus the slippage can be suppressed. It has also been found that the deformation of the projections absorbs the vibration of the photosensitive member, which stabilizes rotation of the photosensitive member. However, an excessively high porosity of the resin particles makes it difficult to maintain gaps in the nip portion. That is, the in-nip discharge is not easily generated. Here, it has been found that, by forming a plurality of pores, but not a single pore, in the resin particles, the pressure applied to each pore is dispersed and thus both the deformability and the gap maintenance can be achieved.

Furthermore, the inventors of the present invention have thoroughly studied the slippage of the charging member, the passage of a toner through the cleaning member, and a mechanism with which smudges are generated on the charging member in an image forming apparatus or a process cartridge that uses a charging member and a toner. This will be described below in detail on the basis of the results of an example study conducted by using a roll-shaped charging member and a blade-shaped cleaning member.

First, the inventors of the present invention observed a behavior on a surface of the cleaning member in the case where the photosensitive member was charged by using the charging member of PTL 1 and a residual toner was not present. It was confirmed that, when the rotation of the photosensitive member was increased, the slippage of the charging member occurred as described above. Consequently, it was also confirmed that the vibration generated by the slippage of the charging member was transferred to the photosensitive member, which formed minute gaps between the cleaning member and the photosensitive member.

The inventors of the present invention prepared a toner subjected to a transfer step with an image forming apparatus that used a conventional toner. That is, the toner (hereafter also referred to as "an aggregated toner") was separately prepared as an aggregated toner that simulates a residual toner. Then, the aggregated toner was supplied to the cleaning member that was in contact with a photosensitive member which was being rotated at high speed. As a result, it was confirmed that, in the contact portion between the cleaning member and the photosensitive member, the aggregated toner significantly passed through a portion in which the aggregated toner collided with the cleaning member as described above and the toner was fixed on the charging member. When the rotation was further continued, the portions through which the toner passed spread and the amount of the toner fixed on the charging member increased. The reason for this may be as follows. The aggregated toner subjected to the transfer step undergoes a dense state and also a high electric field is often applied to the aggregated toner, and thus the aggregated toner has a high adhesive force to the surface of the photosensitive member. That is, the aggregated toner has poor releasability from the photosensitive member. In the case where the amount of the toner having poor releasability is increased and minute gaps are formed when the vibration generated by the slippage of the charging member is transferred to the photosensitive member, the passage of the toner is induced. This increases the amount of the residual toner left on the surface of the photosensitive member after the cleaning member has passed. The residual toner is rubbed with the charging member and the amount of the toner fixed on the surface of the charging member is increased.

Subsequently, the charging member according to the present invention was used instead of the conventional charging member, and the charging member was observed while the aggregated toner was not present. The slippage observed for the conventional charging member was not observed for the charging member. It was confirmed that the rotation of the photosensitive member was stabilized. Then, when the aggregated toner was supplied to the cleaning member in the same manner as above, the passage of the toner did not occur immediately after the supply, but the passage of the toner occurred after a while. Consequently, the toner adhered to the surface of the charging member, but was not fixed on the surface. The reason for this may be as follows. An aggregated toner subjected to removal is often left on the surface of the cleaning member, and thus aggregated toner that arrives one after another repeatedly accumulates and reaggregates near the surface of the cleaning member. The accumulated and reaggregated toner has a higher adhesive force to the surface of the photosensitive member. As a result, the accumulated and reaggregated toner exerts an impact on the cleaning member, which causes the passage of the toner and thus results in toner adhesion to the charging member.

Furthermore, the inventors of the present invention conducted studies using the toner according to the present invention in the same manner as above. First, it was found that the inventors tried to simulate the residual toner in the same manner as in the preparation of the aggregated toner, but the toner according to the present invention did not easily aggregate on the surface of the photosensitive member even after the transfer step.

Subsequently, the photosensitive member was rotated at high speed while being charged by the charging member according to the present invention in the same manner as above. Then, the toner according to the present invention which was subjected to the transfer step was supplied to the cleaning member. Consequently, almost no particles of toner that passed through the cleaning member were observed, and also almost no particles of toner that adhered to the surface of the charging member were observed. After that, the photosensitive member was further rotated at high speed for a long time while being charged by the charging member according to the present invention, and the toner according to the present invention which was subjected to the transfer step was supplied to the cleaning member. Consequently, a toner that passed through the cleaning member was slightly observed, but almost no particles of toner were fixed on the charging member and the adhesion of the toner was also negligible. A consideration about suppressing the generation of an aggregated toner by minutely controlling the state of silica fine particles on a surface of the toner will be described below in detail.

As a result of the series of studies, the inventors of the present invention assume, to be as follows, the mechanism with which the smudges on the surface of the charging member can be suppressed by using the charging member according to the present invention and the toner according to the present invention.

In the charging member according to the present invention, the pores in the resin particles that constitute projections on the surface are controlled. Thus, the slippage between the charging member and the photosensitive member is suppressed while the deformability of the projections is controlled and the in-nip discharge is maintained.

In the toner according to the present invention, the aggregation of particles of the toner is considerably reduced by minutely controlling the state of silica fine particles on a surface of the toner. This considerably reduces the generation of an aggregated toner after the transfer step and the accumulation and reaggregation of a toner near the surface of the cleaning member. In the case where the toner according to the present invention is used, even if a toner passes through the cleaning member, the toner does not aggregate and tends to be sparsely present. In addition, the deformability of projections of the charging member according to the present invention reduces the pressure applied to the toner that has passed through the cleaning member, which considerably suppresses the adhesion of the toner to the surface of the charging member. Furthermore, the deformation of the projections and the recovery of the projections allow to push back the toner to the photosensitive member without causing the toner that has contacted the charging member to be rubbed with the charging member. As a result, the fixation and adhesion of a toner to the surface of the charging member are assumed to be suppressed.

As described above, it is assumed that the passage of a toner through the cleaning member and the fixation of a toner and the smudges on the surface of the charging member are suppressed as a result of combined effects produced by using both the charging member and the toner according to the present invention.

<Charging Member>

The charging member according to the present invention may be any charging member including the electro-conductive substrate and the electro-conductive resin layer and may have any shape such as a roller shape or a flat shape.

Figure 1B:
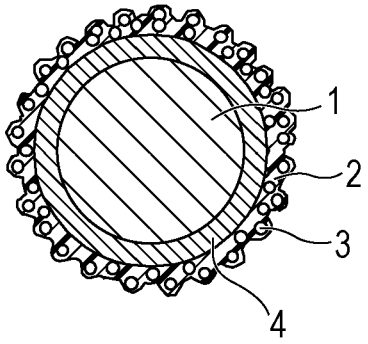
Figure 1C:
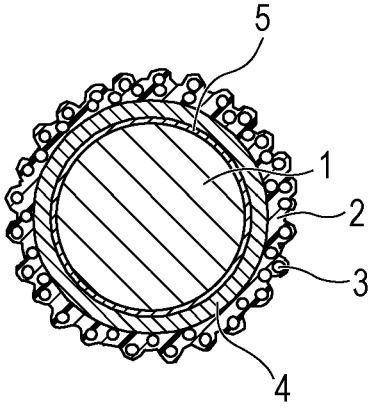

FIG. 1A shows an example of a cross section of the charging member according to the present invention. The charging member includes an electro-conductive substrate 1 and an electro-conductive resin layer 2 that covers a peripheral surface of the electro-conductive substrate 1. The electro-conductive resin layer 2 contains resin particles 3. As shown in FIG. 1B, at least one electro-conductive elastic layer 4 may be disposed between the electro-conductive substrate 1 and the electro-conductive resin layer 2. As shown in FIG. 1C, the electro-conductive elastic layer 4 may be bonded using an electro-conductive adhesive 5. In FIG. 1B, the electro-conductive elastic layer 4 and the electro-conductive resin layer 2 may be bonded to each other with an electro-conductive adhesive disposed therebetween. A publicly known binder resin and conductive agent can be used for the adhesive. Furthermore, at least one resin layer other than the electro-conductive resin layer 2 can also be disposed inside the electro-conductive resin layer 2.

The binder resin of the adhesive is, for example, a thermosetting resin or a thermoplastic resin. Examples of the binder resin include publicly known resins such as urethane resin, acrylic resin, polyester resin, polyether resin, and epoxy resin. The conductive agent for imparting conductivity to the adhesive is appropriately selected from electro-conductive particles and ionic conductive agents. These conductive agents can be used alone or in combination of two or more.

Figure 2:
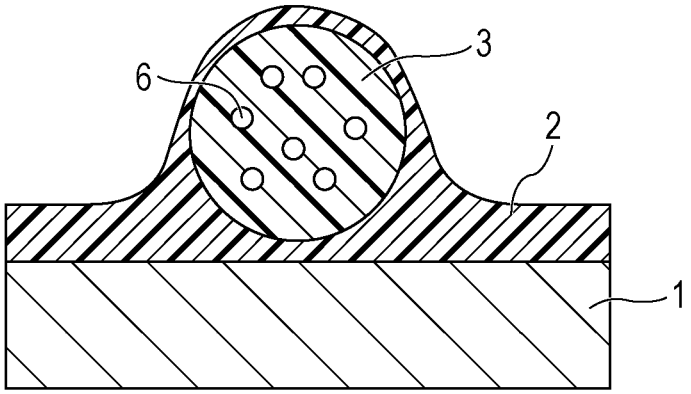
FIG. 2 shows a partial cross-sectional view near the surface of a charging member according to the present invention (a drawing including pores).

FIG. 2 is a schematic cross-sectional view showing the electro-conductive resin layer 2 that constitutes the surface of the electro-conductive substrate 1 or the charging member. The resin layer 2 contains a binder resin, electro-conductive particles dispersed in the binder resin, and resin particles 3 for roughening the resin layer 2. The resin layer 2 includes a plurality of projections derived from the resin particles 3 on the surface thereof. The resin particles 3 that constitute the projections include a plurality of pores 6 inside thereof. Hereafter, the binder resin contained in the resin layer of the charging member is also referred to as a binder resin C.

As described above, the charging member according to the present invention is in contact with the photosensitive member near the top of each projection and there are gaps in portions other than the projections. In the gaps, the in-nip discharge is generated to suppress the generation of lateral streak images. Furthermore, the presence of the plurality pores formed inside the resin particles constituting the projections improves the deformability of the projections, suppresses the slippage of the charging member, and stabilizes the rotation of the photosensitive member. Thus, the vibration of the charging member due to the slippage is suppressed and also the vibration of the photosensitive member is absorbed. This suppresses the formation of gaps between the cleaning member and the photosensitive member and thus suppresses the passage of a residual toner. Consequently, the rubbing of a toner that has passed through the cleaning member due to the slippage of the charging member is suppressed. The inventors of the present invention assume that, as a result of these effects, the generation of the lateral streak images and the spot-like images can be suppressed.

In order to sufficiently produce these effects, the porosity of the resin particles constituting the projections is preferably 2.5% by volume or less as a whole. In the above range, the gaps between the charging member and the photosensitive member are maintained while the contact area with the photosensitive member is increased, and thus the in-nip discharge can be sufficiently performed. The porosity is more preferably 0.5% by volume or more and 2.0% by volume or less. Thus, the in-nip discharge can be more effectively maintained.

Regarding the plurality of pores formed inside the resin particles constituting the projections, the porosity (hereafter also referred to as "porosity $V_{11}$") of resin particles on the top side of the projections is preferably 5% by volume or more and 20% by volume or less and more preferably 5.5% by volume or more and 15% by volume or less. When the porosity $V_{11}$ is within the above range, both the in-nip discharge and the suppression of the slippage can be more effectively achieved. The details will be described below.

In addition, the relationship between the discharge state of the charging member and the state of the resin layer has been studied. Consequently, a preferred state of the resin layer for stably maintaining the in-nip discharge intensity have been found. It has also been found that an aggregate containing carbon black and inorganic particles is preferably dispersed in the resin layer. It is assumed that stable dischargeability can be achieved by incorporating a highly dielectric portion formed by the inorganic particles into a conductive path of carbon black for providing conductivity in the resin layer. Accordingly, the in-nip discharge can be stably performed even if the surface of the charging member is smudged with a toner to some extent.

<Resin Layer>

[Binder Resin C]

Publicly known rubber or resin can be used as the binder resin C used for the electro-conductive resin layer. The rubber is, for example, natural rubber, rubber obtained by vulcanizing natural rubber, or synthetic rubber.

Examples of the synthetic rubber include ethylene-propylene rubber, styrene-butadiene rubber (SBR), silicone rubber, urethane rubber, isoprene rubber (IR), butyl rubber, acrylonitrile-butadiene rubber (NBR), chloroprene rubber (CR), acrylic rubber, epichlorohydrin rubber, and fluororubber.

Examples of the resin include a thermosetting resin and a thermoplastic resin. Among them, fluorocarbon resin, polyamide resin, acrylic resin, polyurethane resin, acrylic-urethane resin, silicone resin, and butyral resin are preferably used. Acrylic resin, polyurethane resin, acrylic-urethane resin are particularly preferably used. Use of such a resin stabilizes the contact state with the photosensitive member and easily suppresses the slippage. In particular, polyurethane resin is preferably used because polyurethane resin stably forms the above-described aggregate containing electro-conductive particles and inorganic particles and the median size (D50 particle diameter) of the aggregate is easily adjusted. These resins may be used alone or in combination of two or more as a mixture. Alternatively, monomers serving as raw materials of the binder resins may be copolymerized to form a copolymer. The binder resins may be formed by adding a cross-linking agent to a prepolymer of a raw material of the binder resin and curing or cross-linking the prepolymer.

In the present invention, the above-mentioned mixture is also described as the binder resin hereafter.

[Polyurethane Resin]

The polyurethane resin can be obtained by causing a reaction between a publicly known polyol and a publicly known isocyanate compound. Examples of the polyol include lactone-modified acrylic polyol, polyethylene glycol, polypropylene glycol, and polytetramethylene glycol.

The isocyanate compound caused to react with the polyol component is not particularly limited. The isocyanate compound preferably has a ring structure in view of the stability of the electro-conductive particles or the formation and stability of the aggregate containing electro-conductive particles and inorganic particles. Specifically, an alicyclic isocyanate and an aromatic isocyanate are preferably used. Examples of the alicyclic isocyanate include isophorone diisocyanate (IPDI), cyclohexane-1,3-diisocyanate, and cyclohexane-1,4-diisocyanate. Examples of the aromatic isocyanate include 2,4-tolylene diisocyanate, 2,6-tolylene diisocyanate (TDI), and diphenylmethane diisocyanate (MDI).

In addition to the isocyanates, an aliphatic isocyanate is preferably used together. When the deformation of the charging member repeatedly occurs as a result of contact with the photosensitive member for the purpose of forming an image, the deformation suppresses the generation of abnormal discharge caused by the redispersion and reaggregation of the electro-conductive particles or the aggregate containing electro-conductive particles and inorganic particles. Therefore, discharge can be stably performed for a long time. Examples of the aliphatic isocyanate include ethylene diisocyanate and 1,6-hexamethylene diisocyanate (HDI).

The isocyanate used in the present invention may be a derivative such as a modified product or a copolymer of the isocyanate. In particular, an isocyanurate-type trimer is preferably used. A rigid trimer serves as a cross-linking point and thus the resin layer can be more densely cross-linked. This can more effectively improve the stability of the aggregate containing electro-conductive particles and inorganic particles. The isocyanate used in the present invention is more preferably a blocked isocyanate having an isocyanate group blocked with a blocking agent. This is because an isocyanate group has a high reactivity and the reaction gradually proceeds if a resin-layer-forming coating solution is left to stand for a long time, which may result in a change in the properties of the coating solution. On the other hand, a blocked isocyanate does not react until the dissociation temperature of the blocking agent because the active isocyanate group is blocked. This provides an advantage of ease of handling of the coating solution. Examples of the blocking agent for performing masking include phenols such as phenol and cresol, lactams such as ∈-caprolactam, and oximes such as methyl ethyl ketoxime. In the present invention, oximes having a relatively low dissociation temperature are preferably used.

When the polyurethane resin is obtained by causing a reaction between the polyol and the isocyanate compound, the isocyanate is preferably added after electro-conductive particles are dispersed in the polyol. The control of the addition order can stabilize the dispersion of the electro-conductive particles. Furthermore, when inorganic particles are added, an aggregate containing electro-conductive particles and inorganic particles which are uniformly mixed with each other is easily formed. As a result, the in-nip discharge can be stably performed for a long time.

[Resin Particles]

The resin particles contained in the conductive resin layer are, for example, particles formed of the following polymer compound. Examples of the polymer compound include resins such as acrylic resin, styrene resin, polyamide resin, silicone resin, vinyl chloride resin, vinylidene chloride resin, acrylonitrile resin, fluorocarbon resin, phenolic resin, polyester resin, melamine resin, urethane resin, olefin resin, and epoxy resin; the copolymers, modified products, and derivatives of the resins; an ethylene-propylene-diene copolymer (EPDM); styrene-butadiene copolymer rubber (SBR); silicone rubber; urethane rubber; isoprene rubber (IR); butyl rubber; chloroprene rubber; and thermoplastic elastomers such as polyolefin-based thermoplastic elastomers, urethane-based thermoplastic elastomers, polystyrene-based thermoplastic elastomers, fluororubber-based thermoplastic elastomers, polyester-based thermoplastic elastomers, polyamide-based thermoplastic elastomers, polybutadiene-based thermoplastic elastomers, ethylene-vinyl acetate-based thermoplastic elastomers, polyvinyl chloride-based thermoplastic elastomers, and chlorinated polyethylene-based thermoplastic elastomers.

Among them, the resin particles are preferably formed of the above-described polymer compound in order to achieve ease of dispersion in the binder resin C. Furthermore, acrylic resin, styrene resin, and styrene-acrylic resin are more preferably used because when the projections are formed on the surface of the charging member, the gaps for generating the in-nip discharge are easily maintained between the charging member and the photosensitive member in any environment.

The resin particles may be used alone or in combination of two or more. Furthermore, a surface treatment, modification, introduction of a functional group or a molecular chain, or coating may be performed on the resin particles.

The content of the resin particles in the resin layer is preferably 2 parts by mass or more and 100 parts by mass or less and more preferably 5 parts by mass or more and 80 parts by mass or less based on 100 parts by mass of the binder resin C. In the above range, the in-nip discharge can be more stably generated.

The volume-average particle diameter of the resin particles is preferably 10 μm or more and 50 μm or less. In the above range, the in-nip discharge can be more stably generated.

Since the resin particles contained in the resin layer have a plurality of pores inside thereof, porous resin particles (hereafter referred to as "porous particles") or multi-hollow resin particles (hereafter referred to as "multi-hollow particles") are used.

Regarding the state of pores in the resin particles, the porosity of the resin particles in the resin layer is preferably 2.5% by volume or less as a whole and more preferably 0.5% by volume or more and 2.0% by volume or less as described above. In the above range, the generation of the slippage can be more effectively suppressed while the in-nip discharge is maintained.

In the resin particles contained in the resin layer, the pores present in an internal region of the resin particles are preferably concentrated in a near-surface region of the resin particles. In other words, the resin particles preferably have a core-shell structure in which the porosity of the resin particles in a near-surface region is higher than the porosity of the resin particles in an internal region. In these particles, the porosity in the internal region is preferably controlled to be 5% by volume or more and 35% by volume or less and the average pore size in the internal region is preferably controlled to be 10 nm or more and 45 nm or less. The porosity in the near-surface region is preferably 10% by volume or more and 55% by volume or less and the average pore size in the near-surface region (hereafter also referred to as "average pore size $R_{11}$") is preferably 30 nm or more and 200 nm or less. When the average pore size $R_{11}$ is within the above range, the porosity near the top of each projection on the surface of the charging member can be easily controlled.

Figure 3:
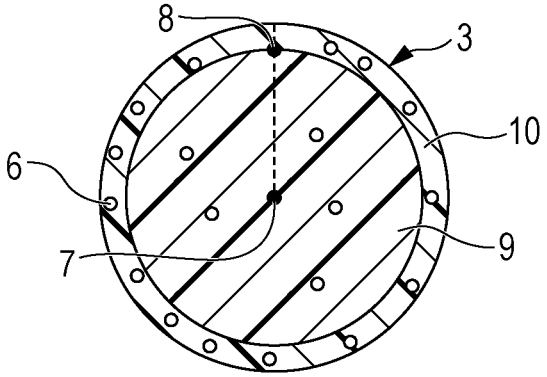
FIG. 3 shows a cross-sectional view of a resin particle according to the present invention (a drawing including pores).

The porous particles of the present invention having a core-shell structure and used to control the porosity will be described with reference to FIG. 3. First, assuming that the resin particle 3 is a solid particle, the center 7 of the resin particle 3 is calculated. Then, a position such as a position 8 shifted from the center 7 toward the outside of the particle by a distance of $(3)^{1/2}/2$ times the particle radius is determined. In the same manner as for the position 8, 100 positions are determined so as to be uniformly located with respect to the perimeter of the particle, and the 100 positions are connected using straight lines to define two regions. The internal region is defined as one of the two regions located on the center 7 side of the particle, that is, a region 9. The near-surface region is defined as the other region located outside the position 8 shifted by a distance of $(3)^{1/2}/2$ times the particle radius, that is, a region 10. A method concerning each parameter will be described below.

Porous particles are preferably used as the resin particles serving as a raw material before addition to the resin layer. As described in detail below, by using such porous particles, the porosity of the resin particles constituting the projections on the surface of the charging member can be easily controlled.

In the present invention, the porous particles are defined as particles having many pores that extend to the surfaces of the resin particles. The multi-hollow particles are defined as particles having a plurality of pores each having a region containing air therein, the pores not extending to the surfaces of the resin particles. The porous particles and the multi-hollow particles will be described below in detail.

[Porous Particles]

The porous particles are formed of, for example, acrylic resin, styrene resin, acrylonitrile resin, vinylidene chloride resin, or vinyl chloride resin. These resins can be used alone or in combination of two or more. Monomers serving as raw materials of the resins may be copolymerized and the obtained copolymer may be used. These resins may be used as a main component, and other publicly known resins may be optionally added thereto.

The porous particles can be produced by a suspension polymerization method, an interfacial polymerization method, an interfacial precipitation method, a drying-in-liquid method, or a publicly known production method in which precipitation is caused by adding a solute or a solvent which decreases the solubility of a resin to a resin solution. For example, in the suspension polymerization method, a pore-forming agent is dissolved in a polymerizable monomer in the presence of a cross-linkable monomer to prepare an oil-based mixture liquid. Aqueous suspension polymerization is performed in an aqueous medium containing a surfactant and a dispersion stabilizer using the oil-based mixture liquid. After the completion of the polymerization, washing and drying are performed to remove water and the pore-forming agent, and thus resin particles can be obtained. A compound having a reactive group that reacts with a functional group of the polymerizable monomer and an organic filler can also be added. In order to form pores inside the porous particles, the polymerization is preferably performed in the presence of the cross-linkable monomer.

Examples of the polymerizable monomer include styrene monomers such as styrene, p-methylstyrene, and p-tert-butyl styrene; and (meth)acrylate monomers such as methyl acrylate, ethyl acrylate, propyl acrylate, butyl acrylate, 2-ethylhexyl acrylate, lauryl acrylate, methyl methacrylate, ethyl methacrylate, propyl methacrylate, butyl methacrylate, isobutyl methacrylate, tert-butyl methacrylate, benzyl methacrylate, phenyl methacrylate, isobornyl methacrylate, cyclohexyl methacrylate, glycidyl methacrylate, hydrofurfuryl methacrylate, and lauryl methacrylate. These polymerizable monomers may be used alone or in combination of two or more. In the present invention, the term "(meth)acrylic" is a concept including both "acrylic" and "methacrylic".

The cross-linkable monomer is not particularly limited as long as the monomer has a plurality of vinyl groups. Examples of the cross-linkable monomer include (meth)acrylate monomers such as ethylene glycol di(meth)acrylate, diethylene glycol di(meth)acrylate, triethylene glycol di(meth)acrylate, decaethylene glycol di(meth)acrylate, pentadecaethylene glycol di(meth)acrylate, pentacontahectaethylene glycol di(meth)acrylate, 1,3-butylene glycol di(meth) acrylate, 1,4-butanediol di(meth)acrylate, 1,6-hexanediol di(meth)acrylate, glycerol di(meth)acrylate, allyl methacrylate, trimethylolpropane tri(meth)acrylate, pentaerythritol tetra(meth)acrylate, diethylene glycol phthalate di(meth) acrylate, caprolactone-modified dipentaerythritol hexa (meth)acrylate, caprolactone-modified neopentyl glycol hydroxypivalate diacrylate, polyester acrylate, and urethane acrylate; and divinylbenzene, divinylnaphthalene, and the derivatives thereof. They can be used alone or in combination of two or more.

The content of the cross-linkable monomer in the monomer is preferably 5 mass % or more and 90 mass % or less. In the above range, pores can be formed in porous particles with certainty.

A non-polymerizable solvent, a mixture of a non-polymerizable solvent and a linear polymer that dissolves in a mixture of polymerizable monomers, or a cellulose resin can be used as the pore-forming agent. Examples of the non-polymerizable solvent include toluene, benzene, ethyl acetate, butyl acetate, normal hexane, normal octane, and normal dodecane. The cellulose resin is not particularly limited, but ethyl cellulose can be used. These pore-forming agents can be used alone or in combination of two or more. The amount of the pore-forming agent added can be appropriately selected in accordance with the purpose. The amount is preferably in the range of 20 parts by mass to 90 parts by mass based on 100 parts by mass of an oil phase constituted by the polymerizable monomer, the cross-linkable monomer, and the pore-forming agent. In the above range, the porous particles resist becoming brittle and gaps are easily formed at the nip between the charging member and the photosensitive member.

The polymerization initiator is not particularly limited, but a polymerization initiator that is soluble in the polymerizable monomer is preferably used. A publicly known peroxide initiator and azo initiator can be used. Examples of the polymerization initiator include 2,2'-azobisisobutyronitrile, 1,1'-azobiscyclohexane-1-carbonitrile, 2,2'-azobis-4-methoxy-2,4-dimethylvaleronitrile, and 2,2'-azobis-2,4-dimethylvaleronitrile.

Examples of the surfactant include anionic surfactants such as sodium lauryl sulfate, polyoxyethylene (degree of polymerization: 1 to 100), and triethanolamine lauryl sulfate; cationic surfactants such as stearyl trimethyl ammonium chloride, diethylaminoethylstearamide lactate, dilaurylamine hydrochloride, and oleylamine lactate; nonionic surfactants such as a diethanolamine adipate condensate, lauryldimethylamine oxide, glycerol monostearate, sorbitan monolaurate, and diethylaminoethylstearamide lactate; amphoteric surfactants such as cocamidopropyl betaine, lauryl hydroxysulfobetaine, and sodium β-laurylaminopropionate; and polymer-type dispersants such as polyvinyl alcohol, starch, and carboxymethyl cellulose.

Examples of the dispersion stabilizer include organic fine particles such as polystyrene fine particles, polymethyl methacrylate fine particles, polyacrylic acid fine particles, and polyepoxide fine particles; silica such as colloidal silica; and calcium carbonate, calcium phosphate, aluminum hydroxide, barium carbonate, and magnesium hydroxide.

Among the polymerization methods, a specific example of the suspension polymerization method is described below. Suspension polymerization is preferably performed using a pressure-resistant container in a sealed manner. After raw material components are suspended using a disperser or the like prior to polymerization and the suspension is transferred to the pressure-resistant container, suspension polymerization may be performed. Alternatively, raw material components may be suspended in the pressure-resistant container. The polymerization temperature is preferably 50° C. to 120° C. The polymerization may be performed under atmospheric pressures, but is preferably performed under pressure (pressure higher than the atmospheric pressure by 0.1 to 1 MPa) in order to prevent the pore-forming agent from gasifying. After the completion of the polymerization, solid-liquid separation, washing, and the like may be performed by centrifugal separation and filtration. After the solid-liquid separation and the washing, drying and pulverization may be performed at a temperature lower than or equal to the softening temperature of a resin of the resin particles. The drying and pulverization can be performed by a publicly known method using a flash dryer, a forewind dryer, or a Nauta mixer. The drying and the pulverization can be simultaneously performed using a pulverizing-and-drying machine. The surfactant and the dispersion stabilizer can be removed by repeatedly performing washing and filtration after the production.

The particle diameter of the resin particles can be adjusted by controlling the mixing conditions between an oil-based mixture liquid composed of the polymerizable monomer and the pore-forming agent and an aqueous medium containing the surfactant and the dispersion stabilizer, the amount of the dispersion stabilizer added, and the stirring dispersion conditions. By increasing the amount of the dispersion stabilizer added, the average particle diameter can be decreased. By increasing the stirring speed under the stirring dispersion conditions, the average particle diameter of the porous particles can be decreased. The volume-average particle diameter of the porous particles is preferably in the range of 5 to 60 μm and more preferably 10 to 50 μm. In the above range, the in-nip discharge can be more stably generated.

The porosity and pore size of the porous particles can be adjusted by controlling the amount of the cross-linkable monomer added and the type and amount of the pore-forming agent added.

The porosity and pore size can be adjusted by increasing or decreasing the amount of the pore-forming agent added to the polymerizable monomer. The porosity and pore size can also be adjusted by increasing or decreasing the amount of the cross-linkable monomer added. When the amount of the pore-forming agent is increased or the amount of the cross-linkable monomer added is decreased, the porosity and pore size are increased.

The pore size can be further increased by using cellulose resin as the pore-forming agent.

The pore size of the porous particles is preferably 10 to 500 nm and 20% or less of the average particle diameter of the resin particles. The pore size is more preferably 20 to 200 nm and 10% or less of the average particle diameter of the resin particles. In the above range, when the projections are formed on the surface of the charging member, the parameters of the pores can be easily adjusted to the above preferred ranges.

The porous particles preferably have a core-shell structure in which the porosity of the particles in the near-surface region is higher than the porosity of the particles in the internal region. Such porous particles having a porosity in the near-surface region higher than the porosity in the internal region can be produced using two types of pore-forming agents. By using the porous particles having such a core-shell structure, the projections are easily formed on the surface of the charging member so that the pores are concentrated in a region on the top side of the projections of the resin particles. In this state, an effect of suppressing the slippage between the photosensitive member and the charging member can be effectively produced without weakening the in-nip discharge. The porous particles having different structures in the inside and near the surface can be produced by using two types of pore-forming agents having different solubility parameters (hereafter referred to as "SP values").

The case where normal hexane and ethyl acetate are used as the pore-forming agents will be described below as a specific example. In the case where the above two types of pore-forming agents are used, when an oil-based mixture liquid prepared by mixing the polymerizable monomer and the pore-forming agents is added to an aqueous medium, a larger amount of ethyl acetate having an SP value close to that of water used as the medium is present on the aqueous medium side, that is, outside the suspension droplets. On the other hand, a larger amount of normal hexane is present in the droplets. Since the ethyl acetate present outside the droplets has an SP value close to that of water, a certain amount of water is dissolved in the ethyl acetate. In this case, the solubility of the pore-forming agents in the polymerizable monomer is decreased in a region located outside the droplets compared with a region located inside the droplets. This provides a state in which the polymerizable monomer and the pore-forming agents are more easily separated from each other in the region located outside the droplets than in the region located inside the droplets. In other words, the pore-forming agents tend to be present in the form of larger lumps in the region located outside the droplets than in the region located inside the droplets. As described above, the polymerization reaction, the posttreatments, and the like are performed while the forms of the pore-forming agents are different from each other between the region located inside the droplets and the region located outside the droplets. Thus, porous particles having a porosity in the near-surface region higher than the porosity in the internal region and also having a pore size in the near-surface region larger than the pore size in the internal region can be produced.

Therefore, by using, as one of the two types of pore-forming agents, a pore-forming agent having an SP value close to that of water used as the medium, the pore size and porosity near the surfaces of the porous particles can be increased. Preferred examples of the pore-forming agent used for the above means include ethyl acetate, methyl acetate, propyl acetate, isopropyl acetate, butyl acetate, acetone, and methyl ethyl ketone. On the other hand, by using, as the other of the two types of pore-forming agents, a pore-forming agent having an SP value far from that of water and having high solubility in the polymerizable monomer, the pore size and porosity inside the porous particles can be decreased. Preferred examples of the pore-forming agent used for the above means include normal hexane, normal octane, and normal dodecane.

Furthermore, regions having different porosities and pore sizes can be controlled by adjusting the ratio of the pore-forming agents used. In the present invention, however, the above-described particles are used in order to concentrate the pores only near the top of the projections formed on the surface of the charging member. From this point of view, the content of the pore-forming agent having an SP value close to that of water is preferably 30 parts by mass or less and more preferably 15 to 25 parts by mass based on 100 parts by mass of all the pore-forming agents.

[Multi-Hollow Particles]

The same resins as the porous particles can be exemplified as the material of the multi-hollow particles. These resins can be used alone or in combination of two or more. Monomers serving as raw materials of the resins may be copolymerized and the obtained copolymer may be used. These resins may be used as a main component, and other publicly known resins may be optionally added thereto.

The multi-hollow particles can be produced by a publicly known method such as a suspension polymerization method, an interfacial polymerization method, an interfacial precipitation method, or a drying-in-liquid method.

For example, in the suspension polymerization method, an oil-based mixture liquid containing a hydrophobic polymerizable monomer, a hydrophilic polymerizable monomer, and a polymerization initiator is prepared in the presence of a cross-linking agent. The oil-based mixture liquid is subjected to aqueous suspension polymerization in an aqueous medium containing a dispersion stabilizer. After the completion of the polymerization, washing and drying are performed to produce multi-hollow particles.

In this method, during the mixing of the oil-based mixture liquid and the aqueous medium, water enters droplets of the oil-based mixture liquid so as to be embraced in the droplets. Thus, multi-hollow particles having a hollow shape formed therein are obtained. Alternatively, a mixture liquid emulsified by adding water to the oil-based mixture liquid in advance may be dispersed in the aqueous medium and then subjected to suspension polymerization to obtain the multi-hollow particles.

The content of the hydrophobic monomer is preferably 70% by mass to 99.5% by mass based on the total of the hydrophobic monomer and the hydrophilic monomer. The content of the hydrophilic monomer is preferably 0.5% by mass to 30% by mass based on the total of the hydrophobic monomer and the hydrophilic monomer. This makes it easy to produce the multi-hollow particles.

Examples of the hydrophobic monomer include (meth) acrylate monomers; polyfunctional (meth)acrylate monomers; styrene monomers such as styrene, p-methylstyrene, and α-methylstyrene; and vinyl acetate. Among them, (meth) acrylate monomers are preferably used and methacrylate monomers are more preferably used in view of thermal decomposition. Examples of the (meth)acrylate monomers include methyl (meth)acrylate, ethyl (meth)acrylate, propyl (meth)acrylate, n-butyl (meth)acrylate, isobutyl (meth)acrylate, hexyl (meth)acrylate, octyl (meth)acrylate, 2-ethylhexyl (meth)acrylate, and lauryl (meth)acrylate. The hydrophobic monomers may be used in combination.

The hydrophilic monomer is, for example, a hydroxyl group-terminated polyalkylene glycol mono(meth)acrylate. Examples of the hydrophilic monomer include polyethylene glycol mono(meth)acrylate, polypropylene glycol mono (meth)acrylate, poly(ethylene glycol-propylene glycol) mono(meth)acrylate, polyethylene glycol-polypropylene glycol mono(meth)acrylate, poly(meth)acrylate, poly(propylene glycol-tetramethylene glycol) mono(meth)acrylate, and propylene glycol-polybutylene glycol mono(meth)acrylate. These hydrophilic monomers may be used in combination.

The same cross-linkable monomer as in the porous particles can be used. The content of the cross-linkable monomer is preferably 0.5% by mass to 60% by mass based on the total of the hydrophobic monomer and the hydrophilic monomer. In the above range, pores can be formed in the porous particles with certainty.

The same compounds as in the porous particles can be used for the polymerization initiator, the surfactant, and the dispersion stabilizer. The above-described polymerization initiators, dispersion stabilizers, and surfactants may each be used alone or in combination of two or more. The content of the polymerization initiator is preferably 0.01 parts by mass to 2 parts by mass based on 100 parts by mass of the monomers. The content of the dispersion stabilizer is preferably 0.5 parts by mass to 30 parts by mass based on 100 parts by mass of the monomers. The content of the surfactant is preferably 0.001 parts by mass to 0.3 parts by mass based on 100 parts by mass of water.

After the oil-based mixture liquid and the aqueous medium are mixed with each other, the polymerization reaction is performed by increasing the temperature under stirring. The polymerization temperature is preferably 40° C. to 90° C. and the polymerization time is preferably about 1 hour to 10 hours. In the above ranges, pores can be formed in the porous particles with certainty.

Herein, the average particle diameter of the multi-hollow particles can be appropriately determined by controlling the mixing conditions of the monomers and water and the stirring conditions.

[Electro-Conductive Particles]

The electro-conductive resin layer contains publicly known electro-conductive particles to achieve conductivity. Examples of the electro-conductive particles include fine particles and fibers of metals such as aluminum, palladium, iron, copper, and silver; metal oxides such as titanium oxide, tin oxide, and zinc oxide; composite particles obtained by performing a surface treatment on the surfaces of the foregoing metal fine particles, metal fibers, and metal oxides by electrolysis, spray coating, or mixing and shaking; and carbon black and carbon fine particles.

Examples of the carbon black include furnace black, thermal black, acetylene black, and Ketjenblack. Examples of the furnace black include SAF-HS, SAF, ISAF-HS, ISAF, ISAF-LS, I-ISAF-HS, HAF-HS, HAF, HAF-LS, T-HS, T-NS, MAF, FEF, GPF, SRF-HS-HM, SRF-LM, ECF, and FEF-HS. Examples of the thermal black include FT and MT. Examples of the carbon fine particles include PAN (polyacrylonitrile) carbon particles and pitch carbon particles.

As described in the preferred state of the charging member, since the electro-conductive particles form an aggregate together with the inorganic particles, the electro-conductive particles preferably contain carbon black. When the electro-conductive particles contain carbon black, the electro-conductive particles interact with the binder resin C, and thus easily form an aggregate together with the inorganic particles. This can effectively suppress abnormal discharge.

Furthermore, the carbon black is preferably used in the form of composite particles obtained by coating at least part of surfaces of inorganic particles with carbon black. In the form of the composite particles, a highly conductive aggregate composed of only carbon black is not formed, and thus abnormal discharge can be suppressed. Moreover, the dispersibility is improved and the electro-conductive particles easily form an aggregate together with the inorganic particles compared with the case where carbon black alone is used.

The electro-conductive particles listed above can be used alone or in combination of two or more.

The amount of the electro-conductive particles added to the electro-conductive resin layer is 2 parts by mass to 200 parts by mass and preferably 5 parts by mass to 100 parts by mass based on 100 parts by mass of the binder resin C.

The conductive particles may be surface-treated. Examples of a surface treatment agent include organic silicon compounds such as alkoxysilane, fluoroalkylsilane, and polysiloxane; silane coupling agents, titanate coupling agents, aluminate coupling agents, and zirconate coupling agents; and oligomers and polymer compounds. These surface treatment agents may be used alone or in combination of two or more. The organic silicon compounds such as alkoxysilane and polysiloxane, the silane coupling agents, the titanate coupling agents, the aluminate coupling agents, and the zirconate coupling agents are preferably used. The organic silicon compounds are more preferably used.

Preferably, the electro-conductive particles are finely dispersed in the resin layer. When the electro-conductive particles are finely dispersed, the conductive path of the resin layer is made uniform, which eliminates portions in which electric current suddenly flows and portions in which electric current does not flow. Thus, abnormal discharge can be suppressed. Specifically, the median size (D50 particle diameter) of the aggregate containing the electro-conductive particles and the inorganic particles in a coating solution for the resin layer is preferably 90 nm or more and 230 nm or less.

The average particle diameter of the electro-conductive particles is preferably 5 nm or more and 300 nm or less and particularly preferably 10 nm or more and 100 nm or less so as not to substantially affect the surface roughness of the charging member. The average particle diameter of the electro-conductive particles is calculated as follows. That is, the magnification of a transmission electron microscope (TEM) is adjusted so that at least 100 electro-conductive particles not subjected to aggregation are observed in a field of view. The area-equivalent diameter of each of the 100 electro-conductive particles not subjected to aggregation in the field of view is determined. A value obtained by rounding off the first decimal place of the arithmetic mean of the area-equivalent diameters of the 100 electro-conductive particles is defined as the average particle diameter of the electro-conductive particles.

[Inorganic Particles]

The resin layer preferably contains inorganic particles, in addition to the electro-conductive particles. The inorganic particles increase the charge potential of the charging member and contribute to uniform charging of a body to be charged. Furthermore, the inorganic particles form an aggregate together with the electro-conductive particles in the resin layer, and a portion having high dielectricity derived from the inorganic particles is incorporated into the conductive path. Thus, a stable conductive path is formed and more stable dischargeability can be achieved.

Examples of the inorganic particles include metal oxides, silica particles, and composite oxides such as strontium titanate particles, calcium titanate particles, and silicon titanate particles. In particular, insulating particles of metal oxides and composite oxides having a high relative dielectric constant are preferably used. Among them, silica and titanium oxide are more preferably used. Furthermore, two or more types of inorganic particles are preferably used in combination. Thus, the inorganic particles effectively form an aggregate together with the electro-conductive particles, and discharge can be stably performed.

The inorganic particles are preferably surface-treated so as to be easily dispersed in a resin-layer-forming coating solution. The surface treatment is performed with a coupling agent or a silicone oil.

[Other Materials]

The electro-conductive resin layer may further contain a release agent in order to improve the releasability. When the electro-conductive resin layer contains a release agent, smudges are prevented from adhering to the surface of the charging member and thus the durability of the charging member can be improved. In the case where the release agent is liquid, the release agent also serves as a levelling agent when the electro-conductive resin layer is formed.

[Other Treatments]

The electro-conductive resin layer may be surface-treated. Examples of the surface treatment include surface processing that uses UV or electron beams and surface modification in which a compound is attached to and/or impregnated into a surface.

[Method for Forming Resin Layer]

The resin layer is formed by, for example, coating a surface of an electro-conductive substrate with a conductive resin composition and performing drying, curing, cross-linking, or the like. Examples of the coating method include electrostatic spray coating, dip coating, roll coating, ring coating, a method in which a sheet-shaped or tube-shaped layer formed so as to have a particular thickness is subjected to bonding or coating, and a method in which a material is cured and molded into a particular shape in a mold. Among them, electrostatic spray coating, dip coating, roll coating, and ring coating are preferably used to uniformly form the resin layer for the purpose of controlling the porosity of the projections on the surface of the charging member.

When the coating method is employed, a conductive resin composition coating solution is prepared by dispersing the resin particles and other materials such as the electro-conductive particles and the inorganic particles in the binder resin C and is applied. Furthermore, a solvent is preferably used for the coating solution in order to more easily control the porosity of the resin particles. In particular, a polar solvent that can dissolve the binder resin C and has a high affinity for the resin particles is preferably used.

Specific examples of the solvent include ketones such as acetone, methyl ethyl ketone, methyl isobutyl ketone, and cyclohexanone; alcohols such as methanol, ethanol, and isopropanol; amides such as N,N-dimethylformamide and N,N-dimethylacetamide; sulfoxides such as dimethylsulfoxide; ethers such as tetrahydrofuran, dioxane, and ethylene glycol monomethyl ether; and esters such as methyl acetate and ethyl acetate.

The resin particles and other materials such as the binder resin C, the electro-conductive particles, and the inorganic particles can be dispersed in the coating solution using solution dispersing means such as a ball mill, a sand mill, a paint shaker, a Dyno-mill, or a pearl mill.

A Preferred example of a method for producing the charging member according to the present invention will be described below.

The method for producing a charging member according to the present invention includes a step (A-1) and a step (A-2) below.

(A-1) A step of forming a film of a resin-layer-forming coating solution containing a binder resin C (urethane resin), a solvent, electro-conductive particles, other materials, and resin particles having pores on a surface of an electro-conductive substrate or on a surface of another layer formed on the periphery of an electro-conductive substrate (A-2) A step of forming a resin layer by evaporating the solvent in the film The step (A-1) preferably includes the following steps (B-1) to (B-3) in order to finely disperse the electro-conductive particles or an aggregate containing the electro-conductive particles and inorganic particles and stabilize the finely dispersed state.

(B-1) A step of dispersing a polyol, a solvent, electro-conductive particles, and other materials such as inorganic particles (B-2) A step of preparing a resin-layer-forming coating solution by adding an isocyanate or an isocyanate derivative to the dispersion liquid prepared in the step (B-1) and performing mixing (B-3) A step of forming a film of the resin-layer-forming coating solution on a surface of an electro-conductive substrate or on a surface of another layer formed on the periphery of an electro-conductive substrate In the step (B-2), the dispersion states of the electro-conductive particles or the aggregate containing the electro-conductive particles and the inorganic particles in the resin layer in both the coating solution and the film can be stabilized by adding an isocyanate or an isocyanate derivative.

The resin particles having pores can be added in the step (B-1) or (B-2).

In the step (A-1) or in the step (B-1) or (B-2), the median size (D50 particle diameter) of the electro-conductive particles or the aggregate containing the electro-conductive particles and the inorganic particles is preferably adjusted to 90 nm or more and 230 nm or less. By finely dispersing the electro-conductive particles or the aggregate containing the electro-conductive particles and the inorganic particles, abnormal discharge can be stably suppressed.

In the case where porous particles are used as the resin particles having pores, when the solvent in the film is evaporated in the step (A-2), the following steps (C1) and (C2) are preferably performed to control the porosity of the resin particles in the resin layer.

(C-1) A step of replacing a solvent in the pores of the resin particles with a binder (C-2) A step of drying the film at a temperature higher than or equal to the boiling point of the solvent.

By forming the resin layer in such a manner, the porosity of the resin particles is easily adjusted within the above preferred range. Furthermore, porous particles in which the porosity and pore size near the surface are larger than those in the inside are used as the resin particles. Thus, the projections can be formed on the surface of the charging member so that the pores in the resin particles constituting the projections are concentrated in a region on the top side of the projections of the resin particles.

When the resin layer is formed by the above method, the pores can be easily controlled in the projections on the surface of the charging member as described above. The reason for this will be described below with reference to FIGS. 4A to 4E.

Figure 4A:
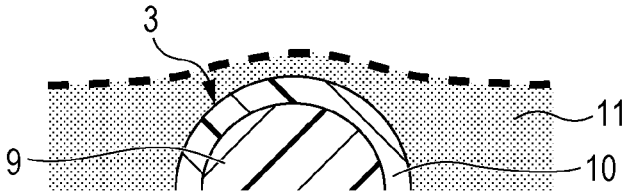
FIGS. 4A to 4E show schematic views illustrating the flow from the application of a coating solution for a resin layer of the charging member according to the present invention to the formation of pores.
Figure 4B:
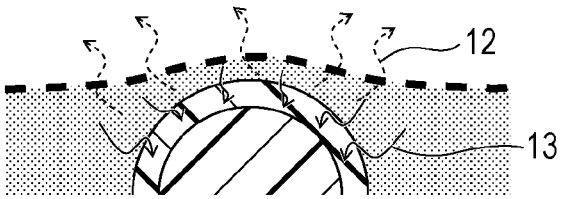

FIG. 4A is a schematic view showing a state immediately after the surface of the electro-conductive substrate is coated with a film 11 of the resin layer coating solution by the above method. The film 11 contains the solvent, the binder resin C, the electro-conductive particles, and the porous particles serving as resin particles 3, and each of the particles 3 is constituted by an internal region 9 and a near-surface region 10. In the particle 3, the porosity in the near-surface region 10 is higher than the porosity in the internal region 9 and the pore size in the near-surface region 10 is larger than the pore size in the internal region 9. In this state, it is assumed that at least the solvent and the binder resin C equally enter the inside of the pores of the particle J. Immediately after the resin layer coating solution is applied to the surface of the electro-conductive substrate, the solvent starts to evaporate from the surface of the coating solution. Since the evaporation of the solvent proceeds in a direction 12 of FIG. 4B, the concentration of the binder resin C increases on the surface side of the film 11. A force of keeping the concentrations of the solvent and the binder resin C at constant is exerted in the film 11, and thus the binder resin C in the coating solution flows in a direction 13.

On the other hand, in the internal region 9 of the particle 3, the pore size is smaller than the pore size in the near-surface region 10 and the porosity is also lower than the porosity in the near-surface region 10. Therefore, the solvent and binder resin C that equally enter the internal region 9 move more slowly than the solvent and binder resin C that enter the near-surface region 10.

Figure 4C:
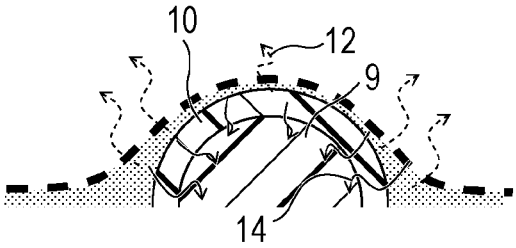

Although the binder resin C moves in the direction 13, the difference in moving speed between the internal region 9 and the near-surface region 10 of the particle results in a state in which the concentration of the binder resin C in the near-surface region 10 is higher than the concentration of the binder resin C in the internal region 9. FIG. 4C shows a state in which the concentration of the binder resin C is higher in the near-surface region 10 than in the internal region 9.

At the next moment, a flow 14 of the binder resin C is generated in such a direction that the difference in the concentration of the binder resin C between the internal region 9 and the near-surface region 10 of the particle 3 is made small. At the next moment, since the evaporation of the solvent always proceeds in the direction 12, there is provided a state in which the concentration of the binder resin C is lower in the near-surface region 10 than in the internal region 9 of the particle 3, that is, a state shown in FIG. 4D.

Figure 4D:
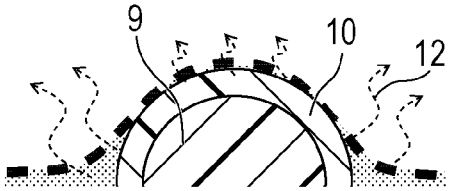
Figure 4E:
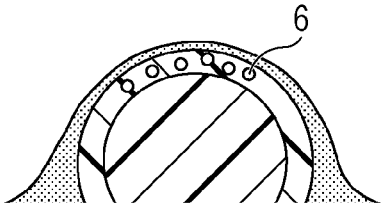

In the state shown in FIG. 4D, the applied resin layer coating solution is subjected to drying, curing, cross-linking, or the like at a temperature higher than or equal to the boiling point of the solvent used. As a result, the solvent left in the near-surface region 10 of the particle 3 rapidly evaporates and, in the end, pores 6 can be formed in the near-surface region 10 of the particle 3.

The inventors of the present invention consider that, by employing the above method, the porosity in the projections of the charging member can be controlled with certainty.

To more easily perform the control, the ratio of the porosities between the internal region and the near-surface region of the porous particles and the ratio of the pore sizes between the internal region and the near-surface region are preferably controlled. That is, the ratio of the porosity in the near-surface region to the porosity in the internal region is preferably 1.5 or more and 3 or less and the ratio of the pore size in the near-surface region to the pore size in the internal region is preferably 2 or more and 10 or less.

To control the flow of the solvent, the polar solvent having a high affinity for the porous particles is preferably used. Among the solvents described above, ketones and esters are preferably used.

In the process of drying, curing, cross-linking, or the like performed after the application of the resin layer coating solution, the temperature and time are preferably controlled. By controlling the temperature and time, the moving speeds of the solvent and the binder resin C described above can be controlled. Specifically, the process after the film formation preferably includes three or more stages. The case where the process after the film formation includes three stages will be described in detail.

At the first stage, the film is preferably left to stand at room temperature for 15 minutes or more and 1 hour or less after the film formation. This makes it easy to gently form the state shown in FIG. 4B.

At the second stage, the film is preferably left to stand at a temperature higher than or equal to room temperature and lower than or equal to the boiling point of the solvent used for 15 minutes or more and 1 hour or less. Although there is a slight difference depending on the types of solvents used, specifically, the film is more preferably left to stand at 40° C. or higher and 100° C. or lower for 30 minutes or more and 50 minutes or less. At this second stage, the evaporation rate of the solvent in FIG. 4C increases, and thus an increase in the concentration of the binder resin C in the internal region 9 of the porous particles can be more easily controlled.

At the third stage, drying, curing, cross-linking, or the like is performed at a temperature higher than or equal to the boiling point of the solvent. The temperatures at the second and third stages are preferably rapidly increased. Thus, pores are easily formed near the top of the projections. Specifically, the temperatures are preferably not controlled in the same drying furnace, and the drying furnaces at the second and third stages are preferably different furnaces or are preferably located in different areas. The time taken for transfer between the furnaces or the areas is preferably as short as possible.

As a result, the pore size in an 11% by volume-region on the top side of the projections in the resin layer of the charging member is often larger than the average pore size of the porous particles in the near-surface region. This may be because relatively large pores among pores present in the near-surface region of the porous particles are easily formed through the evaporation of the solvent.

The porosity of the resin particles is preferably 0.1% by volume or more and 2.5% by volume or less as a whole. In the above range, the gaps between the charging member and the photosensitive member are maintained while the contact area with the photosensitive member is increased, and thus the in-nip discharge can be sufficiently performed. The porosity is more preferably 1.0% by volume or more and 2.0% by volume or less. Thus, the in-nip discharge can be more effectively maintained. Moreover, the porosity of the entire resin particles is within the above range and the porosity of the resin particles on the top side of the projections is preferably 5% by volume or more and 20% by volume or less and more preferably 5.5% by volume or more and 15% by volume or less. In the above range, both the in-nip discharge and the suppression of the slippage can be more effectively achieved.

The pore size in an 11% by volume-region on the top side of the projections in the resin layer of the charging member is preferably 30 nm or more and 200 nm or less and more preferably 60 nm or more and 150 nm or less as the mean pore size. In the above range, the maintenance of the in-nip discharge and the suppression of the slippage of the charging member can be more easily achieved.

A specific example of this method will be described below in detail. First, dispersion components other than porous particles, such as electro-conductive particles and inorganic particles, are mixed into a polyol and a solvent together with glass beads having a diameter of 0.8 mm. The mixture is dispersed for 5 hours to 60 hours using a paint shaker. Subsequently, an isocyanate and resin particles having pores are added and dispersed. The dispersion time is preferably 2 minutes or more and 30 minutes or less. The necessary conditions herein are not to pulverize the resin particles having pores. Then, a conductive coating solution is prepared so as to have a viscosity of 3 to 30 mPa and preferably 3 to 20 mPa. Subsequently, a resin layer is preferably formed on the periphery of the electro-conductive substrate by dipping or the like so as to have a thickness after drying of 0.5 to 50 μm, preferably 1 to 20 μm, and more preferably 1 to 10 μm.

The thickness of the resin layer can be measured by cutting the charging member with a sharp-edged cutting-tool to obtain a cross section and observing the cross section with an optical microscope or an electron microscope. Three arbitrary points in the longitudinal direction of the charging member and three arbitrary points in the circumferential direction are selected, and the measurement is performed at nine points in total. The average of the nine thicknesses is defined as the thickness of the resin layer.

If the thickness is large, that is, if the amount of the solvent in the coating solution is small, the evaporation rate of the solvent decreases, which may make it difficult to perform the pore control. Therefore, the solid content of the coating solution is preferably relatively low. The content of the solvent in the coating solution is preferably 40% by mass or more, more preferably 50% by mass or more, and particularly preferably 60% by mass or more.

The specific gravity of the coating solution is preferably adjusted to 0.8000 or more and 1.200 or less and is more preferably adjusted to 0.8500 or more and 1.000 or less. In the above range, the speeds of the binder resin C that enters the pores of the porous particles in the inside and near the surface are easily controlled to desired speeds.

[Volume Resistivity]

The volume resistivity of the electro-conductive resin layer is preferably $1\times10^{2}$ Ω·cm or more and $1\times10^{16}$ Ω·cm or less in an environment of 23° C. and 50% RH. In the above range, the photosensitive member is more easily charged appropriately by discharge.

The volume resistivity of the electro-conductive resin layer is determined as follows. First, the electro-conductive resin layer is cut from the charging member into strips each having a length of about 5 mm, a width of about 5 mm, and a thickness of about 1 mm. A metal is evaporated onto both surfaces of each strip to obtain a measurement sample. In the case where the electro-conductive resin layer cannot be cut because of its small thickness, a film is formed by applying a conductive resin composition for forming the electro-conductive resin layer onto a surface of an aluminum sheet and a metal is evaporated onto the coated surface to obtain a measurement sample. A voltage of 200 V is applied to the obtained measurement sample using a micro-ammeter (trade name: ADVANTEST R8340A ULTRA HIGH RESISTANCE METER manufactured by ADVANTEST CORPORATION). The electric current after 30 seconds is measured, and the volume resistivity is calculated from the thickness and the electrode area. The volume resistivity of the electro-conductive resin layer can be adjusted by changing the electro-conductive particles.

The average particle diameter of the electro-conductive particles is preferably 0.01 μm to 0.9 μm and more preferably 0.01 μm to 0.5 μm. In the above range, the volume resistivity of the resin layer is easily controlled.

<Conductive Elastic Layer>

The charging member according to the present invention may include a conductive elastic layer formed between the electro-conductive substrate and the electro-conductive resin layer. Publicly known rubber or resin can be used as a binder resin for the conductive elastic layer. In order to ensure a sufficient nip between the charging member and the photosensitive member, the binder resin preferably has a relatively low elasticity and rubber is more preferably used. The rubber is, for example, natural rubber, rubber obtained by vulcanizing natural rubber, or synthetic rubber.

Examples of the synthetic rubber include ethylene-propylene rubber, styrene-butadiene rubber (SBR), silicone rubber, urethane rubber, isoprene rubber (IR), butyl rubber, acrylonitrile-butadiene rubber (NBR), chloroprene rubber (CR), acrylic rubber, epichlorohydrin rubber, and fluororubber.

The volume resistivity of the electro-conductive resin layer is preferably $10^{2}$ Ωcm or more and $10^{10}$ Ωcm or less in an environment of 23° C. and 50% RH. The volume resistivity of the conductive elastic layer can be adjusted by appropriately adding the above-described conductive fine particles and an ionic conductive agent to the binder resin. Examples of the ionic conductive agent include inorganic ionic substances such as lithium perchlorate, sodium perchlorate, and calcium perchlorate; cationic surfactants such as lauryltrimethylammonium chloride, stearyltrimethylammonium chloride, octadecyltrimethylammonium chloride, dodecyltrimethylammonium chloride, hexadecyltrimethylammonium chloride, trioctylpropylammonium bromide, and modified aliphatic dimethylethylammonium ethosulfate; amphoteric ion surfactants such as lauryl betaine, stearyl betaine, and dimethylalkyllauryl betaine; quaternary ammonium salts such as tetraethylammonium perchlorate, tetrabutylammonium perchlorate, and trimethyloctadecylammonium perchlorate; and organic acid lithium salts such as lithium trifluoromethanesulfonate. These ionic conductive agents can be used alone or in combination of two or more.

When the binder resin is a polar rubber, an ammonium salt is particularly preferably used. The conductive elastic layer may also contain additives such as plasticizing oil and a plasticizer and the above-described insulating particles, in addition to the conductive fine particles in order to adjust the hardness or the like. The conductive elastic layer can also be disposed by being bonded to the electro-conductive substrate or the electro-conductive resin layer with an adhesive. The adhesive is preferably a conductive adhesive.

The volume resistivity of the conductive elastic layer can be measured using a sample for measuring volume resistivity in the same manner as in the method for measuring the volume resistivity of the resin layer. The sample for measuring volume resistivity is prepared by molding a material to be used for the conductive elastic layer into a sheet having a thickness of 1 mm and evaporating a metal onto both surfaces of the sheet.

<Electro-Conductive Substrate>

The electro-conductive substrate used for the charging member according to the present invention has conductivity and has a function of supporting the electro-conductive resin layer or the like disposed on the periphery of the electro-conductive substrate. The electro-conductive substrate is composed of a metal such as iron, copper, stainless steel, aluminum, or nickel or an alloy thereof. A plating treatment may be performed on the surface of the electro-conductive substrate to impart scratch resistance as long as the conductivity is not impaired. Furthermore, the electro-conductive substrate may be a substrate obtained by coating the surface of a resin material with a metal so as to have a conductive surface or a substrate produced from a conductive resin composition.

<Physical Properties of Charging Member>

To achieve good electrification of the photosensitive member, the charging member according to the present invention preferably has an electrical resistance of $1\times10^{3}\Omega$ or more and $1\times10^{10}\Omega$ or less in an environment of 23° C. and 50% RH.

Figure 5:
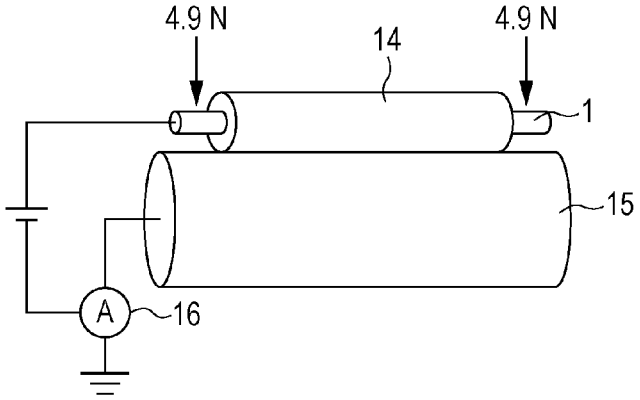
FIG. 5 shows an apparatus for measuring the electrical resistance of the charging member according to the present invention.

FIG. 5 shows an example method for measuring the electrical resistance of the charging member. By the aid of bearings through each of which a load is kept applied, a substrate 1 is supported at its both end portions on a columnar metal 15 having the same curvature radius as the photosensitive member, and in such a way that the former is in parallel to the latter, a charging member 14 is brought into contact with the columnar metal 15. In this state, the columnar metal 15 is rotated with a motor (not shown), and a direct voltage of −200 V is applied from a regulated power supply while a charging member 14 in contact with the columnar metal 15 is rotated by the rotation of the columnar metal 15. The electric current is measured with an ammeter 16 and the resistance of the charging member is calculated. In the present invention, the load was 4.9 N, and the metal column had a diameter of ϕ30 mm and was rotated at a peripheral speed of 45 mm/sec.

The charging member according to the present invention preferably has a crown shape in which the thickness is the largest at the center in the longitudinal direction and becomes smaller at both ends in the longitudinal direction, for the purpose of achieving a uniform nip width between the charging member and the photosensitive member in the longitudinal direction. The crown height is preferably 30 μm or more and 200 μm or less, which is a difference between the outer diameter at the center and the outer diameter at a position 90 mm away from the center.

The ten-point height of irregularities (Rzjis) of the surface of the charging member is preferably 8 μm or more and 100 μm or less and more preferably 12 μm or more and 60 μm or less. The ruggedness average spacing (RSm) on the surface is 20 μm or more and 300 μm or less and more preferably 50 μm or more and 200 μm or less. When Rzjis and RSm are within the above ranges, the gaps are easily formed at the nip between the charging member and the photosensitive member, and thus stable in-nip discharge can be performed.

Rzjis and RSm are measured in conformity with the standard of surface roughness in JIS B 0601-1994 using a surface roughness tester (trade name: SE-3500 manufactured by Kosaka Laboratory Ltd.). The ten-point height of irregularities is an average of surface roughness values at six positions freely selected from the charging member. In the measurement, the cutoff value is set to 0.8 mm and the evaluation length is set to 8 mm.

<Toner>

The inventors of the present invention consider that the following four points are toner requirements for maintaining high-quality development and suppressing the generation of the aggregated toner to suppress the passage of a toner through the cleaning member, which causes toner fixation and smudges on the surface of the charging member (1) Inorganic fine particles (hereafter also referred to as "an external additive") on the surface of a toner are not easily embedded in the toner.

If the external additive is embedded in the toner, the releasability below imparted to the toner by the external additive and the above-described spacer effect cannot be produced.

(2) Releasability of Toner

With the releasability, the generation of the aggregated toner can be suppressed while at the same time the fixation of toner components onto the surface of the charging member can be suppressed.

(3) Lubricity of Toner

With the lubricity, the toner components that adhere to the surface of the charging member are easily replaced.

(4) Ease of Disaggregation of Toner

With ease of disaggregation, the generation of the aggregated toner can be suppressed. To satisfy the toner requirements (1) to (4), the inventors of the present invention have defined the surface properties of silica fine particles serving as the external additive and at the same time have defined the external addition state of the silica fine particles present on the surface of the toner.

An embodiment of the present invention will be described below in detail. In the toner according to the present invention, "the surface properties of silica fine particles" are defined as follows.

The toner according to the present invention contains toner particles containing a binder resin and a colorant and also contains inorganic fine particles. Hereafter, the binder resin contained in the toner particles is also referred to as a binder resin T.

In the present invention, the inorganic fine particles are silica fine particles, and the toner contains the silica fine particles in an amount of 0.40 parts by mass or more and 1.50 parts by mass or less based on 100 parts by mass of the toner particles. The amount of the silica fine particles is preferably 0.50 parts by mass or more and 1.30 parts by mass or less based on 100 parts by mass of the toner particles.

By controlling the content of the silica fine particles in the above range, the releasability of the toner can be improved and at the same time the embedding of the external additive in the toner can be suppressed. This can suppress the passage of the toner through the cleaning member and the adhesion of smudges to the charging member.

If the content of the silica fine particles is less than 0.40 parts by mass, the releasability of the toner is not sufficiently achieved, which generates a toner that passes through the cleaning member.

In the toner according to the present invention, the silica fine particles are treated with a silicone oil in an amount of 15.0 parts by mass or more and 40.0 parts by mass or less based on 100 parts by mass of a silica raw material, and the fixation ratio (%) of the silicone oil on the basis of the amount of carbon is 70% or more.

The fixation ratio of the silicone oil on the basis of the amount of carbon corresponds to the amount of silicone oil molecules that are chemically bonded to the surface of a silica raw material.

In the silica fine particles used in the toner according to the present invention, the aggregation property and friction coefficient between the silica fine particles can be controlled to the range required in the present invention by controlling the number of parts of the silicone oil used for the treatment and the fixation ratio in the above ranges. The same properties can be imparted to the toner to which the silica fine particles have been added, which contributes to an improvement in the above effect (2). The inventors of the present invention assume the mechanism of producing such an effect to be as follows.

It is known that, when the number of parts of the silicone oil added to a silica raw material is increased, the releasability from the developing member is improved due to low surface energy of silicone oil molecules. On the other hand, the affinity between the silicone oil molecules degrades the releasability or aggregation property between the silica fine particles and also increases the friction coefficient between the silica fine particles. The present invention features silica fine particles treated with a relatively large number of parts of the silicone oil and having a high fixation ratio. Such silica fine particles can increase the friction coefficient without degrading the aggregation property between the silica fine particles. The inventors of the present invention consider that, by fixing the terminal of the silicone oil molecules on the surface of a silica raw material, the degradation of the aggregation property can be suppressed. This can suppress the generation of the aggregated toner and can also suppress the passage of the toner through the cleaning member and the adhesion of smudges to the charging member.

Next, the influence, on the toner surface, of the external addition of the silica fine particles to the toner particles will be described. In the range of the below-described coverage ratio X1, which is a ratio of a toner surface coated with silica fine particles, when particles of the toner contact each other, the contact between silica fine particles present on the surfaces of toner particles is dominant from a microscopic point of view and thus the toner is also strongly affected by the properties of the silica fine particles. Therefore, the toner according to the present invention is a toner including particles whose friction coefficient is increased without degrading the aggregation property between the particles of the toner. This allows to simultaneously achieve the effects (2) and (3). This can suppress the generation of the aggregated toner and the passage of the toner through the cleaning member. At the same time, the adhesion of toner components to the surface of the charging member is suppressed, which can suppress smudges formed on the charging member.

If the number of parts of the silicone oil used for the treatment is less than 15.0 parts by mass, a sufficient friction coefficient cannot be achieved, which degrades the circulation property of the toner. If the number of parts of the silicone oil is more than 40.0 parts by mass, a sufficient friction coefficient can be achieved, but it is difficult to control the fixation ratio in an appropriate range. This degrades the aggregation property between the silica fine particles and thus the effect (4) cannot be achieved.

Furthermore, if the fixation ratio of the silicone oil on the basis of the amount of carbon is less than 70%, the aggregation property between the silica fine particles degrades and thus the effect (4) cannot be achieved. As a result, the passage of the toner through the cleaning member is generated.

The number of parts of the silicone oil used for the treatment of the silica fine particles is preferably 17.0 parts by mass or more and 30.0 parts by mass or less based on 100 parts by mass of a silica raw material. Furthermore, the fixation ratio (%) of the silicone oil on the basis of the amount of carbon is preferably 90% or more. Thus, the above effects can be further produced.

In the toner according to the present invention, "the external addition state of silica fine particles" is defined as follows.

In the toner, the coverage ratio X1, which is a ratio of a toner surface coated with silica fine particles and is determined with an X-ray photoelectron spectrometer (ESCA), is 50.0 area % or more and 75.0 area % or less. In the toner, when the theoretical coverage ratio with silica fine particles is assumed to be X2, the diffusion index represented by the following formula 1 satisfies the following formula 2.

$$\text{Diffusion index}=X1/X2 \quad \text{(Formula 1)}$$

$$\text{Diffusion index} \geq -0.0042 \times X1+0.62 \quad \text{(Formula 2)}$$

The coverage ratio X1 can be calculated from the ratio of the detection intensity of Si in the measurement of the toner using ESCA to the detection intensity of Si in the measurement of silica fine particles alone. The coverage ratio X1 indicates an area percentage at which the surfaces of the toner particles are actually coated with the silica fine particles.

When the coverage ratio X1 is 50.0 area % or more and 75.0 area % or less, the flowability and electrification of the toner can be controlled to good states throughout a durability test. If the coverage ratio X1 is less than 50.0 area %, the ease of disaggregation of the toner described below cannot be sufficiently achieved. Therefore, under the strict evaluation conditions described above, the degradation of the toner decreases the flowability and the durability cannot be improved because of poor releasability from the developing member.

The theoretical coverage ratio X2 with silica fine particles can be calculated from the following formula 4 using the number of parts by mass of the silica fine particles based on 100 parts by mass of the toner particles, the particle diameter of the silica fine particles, and the like. The theoretical coverage ratio X2 indicates an area percentage at which the surfaces of the toner particles can be theoretically coated with the silica fine particles.

$$\text{Theoretical coverage ratio } X2 \text{ (area \%)}=3^{1/2}/(2\pi)\times(dt/da)\times(\rho t/\rho a)\times C\times 100 \quad \text{(Formula 4)}$$

da: the number-average particle diameter (D1) of silica fine particles dt: the weight-average particle diameter (D4) of toner ρa: the true specific gravity of silica fine particles ρt: the true specific gravity of toner C: the mass of silica fine particles/the mass of toner (for C, the content of the silica fine particles in the toner, which is described below, is used)

The physical implication of the diffusion index represented by the formula 1 will be described below.

The diffusion index shows a divergence between the actually measured coverage ratio X1 and the theoretical coverage ratio X2. The degree of the divergence is believed to indicate the number of silica fine particles stacked on the surfaces of the toner particles in a vertical direction so as to form two or three layers. The diffusion index is ideally 1, but this is the case where the coverage ratio X1 matches the theoretical coverage ratio X2, and two or more layers of the silica fine particles are not present at all. When the silica fine particles are present on the toner surface in the form of aggregated secondary particles, a divergence arises between the actually measured coverage ratio and the theoretical coverage ratio, which decreases the diffusion index. In other words, the diffusion index indicates the amount of the silica fine particles present in the form of secondary particles.

In the present invention, it is important that the diffusion index is in the range indicated by the formula 2. This range is believed to be larger than that of toners produced by conventional techniques. A large diffusion index indicates that among the silica fine particles on the surfaces of the toner particles, a small amount of the silica fine particles is present in the form of secondary particles and a large amount of the silica fine particles is present in the form of primary particles. As described above, the upper limit of the diffusion index is 1.

The inventors of the present invention have found that when both the coverage ratio X1 and the diffusion index satisfy the range indicated by the formula 2, the ease of disaggregation of the toner upon the application of pressure can be considerably improved.

Hitherto, it has been believed that the ease of disaggregation of the toner is improved by the external addition of a large amount of an external additive having a small particle diameter of about several nanometers to increase the coverage ratio X1. On the other hand, as a result of studies conducted by the inventors of the present invention, it has been found that when the ease of disaggregation of toners having the same coverage ratio X1 but different diffusion indices is measured, there is a difference in ease of disaggregation between the toners. It has also been found that when the ease of disaggregation is measured under pressure, a significant difference is observed. In particular, the inventors of the present invention consider that the behavior of the toner in a state under pressure, which is typified by a transfer step, is reflected in the ease of disaggregation of the toner under pressure. Thus, the inventors of the present invention consider that in order to more closely control the ease of disaggregation of the toner under pressure, the diffusion index is very important in addition to the coverage ratio X1.

The inventors of the present invention assume the following reason why the toner satisfactorily has ease of disaggregation when both the coverage ratio X1 and the diffusion index satisfy the range indicated by the formula 2. That is, when the toner is present in a narrow, high-pressure place, such as a blade nip, particles of the toner are easily brought into an "interlocked" state so that particles of the external additive present on the surfaces do not collide with one another. At this time, when a large number of silica fine particles are present in the form of secondary particles, the influence of interlocking is excessively increased. It is thus difficult to rapidly disaggregate the particles of the toner.

In particular, in the case where the toner has degraded, the silica fine particles present in the form of primary particles are buried in the surfaces of the toner particles, which reduces the flowability of the toner. At that time, the influence of interlocking between silica fine particles which are not buried and which are present in the form of secondary particles is presumably increased to degrade the ease of disaggregation of the toner. In the toner according to the present invention, most of the silica fine particles are present in the form of primary particles; hence, even if the toner has degraded, interlocking between particles of the toner is less likely to occur. Even when the toner is subjected to rubbing in a transfer step or the like, the toner is easily disaggregated into individual particles. That is, "the ease of disaggregation of the toner" described in the requirement (4), which has been difficult to improve only by the control of the coverage ratio X1 in the related art, can be markedly improved.

Furthermore, the inventors of the present invention have found that when both the coverage ratio X1 and the diffusion index satisfy the range indicated by the formula 2, the degree of progress of the degradation of the toner is considerably reduced. The reason for this is presumably that in the case where the silica fine particles on the surfaces of the toner particles are present in the form of primary particles, even if particles of the toner come into contact with each other, the silica fine particles are less likely to come into contact with each other, and a pressure applied to the silica fine particles is reduced. That is, the effect (1) described above can be produced.

The boundary line of the diffusion index in the present invention is expressed as a function of the coverage ratio X1 serving as a variable in the range of a coverage ratio X1 of 50.0 area % or more and 75.0 area % or less. The function was empirically obtained from a phenomenon in which when the coverage ratio X1 and the diffusion index are determined by changing silica fine particles, external addition conditions, and the like, the toner is sufficiently easily disaggregated upon the application of pressure.

As described above, by controlling the ease of disaggregation of the toner, the generation of the passage of a toner through the cleaning member can be suppressed. Furthermore, when the particles of the toner are sparsely present, the pressure applied to the particles of the toner from the charging member is reduced, which suppresses the adhesion and fixation of smudges to the surface of the charging member.

Figure 6:
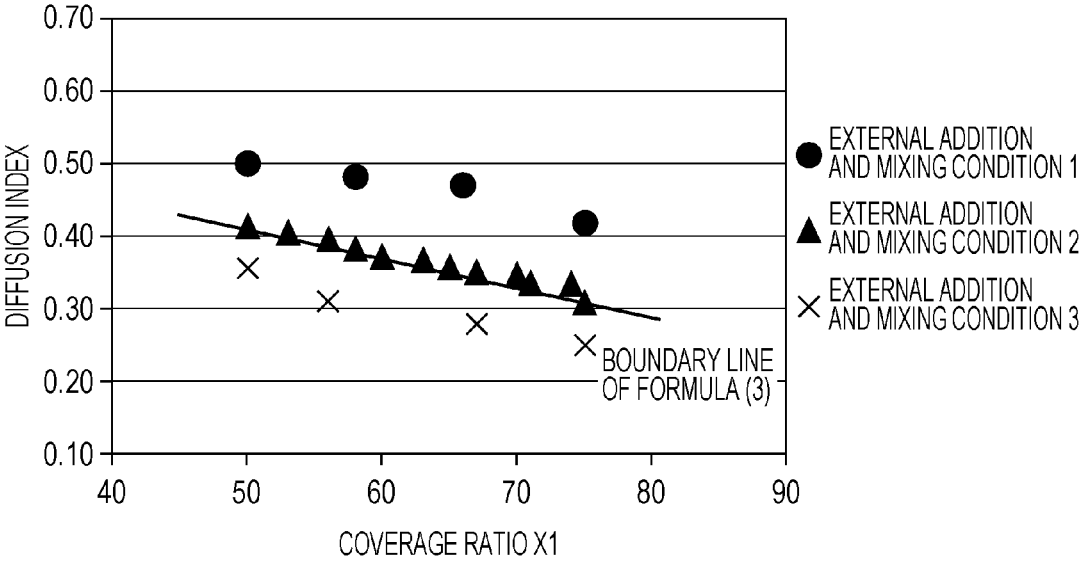
FIG. 6 shows the boundary line of a diffusion index of a toner according to the present invention.

FIG. 6 is a graph plotting the relationship between the coverage ratio X1 and the diffusion index when toners having freely-selected different coverage ratios X1 are produced under three different external addition and mixing conditions by changing the amounts of silica fine particles added. It has been found that among these toners plotted in this graph, the toner plotted in the region that satisfies the formula 2 has sufficiently improved ease of disaggregation upon the application of pressure.

The inventors of the present invention assume the reason why the diffusion index is dependent on the coverage ratio X1 as follows. To improve the ease of disaggregation of the toner upon the application of pressure, a smaller amount of the silica fine particles present in the form of secondary particles is better, but the ease of disaggregation is also more or less affected by the coverage ratio X1. The ease of disaggregation of the toner is gradually improved as the coverage ratio X1 increases. Thus, the allowable amount of the silica fine particles present in the form of secondary particles is increased. In this manner, the boundary line of the diffusion index is considered to be expressed as a function of the coverage ratio X1 serving as a variable. That is, it was experimentally determined that a correlation exists between the coverage ratio X1 and the diffusion index and that it is important to control the diffusion index in accordance with the coverage ratio X1.

In the case where the diffusion index is in the range indicated by the following formula 3, a large amount of the silica fine particles is present in the form of secondary particles. This causes lack of ease of disaggregation of the toner. Thus, the passage of the toner through the cleaning member occurs, which further degrades the adhesion and fixation of the toner to the surface of the charging member.

$$\text{diffusion index} < -0.0042 \times X1 + 0.62 \qquad \text{(Formula 3)}$$

As described above, in order to suppress the passage of the toner through the cleaning member and the smudge on the charging member, the inventors of the present invention consider that the toner is required to satisfy the requirements (1) to (4) described above. It is speculated that as a result of the combined effect produced by the control of both "the surface properties of the silica fine particles" and "the external addition state of the silica fine particles", the toner provides the characteristics (1) to (4) and the use of the toner together with the charging member according to the present invention can overcome the foregoing problems.

The toner according to the present invention contains a colorant. The colorant preferably used in the present invention is as follow.

Examples of organic pigments or organic dyes that serve as cyan colorants include copper phthalocyanine compounds and the derivatives thereof, anthraquinone compounds, and basic dye lake compounds.

Examples of organic pigments or organic dyes that serve as magenta colorants include condensed azo compounds, diketopyrrolopyrrole compounds, anthraquinone, quinacridone compounds, basic dye lake compounds, naphthol compounds, benzimidazolone compounds, thioindigo compounds, and perylene compounds.

Examples of organic pigments or organic dyes that serve as yellow colorants include condensed azo compounds, isoindolinone compounds, anthraquinone compounds, azo metal complexes, methine compounds, and allylamide compounds.

Examples of black colorants include carbon black; and black colorants prepared by mixing the foregoing yellow colorants, the foregoing magenta colorants, and the foregoing cyan colorants.

In the case where a colorant is used, the colorant is preferably added in an amount of 1 part by mass or more and 20 parts by mass or less based on 100 parts by mass of a polymerizable monomer or the binder resin T.

The toner according to the present invention may contain a magnetic material. In the present invention, the magnetic material may also serve as a colorant.

The magnetic material used in the present invention is mainly composed of, for example, triiron tetroxide or γ-iron oxide, and may contain an element such as phosphorus, cobalt, nickel, copper, magnesium, manganese, or aluminum. Examples of the shape of the magnetic material include polyhedral, octahedral, hexahedral, spherical, needle-like, and flaky shapes. Shapes having a low degree of anisotropy, such as polyhedral, octahedral, hexahedral, and spherical shapes, are preferred for the purpose of increasing the image density. The content of the magnetic material in the present invention is preferably 50 parts by mass or more and 150 parts by mass or less based on 100 parts by mass of the polymerizable monomer or the binder resin T.

The toner according to the present invention preferably contains a wax. The wax preferably contains a hydrocarbon wax. Examples of other waxes include amide waxes, higher fatty acids, long-chain alcohols, ketone waxes, ester waxes, and the derivatives of the foregoing, such as graft compounds and block compounds. Two or more types of waxes may be used in combination when necessary. Among these waxes, when a hydrocarbon wax prepared by a Fischer-Tropsch process is employed, the hot offset resistance can be favorably maintained while satisfactory developability is maintained for a long time. The hydrocarbon wax may contain an antioxidant to the extent that the antioxidant does not affect the chargeability of the toner.

The content of the wax is preferably 4.0 parts by mass or more and 30.0 parts by mass or less and more preferably 16.0 parts by mass or more and 28.0 parts by mass or less based on 100 parts by mass of the binder resin T.

In the toner according to the present invention, the toner particles may optionally contain a charge control agent. The addition of the charge control agent results in stable charging characteristics, thus enabling the control of the optimal amount of triboelectric charge based on a development system.

A publicly known charge control agent can be used as the charge control agent. In particular, a charge control agent having a high charging speed and being capable of stably maintaining a certain amount of charge is preferred. In the case where the toner particles are produced by a direct polymerization process, a charge control agent having low polymerization inhibiting properties and containing substantially no substance soluble in an aqueous medium is particularly preferred.

These charge control agents may be contained in the toner according to the present invention singly or in combination of two or more.

The amount of the charge control agent added is preferably 0.3 parts by mass or more and 10.0 parts by mass or less and more preferably 0.5 parts by mass or more and 8.0 parts by mass or less based on 100 parts by mass of the polymerizable monomer or the binder resin T.

The toner according to the present invention includes toner particles and inorganic fine particles. In the present invention, the inorganic fine particles are silica fine particles.

The silica fine particles used in the present invention are produced by subjecting 100 parts by mass of a silica raw material to a hydrophobic treatment with 15.0 parts by mass or more and 40.0 parts by mass or less of a silicone oil. Regarding the degree of the hydrophobic treatment, the degree of hydrophobicity measured by a methanol titration test is preferably 70% or more and more preferably 80% or more from the viewpoint of suppressing a reduction in chargeability in a high-temperature and high-humidity environment.

Examples of the silicone oil include dimethyl silicone oil, methylphenyl silicone oil, α-methylstyrene-modified silicone oil, chlorophenyl silicone oil, and fluorine-modified silicone oil.

In the present invention, the silicone oil used for the treatment of the silica fine particles preferably has a kinematic viscosity of 30 cSt or more and 500 cSt or less at 25° C. When the kinematic viscosity is in the above range, it is easy to control the uniformity upon subjecting the silica raw material to the hydrophobic treatment with the silicone oil. Furthermore, the kinematic viscosity of the silicone oil correlates closely with the molecular chain length of the silicone oil. When the kinematic viscosity is in the above range, the degree of aggregation of the silica fine particles is easily controlled in a suitable range, which is preferred. The silicone oil more preferably has a kinematic viscosity of 40 cSt or more and 300 cSt or less at 25° C. Examples of an instrument for measuring the kinematic viscosity of the silicone oil include a capillary kinematic viscometer (manufactured by Kaburagi Scientific Instruments Ltd.) and an automatic small-sample-volume kinematic viscometer (manufactured by Viscotech Co., Ltd.).

The silica fine particles used in the present invention are preferably produced by treating the silica raw material with the silicone oil and subsequently with at least one of an alkoxysilane and a silazane. In this case, a surface portion of the silica raw material that has not been subjected to the hydrophobic treatment with the silicone oil can be subjected to the hydrophobic treatment. It is thus possible to stably produce silica fine particles having a high degree of hydrophobicity. Furthermore, the ease of disaggregation of the toner is considerably improved, which is preferred. Although the details of the reason why the ease of disaggregation is improved are not yet understood, the inventors of the present invention believe the reason as follows. Among terminals of silicone oil molecules on the surfaces of the silica fine particles, only one terminal of each of the silicone oil molecules has the degree of freedom and affects the aggregation property between the silica fine particles. When the two-stage treatment described above is performed, few terminals of the silicone oil molecules are present on the outermost surfaces of the silica fine particles, and thus the aggregation property of the silica fine particles can be further reduced. This results in a considerable reduction in the aggregation property between particles of the toner when external addition is performed, which can improve the ease of disaggregation of the toner.

In the present invention, examples of the silica raw material that can be used include so-called dry silica such as fumed silica formed by the vapor phase oxidation of a silicon halide; and so-called wet silica produced from, for example, water glass.

The silica fine particles used in the present invention may be subjected to a disintegration treatment during or after the above treatment process. Furthermore, if the two-stage treatment is performed, the disintegration treatment may be performed between the stages.

The surface treatment of the silica raw material with the silicone oil and the surface treatment of the silica raw material with the alkoxysilane and the silazane may be performed by a dry process or a wet process.

A specific procedure for the surface treatment of the silica raw material with the silicone oil is as follows. For example, the silica fine particles are added to a solvent containing the silicone oil dissolved therein (the pH is preferably adjusted to 4 with an organic acid or the like) to cause the reaction. Then, the solvent is removed. Thereafter, the disintegration treatment may be performed.

A specific procedure for the surface treatment with at least one of the alkoxysilane and the silazane is as follows.

Silicone oil-treated silica fine particles subjected to the disintegration treatment are added to a solvent containing at least one of the alkoxysilane and the silazane dissolved therein to cause the reaction. Then, the solvent is removed. Thereafter, the disintegration treatment is performed. Alternatively, the following method may be employed. For example, in the surface treatment with the silicone oil, the silica fine particles are charged into a reaction vessel. An aqueous alcohol solution is added thereto in a nitrogen atmosphere under stirring. The silicone oil is introduced into the reaction vessel to perform the surface treatment. The mixture is heated under stirring to remove the solvent. Then, the disintegration treatment is performed. In the surface treatment with at least one of the alkoxysilane and the silazane, at least one of the alkoxysilane and the silazane is introduced to perform the surface treatment in a nitrogen atmosphere under stirring. The mixture is heated under stirring to remove a solvent. Then, cooling is performed.

Preferred examples of the alkoxysilane include methyltrimethoxysilane, dimethyldimethoxysilane, phenyltrimethoxysilane, methyltriethoxysilane, dimethyldiethoxysilane, and phenyltriethoxysilane. A preferred example of the silazane is hexamethyldisilazane.

Regarding the amount of at least one of the alkoxysilane and the silazane used for the treatment, the total amount of at least one of the alkoxysilane and the silazane is 0.1 parts by mass or more and 20.0 parts by mass or less based on 100 parts by mass of the silica raw material.

To increase the fixation ratio of the silicone oil on the basis of the amount of carbon in the silica fine particles, the silicone oil needs to be chemically fixed to the surface of the silica raw material in the course of the production of the silica fine particles. To that end, a method in which a heat treatment is performed for the reaction of the silicone oil in the course of the production of the silica fine particles is suitably exemplified. The heat-treatment temperature is preferably 100° C. or higher. A higher heat-treatment temperature results in an increase in fixation ratio. The heat-treatment process is preferably performed immediately after the treatment with the silicone oil. If the disintegration treatment is performed, the heat-treatment process may be performed after the disintegration treatment process.

The silica fine particles used in the present invention preferably have an apparent density of 15 g/L or more and 50 g/L or less. The fact that the apparent density of the silica fine particles is in the above range indicates that the silica fine particles are not so closely packed, are present with a large amount of air interposed between the fine particles, and have a very low apparent density. Thus, particles of the toner are not so closely packed, which can considerably reduce the rate of degradation. The silica fine particles more preferably have an apparent density of 18 g/L or more and 45 g/L or less.

Examples of a method for controlling the apparent density of the silica fine particles to the above range include adjustments of the particle diameter of the silica raw material used for the silica fine particles, whether the foregoing disintegration treatment is performed or not and the intensity of the disintegration treatment, and the amount of the silicone oil used for the treatment. A smaller particle diameter of the silica raw material results in a higher BET specific surface area of the resulting silica fine particles; hence, a larger amount of air can be interposed to reduce the apparent density. Relatively large secondary particles contained in the silica fine particles can be disintegrated into relatively small secondary particles by performing the disintegration treatment, which can reduce the apparent density.

To impart satisfactory flowability to the toner, the silica raw material used in the present invention preferably has a specific surface area of 130 $m^2/g$ or more and 330 $m^2/g$ or less, the specific surface area being measured by the BET method using nitrogen adsorption (BET specific surface area). In the above range, the flowability and the chargeability imparted to the toner are provided throughout endurance running. The silica raw material more preferably has a BET specific surface area of 200 $m^2/g$ or more and 320 $m^2/g$ or less.

Measurement of the specific surface area measured by the BET method using nitrogen adsorption (BET specific surface area) is conducted in conformity with JIS Z 8830 (2001). "A surface area and porosimetry analyzer TriStar 3000 (manufactured by Shimadzu Corporation)", which employs constant volume gas adsorption as a method of measurement, is used as the measurement instrument.

The primary particles of the silica raw material used in the present invention preferably have a number-average particle diameter of 3 nm or more and 50 nm or less and more preferably 5 nm or more and 40 nm or less.

The toner according to the present invention preferably has a weight-average particle diameter (D4) of 5.0 μm or more and 10.0 μm or less and more preferably 5.5 μm or more and 9.5 μm or less in view of the balance between the developability and fixability.

In the present invention, the toner particles preferably have an average circularity of 0.960 or more and more preferably 0.970 or more. When the toner particles have an average circularity of 0.960 or more, each of particles of the toner has a spherical shape or an approximately spherical shape. Thus, the toner has excellent flowability and easily acquires uniform triboelectric chargeability. Therefore, high developability is easily maintained even in the latter half of endurance running, which is preferred. In addition, the toner particles having a high average circularity are preferred because they easily permit the ranges of the coverage ratio X1 and the diffusion index to be controlled in the scope of the present invention in the external addition treatment of the inorganic fine particles described below. Furthermore, also from the viewpoint of the ease of disaggregation of the toner upon the application of pressure, the interlocking effect due to the surface shape of the toner particles is less likely to be provided, thereby further improving the ease of disaggregation, which is preferred.

A method for producing the toner according to the present invention will be exemplified below, but is not limited thereto.

In the toner according to the present invention, the number of parts of the silica fine particles treated with the silicone oil, the fixation ratio of the silicone oil on the basis of the amount of carbon, the coverage ratio X1, and the diffusion index can be adjusted. Preferably, in a production method including a step of adjusting the average circularity, other production steps are not particularly limited, and the toner can be produced by a publicly known method.

In the case of production by a pulverization method, for example, the binder resin T, the colorant, and optionally other additives such as a release agent are thoroughly mixed with a mixer, for example, a Henschel mixer or a ball mill. Then, the mixture is melt-kneaded with a heating kneader such as a heating roller, a kneader, or an extruder to disperse or melt the toner materials. The mixture is solidified by cooling. After pulverization, classification and optionally a surface treatment are performed to obtain toner particles. The order of the classification and the surface treatment may be freely selected. In the classification process, a multi-division classifier is preferably used in view of production efficiency.

The pulverization can be performed by a method that uses a publicly known pulverizer such as a mechanical impact-type pulverizer or a jet-type pulverizer. To produce a toner having a preferable circularity, it is preferable to perform pulverization by further applying heat or to perform a treatment of applying an auxiliary mechanical impact force. Alternatively, a hot-water bath method in which toner particles finely pulverized (and optionally classified) are dispersed in hot water or a method in which the toner particles are passed through hot-air stream may be employed.

Examples of means for applying a mechanical impact force include a method that uses a mechanical impact-type pulverizer such as a Kryptron system manufactured by Kawasaki Heavy Industries, Ltd., or Turbo mill manufactured by Turbo Kogyo Co., Ltd. and a method in which a mechanical impact force is applied to a toner by a compressive force or friction force with an apparatus such as a mechanofusion system manufactured by Hosokawa Micron Corporation or a hybridization system manufactured by Nara Machinery Co., Ltd.

The toner particles used in the present invention are preferably produced by a method in which the toner is produced in an aqueous medium. Examples of the method include a dispersion polymerization method, an association aggregation method, a dissolution suspension method, and a suspension polymerization method. The toner particles are more preferably produced by the suspension polymerization method.

In the suspension polymerization method, a polymerizable monomer, a colorant, and optionally other additives such as a polymerization initiator, a cross-linking agent, and a charge control agent are uniformly dissolved or dispersed to prepare a polymerizable monomer composition. Then, the polymerizable monomer composition is dispersed in a continuous phase (for example, an aqueous phase) containing a dispersion stabilizer with an appropriate stirrer. The polymerizable monomer in the polymerizable monomer composition is polymerized to prepare toner particles having a desired particle diameter. The toner particles prepared by the suspension polymerization method (hereafter also referred to as "polymerized toner particles) are preferred because the individual toner particles have a substantially spherical shape, the toner particles satisfy a predetermined average circularity, and the distribution of the amount of charge is relatively uniform.

In the production of the polymerized toner particles according to the present invention, a publicly known monomer can be used as the polymerizable monomer in the polymerizable monomer composition. Preferably, styrene or a styrene derivative is used alone or is used in combination with another polymerizable monomer in view of the developing characteristics and the durability of the toner.

In the present invention, the polymerization initiator used in the suspension polymerization method preferably has a half-life of 0.5 hours or more and 30.0 hours or less during the polymerization reaction. The amount of the polymerization initiator added is preferably 0.5 parts by mass or more and 20.0 parts by mass or less based on 100 parts by mass of the polymerizable monomer.

Specific examples of the polymerization initiator include azo or diazo-based polymerization initiators; and peroxide-based polymerization initiators.

In the suspension polymerization method, a cross-linking agent may be added during the polymerization reaction. The amount of the cross-linking agent added is preferably 0.1 parts by mass or more and 10.0 parts by mass or less based on 100 parts by mass of the polymerizable monomer. Here, a compound having two or more polymerizable double bonds is mainly used as the cross-linking agent. Examples of the cross-linking agent include aromatic divinyl compounds, carboxylates each having two double bonds, divinyl compounds, and compounds each having three or more vinyl groups. These cross-linking agents may be used alone or in combination as a mixture of two or more.

The production of the toner particles by the suspension polymerization method will be specifically described below, but is not limited thereto. First, the polymerizable monomer and the colorant described above are appropriately added and uniformly dissolved or dispersed with a disperser such as a homogenizer, a ball mill, or an ultrasonic disperser to prepare a polymerizable monomer composition. The polymerizable monomer composition is suspended in a dispersion stabilizer-containing aqueous medium. At this time, when a disperser such as a high-speed agitator or an ultrasonic disperser is used to achieve a desired toner particle size in one operation, the resulting toner particles have a narrow particle size distribution. Regarding the timing of the addition of the polymerization initiator, the polymerization initiator may be added simultaneously with the addition of the other additives to the polymerizable monomer or may be added immediately before the composition is suspended in the aqueous medium. Alternatively, the polymerization initiator dissolved in the polymerizable monomer or a solvent may be added immediately after granulation and before the initiation of the polymerization reaction.

After the granulation, stirring may be performed with a common stirrer in such a manner that the particle state is maintained and that the floating and settling of the particles are prevented.

A publicly known surfactant, an organic dispersant, or an inorganic dispersant can be used as the dispersion stabilizer. In particular, the inorganic dispersant is preferably used because the inorganic dispersant does not readily generate a harmful ultrafine powder, its steric hindrance provides dispersion stability, the stability is not readily degraded even if the reaction temperature is changed, cleaning is easily conducted, and the inorganic dispersant is less likely to adversely affect the toner. Examples of the inorganic dispersant include polyvalent metal salts of phosphoric acid, such as tricalcium phosphate, magnesium phosphate, aluminum phosphate, zinc phosphate, and hydroxyapatite; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

Each of the inorganic dispersants is preferably used in an amount of 0.20 parts by mass or more and 20.00 parts by mass or less based on 100 parts by mass of the polymerizable monomer. These dispersion stabilizers may be used alone or in combination of two or more. Furthermore, a surfactant may be used together in an amount of 0.0001 parts by mass or more and 0.1000 parts by mass or less based on 100 parts by mass of the polymerizable monomer.

In the polymerization reaction of the polymerizable monomer, the polymerization temperature is set to 40° C. or higher and commonly 50° C. or higher and 90° C. or lower.

After the completion of the polymerization of the polymerizable monomer, the resulting polymer particles are filtered, washed, and dried by publicly known methods to obtain toner particles. The silica fine particles, which are inorganic fine particles, are externally added to and mixed with the toner particles to cause the silica fine particles to adhere to the surfaces of the toner particles. Thus, the toner according to the present invention is obtained. A classification step may be performed in the production process (before the mixing of the inorganic fine particles) to remove a coarse powder and a fine powder contained in the toner particles.

In addition to the above silica fine particles, the toner according to the present invention may further contain particles with the primary particles having a number-average particle diameter (D1) of 80 nm or more and 3 μm or less. Examples of the particles include lubricants such as a fluorocarbon resin powder, a zinc stearate powder, and a polyvinylidene fluoride powder; abrasives such as a cerium oxide powder, a silicon carbide powder, and a strontium titanate powder; and spacer particles such as silica. These particles can be used in a small amount to the extent that the advantageous effects of the present invention are not affected.

A publicly known mixing treatment apparatus can be used as a mixing treatment apparatus for the external addition and mixing of the silica fine particles. An apparatus shown in FIG. 7 is preferably used from the viewpoint of easily controlling the coverage ratio X1 and the diffusion index.

Figure 7:
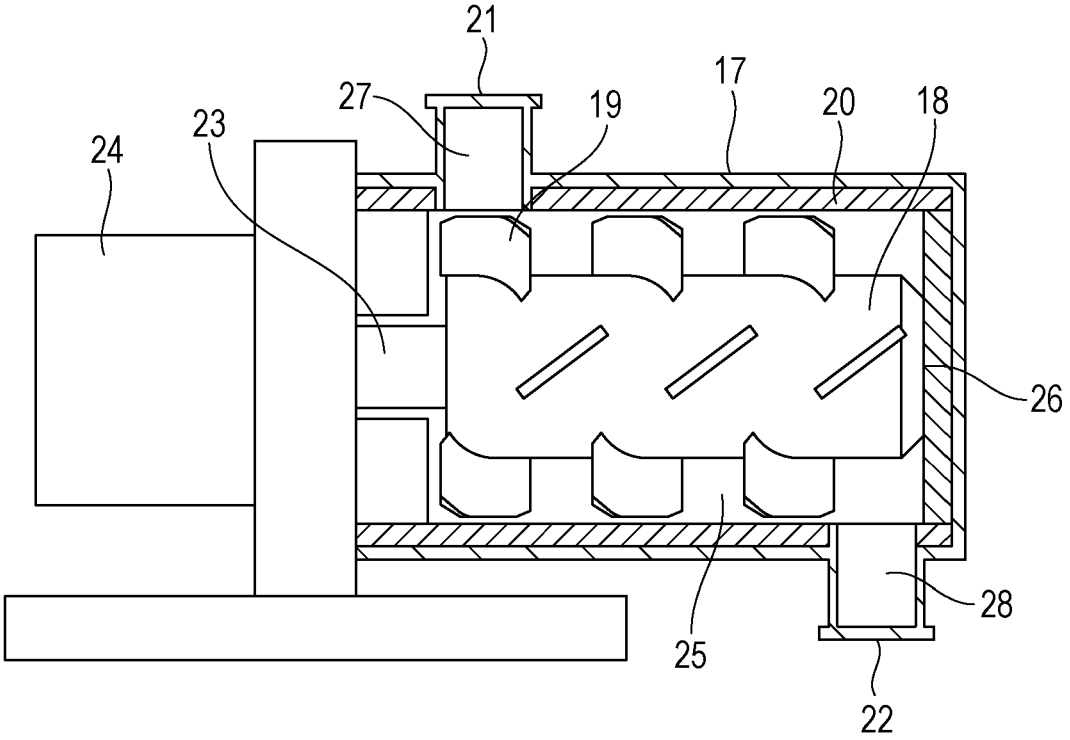
FIG. 7 shows a schematic cross-sectional view according to one aspect of a mixing treatment apparatus that can be used for external addition and mixing of inorganic fine particles according to the present invention.

FIG. 7 is a schematic view showing an example of a mixing treatment apparatus that can be used to perform the external addition and mixing of the silica fine particles used in the present invention.

In the mixing treatment apparatus, the toner particles and the silica fine particles are sheared in a narrow clearance portion. Thus, the silica fine particles adhere to the surfaces of the toner particles while the silica fine particles are being disaggregated from secondary particles to primary particles.

Furthermore, as described below, the toner particles and the silica fine particles are readily circulated in the axial direction of a rotary member and thus sufficiently uniformly mixed with each other before the progress of fixation. Therefore, the coverage ratio X1 and the diffusion index are easily controlled in preferred ranges in the present invention.

Figure 8:
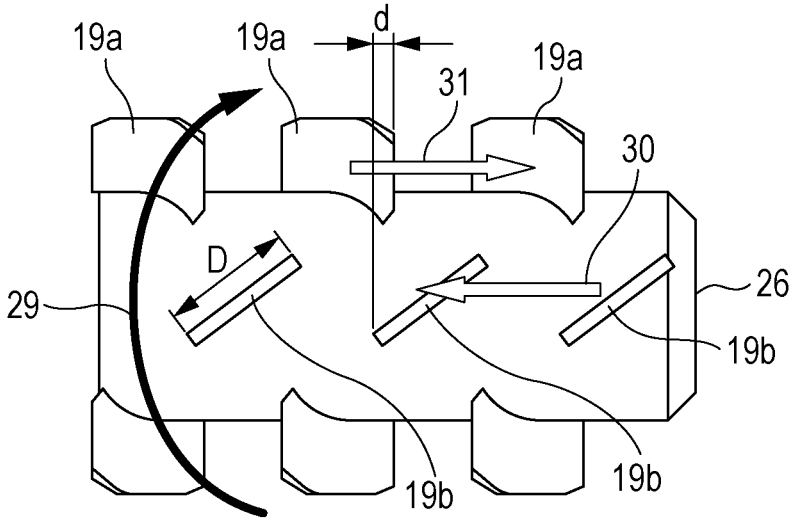
FIG. 8 shows a schematic cross-sectional view according to one aspect of a structure of a stirring member used in the mixing treatment apparatus according to the present invention.

FIG. 8 is a schematic view showing an example of a structure of a stirring member used in the mixing treatment apparatus.

The external addition and mixing process of the silica fine particles will be described below with reference to FIGS. 7 and 8.

The mixing treatment apparatus configured to perform the external addition and mixing of the silica fine particles includes a rotary member 18 with a surface on which at least a plurality of stirring members 19 are disposed, a drive member 24 configured to rotate the rotary member 18, and a main body casing 17 disposed so as to have a gap between the stirring members 19 and the main body casing 17.

It is important that the gap (clearance) between the inner peripheral portion of the main body casing 17 and the stirring members 19 is kept constant and very small in order to uniformly apply shear to the toner particles and allow the silica fine particles to easily adhere to the surfaces of the toner particles while disaggregating the silica fine particles from secondary particles to primary particles.

In the mixing treatment apparatus, the diameter of the inner peripheral portion of the main body casing 17 is less than or equal to two times the diameter of an outer peripheral portion of the rotary member 18. FIG. 7 shows an example in which the diameter of the inner peripheral portion of the main body casing 17 is 1.7 times the diameter of the outer peripheral portion of the rotary member 18 (i.e., the diameter of a body obtained by removing the stirring members 19 from the rotary member 18). When the diameter of the inner peripheral portion of the main body casing 17 is less than or equal to two times the diameter of the outer peripheral portion of the rotary member 18, the processing space where a force acts on the toner particles is appropriately limited. Thus, a sufficient impact force is applied to the silica fine particles present in the form of secondary particles.

It is also important to adjust the clearance in accordance with the size of the main body casing 17. That is, it is important to adjust the clearance to be about 1% or more and about 5% or less of the diameter of the inner peripheral portion of the main body casing 17 from the viewpoint of applying sufficient shear to the silica fine particles. Specifically, when the diameter of the inner peripheral portion of the main body casing 17 is about 130 mm, the clearance may be about 2 mm or more and about 5 mm or less. When the diameter of the inner peripheral portion of the main body casing 17 is about 800 mm, the clearance may be about 10 mm or more and about 30 mm or less.

In the external addition and mixing process of the silica fine particles in the present invention, the mixing treatment apparatus is used. The drive member 24 rotates the rotary member 18 to stir and mix the toner particles and the silica fine particles charged into the mixing treatment apparatus. In such a manner, the silica fine particles are subjected to the external addition and mixing treatment on the surfaces of the toner particles.

As shown in FIG. 8, at least some of the plurality of stirring members 19 serve as forward stirring members 19*a* configured to feed the toner particles and the silica fine particles in one of the axial directions of the rotary member with the rotation of the rotary member 18. Furthermore, at least some of the plurality of stirring members 19 serve as backward stirring members 19*b* configured to feed the toner particles and the silica fine particles in the other axial direction with the rotation of the rotary member 18.

Here, when a raw material inlet port 21 and a product discharge port 22 are disposed at both ends of the main body casing 17 as shown in FIG. 7, a direction from the raw material inlet port 21 toward the product discharge port (a direction to the right in FIG. 7) is referred to as a "forward direction".

That is, as shown in FIG. 8, surfaces of the forward stirring members 19*a* are inclined so that the toner particles are fed in the forward direction (31). On the other hand, surfaces of the stirring members 19*b* are inclined so that the toner particles and the silica fine particles are fed in a backward direction (30).

Thus, the external addition and mixing treatment for the silica fine particles is performed on the surfaces of the toner particles while repeatedly performing the feed in the "forward direction" (31) and the feed in the "backward direction" (30).

The stirring members 19*a* and 19*b* are provided in the form of sets of a plurality of the members arranged at intervals in the circumferential direction of the rotary member 18. In the example shown in FIG. 8, the stirring members 19*a* and 19*b* are provided in the form of sets of two members located at intervals of 180 degrees on the rotary member 18. A larger number of members may be similarly provided in the form of sets of, for example, three members at intervals of 120 degrees or four members at intervals of 90 degrees.

In the example shown in FIG. 8, 12 stirring members 19*a* and 19*b* in total are provided at regular intervals.

In FIG. 8, D represents the width of the stirring member and d represents a distance of an overlapping portion of the stirring members. From the viewpoint of efficiently feeding the toner particles and the silica fine particles in the forward and backward directions, the width D is preferably about 20% or more and about 30% or less of the length of the rotary member 18 in FIG. 8. FIG. 8 shows an example in which the value is 23%. Furthermore, when an extension line is drawn from an end of each of the stirring members 19*a* in a vertical direction, the stirring members 19*a* and 19*b* preferably have a particular distance d of an overlapping portion where each of the stirring members 19*a* overlaps a corresponding one of the stirring members 19*b*. This enables shear to be efficiently applied to the silica fine particles present in the form of secondary particles. The ratio of d to D is preferably 10% or more and 30% or less in view of the application of shear.

In addition to the blade shape shown in FIG. 8, the blade shape may be a shape having a curved surface or a paddle structure in which a distal blade portion is connected to the rotary member 2 with a rod-shaped arm as long as the toner particles can be fed in the forward and backward directions and the clearance can be maintained.

The present invention will be further described in detail below with reference to the schematic views of the apparatus shown in FIGS. 7 and 8.

The apparatus shown in FIG. 7 includes a rotary member 18 with a surface on which a plurality of stirring members 19 are disposed, a drive member 24 configured to rotate the rotary member 18, and a main body casing 17 disposed so as to have a gap between the stirring members 19 and the main body casing 17. The apparatus shown in FIG. 7 also includes a jacket 20 which is located inside the main body casing 17 and on an end surface 26 of the rotary member and through which a cooling and heating medium can flow.

The apparatus shown in FIG. 7 includes a raw material inlet port 21 disposed on the upper portion of the main body casing 17 in order to introduce the toner particles and the silica fine particles. The apparatus shown in FIG. 7 also includes a product discharge port 22 disposed on the lower portion of the main body casing 17 in order to discharge the toner that has been subjected to the external addition and mixing treatment from the main body casing 17 to the outside. The apparatus shown in FIG. 7 further includes an inner piece 27 for the raw material inlet port in the raw material inlet port 21 and an inner piece 28 for the product discharge port in the product discharge port 22.

In the present invention, the inner piece 27 for the raw material inlet port is removed from the raw material inlet port 21. Toner particles are charged into a processing space 25 through the raw material inlet port 21. Silica fine particles are then charged into the processing space 25 through the raw material inlet port 21. The inner piece 27 for the raw material inlet port is inserted. Subsequently, the rotary member 18 is rotated by the drive member 24 (29 denotes the direction of rotation), thereby subjecting the charged materials to the external addition and mixing treatment while the charged materials are stirred and mixed together using the plurality of stirring members 19 disposed on the surface of the rotary member 18.

Regarding the order of charging, the silica fine particles may first be charged through the raw material inlet port 21, and then the toner particles may be charged through the raw material inlet port 21. Alternatively, the toner particles and the silica fine particles may be mixed with each other in advance using a mixer such as a Henschel mixer. Then, the mixture may be charged through the raw material inlet port 21 of the apparatus shown in FIG. 7.

More specifically, in terms of the external addition and mixing treatment conditions, the power of the drive member 24 is preferably controlled to 0.2 W/g or more and 2.0 W/g or less in order to achieve the coverage ratio X1 and the diffusion index specified in the present invention. The power of the drive member 24 is more preferably controlled to 0.6 W/g or more and 1.6 W/g or less.

At a power of less than 0.2 W/g, a high coverage ratio X1 is less likely to be obtained and an excessively low diffusion index tends to be obtained. At a power of more than 2.0 W/g, a high diffusion index is obtained, but the silica fine particles have a tendency to be excessively embedded.

The treatment time is not particularly limited, but is preferably 3 minutes or more and 10 minutes or less. At a treatment time of less than 3 minutes, the coverage ratio X1 and the diffusion index tend to decrease.

The rotational speed of the stirring members during the external addition and mixing is not particularly limited. In an apparatus having a volume of the processing space 25 of $2.0\times10^{-3}$ $m^3$, the rotational speed of the stirring members 19 having the shape shown in FIG. 8 is preferably 800 rpm or more and 3000 rpm or less. When the rotational speed is 800 rpm or more and 3000 rpm or less, it is easy to obtain the coverage ratio X1 and the diffusion index specified in the present invention.

In the present invention, a particularly preferred treatment method includes a premixing step before the external addition and mixing treatment operation. In the premixing step, the silica fine particles are highly uniformly dispersed on the surfaces of the toner particles. This facilitates the achievement of a high coverage ratio X1 and a high diffusion index.

More specifically, in terms of the premixing treatment conditions, the power of the drive member 24 is preferably 0.06 W/g or more and 0.20 W/g or less and the treatment time is preferably 0.5 minutes or more and 1.5 minutes or less. Regarding the premixing treatment conditions, if the load power is less than 0.06 W/g or the treatment time is shorter than 0.5 minutes, it is difficult to perform sufficiently uniform mixing as the premixing. Regarding the premixing treatment conditions, if the load power is more than 0.20 W/g or the treatment time is longer than 1.5 minutes, the silica fine particles are sometimes fixed to the surfaces of the toner particles before sufficiently uniform mixing is accomplished.

Regarding the rotational speed of the stirring members in the premixing treatment, in an apparatus having a volume of the processing space 25 of $2.0\times10^{-3}$ $m^3$, the rotational speed of the stirring members 19 having the shape shown in FIG. 8 is preferably 50 rpm or more and 500 rpm or less. When the rotational speed is 50 rpm or more and 500 rpm or less, it is easy to obtain the coverage ratio X1 and the diffusion index specified in the present invention.

After the completion of the external addition and mixing treatment, the inner piece 28 for the product discharge port is removed from the product discharge port 22. The rotary member 18 is rotated by the drive member 24 to discharge the resulting toner through the product discharge port 22. Coarse particles and the like are separated from the resulting toner with a sieve such as a circular vibrating sieve, when necessary. Thus, a toner is provided.

Methods for measuring various properties according to the present invention will be described below.

<Method for Quantitatively Determining Silica Fine Particles>

(1) Quantitative Determination of Content of Silica Fine Particles in Toner (Standard Addition Method)

Into an aluminum ring with a diameter of 30 mm, 3 g of a toner is charged. A pellet is produced at a pressure of 10 tons. The intensity of silicon (Si) is measured (Si intensity-1) by wavelength-dispersive fluorescent X-ray analysis (XRF). The measurement conditions may be conditions that have been optimized in an XRF instrument used, and a series of intensity measurements shall all be performed under the same conditions. Silica fine particles with primary particles having a number-average particle diameter of 12 nm are added to the toner in an amount of 1.0% by mass. The mixture is mixed using a coffee mill.

After the mixing, a pellet is produced in the same manner as described above. The intensity of Si is determined as described above (Si intensity-2). The same operation is performed to determine the intensities of Si (Si intensity-3 and Si intensity-4) for a sample prepared by adding 2.0% by mass of the silica fine particles to the toner and a sample prepared by adding 3.0% by mass of the silica fine particles to the toner. The silica content (% by mass) in the toner is calculated by the standard addition method using the Si intensity-1 to the Si intensity-4.

(2) Separation of Silica Fine Particles from Toner

When the toner contains a magnetic material, the quantitative determination of the silica fine particles is performed through the steps described below.

Five grams of the toner is weighed with a precision scale and charged into a 200-mL plastic cup equipped with a lid. Then, 100 mL of methanol is added thereto. The mixture is dispersed for 5 minutes with an ultrasonic disperser. The toner is attracted with a neodymium magnet and the supernatant is discarded. The operations of dispersing the mixture in methanol and discarding the supernatant are repeatedly performed three times. Then, 100 mL of 10% NaOH and several droplets of "Contaminon N" (a 10% by mass aqueous solution of a neutral (pH 7) cleanser for cleaning precision analyzers, the solution containing a nonionic surfactant, an anionic surfactant, and an organic builder, manufactured by Wako Pure Chemical Industries, Ltd.) are added and lightly mixed. The mixture is left to stand for 24 hours. Thereafter, separation is performed again with the neodymium magnet. Here, the resulting particles are repeatedly rinsed with distilled water in such a manner that NaOH is not left. The recovered particles are sufficiently dried with a vacuum drier to obtain particles A. The externally added silica fine particles are dissolved and removed by the foregoing operations.

(3) Measurement of Si Intensity in Particle A

Into an aluminum ring having a diameter of 30 mm, 3 g of particles A are charged. A pellet is produced at a pressure of 10 tons. The intensity of Si is determined (Si intensity-5) by wavelength-dispersive fluorescent X-ray analysis (XRF). The silica content (% by mass) in the particles A is calculated using the Si intensity-5 and the Si intensity-1 to Si intensity-4 used to quantitatively determine the silica content in the toner.

(4) Separation of Magnetic Material from Toner

To 5 g of the particles A, 100 mL of tetrahydrofuran is added. After sufficient mixing, the mixture is subjected to ultrasonic dispersion for 10 minutes. The magnetic particles are attracted with a magnet and the supernatant is discarded. The operations are repeatedly performed five times to obtain particles B. Organic components, such as a resin, other than the magnetic material are substantially removed by the operations. However, there is a probability that a component, which is insoluble in tetrahydrofuran, in the resin is left. Thus, the particles B produced by the foregoing operations are preferably heated to 800° C. to burn the residual organic components. Particles C produced by the heating can be regarded as the magnetic material contained in the toner.

The mass of the particles C is measured and can be regarded as the magnetic material content W (% by mass) in the magnetic toner. To correct for the amount of the magnetic material increased by oxidation, the mass of the particles C is multiplied by 0.9666 ($Fe_2O_3 \rightarrow Fe_3O_4$). The amount of externally added silica fine particles is calculated by substitution of the respective quantitative values into the following formula:

Amount of externally added silica fine particles (% by mass)=silica content (% by mass) in toner−silica content (% by mass) in particles *A*

<Method for Measuring Coverage Ratio X1>

The coverage ratio X1 of the toner surface with the silica fine particles is calculated as follows. The toner surface is subjected to elemental analysis with a measurement apparatus below under the following conditions.

Measurement apparatus: Quantum 2000 (trade name, manufactured by Ulvac-Phi, Inc.)
X-ray source: Monochrome Al Kα
X-ray Setting: 100 μmϕ (25 W (15 KV))
Photoelectron take-off angle: 45°
Neutralization conditions: combination use of neutralization gun and ion gun
Analysis region: 300×200 μm
Pass energy: 58.70 eV
Step size: 1.25 eV
Analysis software: Maltipak (from PHI)

Here, C 1c (B.E. 280 to 295 eV), O 1s (B.E. 525 to 540 eV), and Si 2p (B.E. 95 to 113 eV) peaks were used to calculate the quantitative value for Si atoms. The resulting quantitative value for the Si element is defined as Y1.

Elemental analysis of the silica fine particles alone is performed in the same manner as in the foregoing elemental analysis at the toner surface. The resulting quantitative value for the Si element is defined as Y2.

In the present invention, the coverage ratio X1 of the toner surface with the silica fine particles is defined as follows using Y1 and Y2:

Coverage ratio *X*1 (area %)=*Y*1/*Y*2×100

To improve the accuracy of this measurement, Y1 and Y2 are preferably measured twice or more.

In the determination of the quantitative value Y2, if the silica fine particles used for the external addition are available, the measurement may be performed using the silica fine particles.

In the case where the silica fine particles separated from the toner surface are used as a measurement sample, the silica fine particles are separated from the toner particles by the following procedure.

1) In the Case of Magnetic Toner

First, 6 mL of Contaminon N (a 10% by mass aqueous solution of a neutral (pH 7) cleanser for cleaning precision analyzers, the solution containing a nonionic surfactant, an anionic surfactant, and an organic builder, manufactured by Wako Pure Chemical Industries, Ltd.) is added to 100 mL of ion exchanged water to prepare a dispersion medium. To the dispersion medium, 5 g of toner is added and the mixture is dispersed with an ultrasonic disperser for 5 minutes. Subsequently, the mixture is set in a "KM Shaker" (model: V. SX) manufactured by Iwaki Industry and shaken for 20 minutes at a reciprocation of 350 times per minute. The toner particles are then bound with a neodymium magnet and the supernatant is collected. By drying the supernatant, the silica fine particles are collected. If a sufficient amount of silica fine particles cannot be collected, this operation is repeatedly performed.

In this method, if the external additives other than the silica fine particles are added, such external additives other than the silica fine particles are also collected. In this case, the silica fine particles may be separated from the collected external additives by using centrifugal separation or the like.

2) In the Case of Non-Magnetic Toner

A concentrated sucrose solution is prepared by adding 160 g of sucrose (manufactured by KISHIDA CHEMICAL Co., Ltd.) to 100 mL of ion exchanged water and dissolving the sucrose under heating in a water bath. A dispersion liquid is prepared by inserting 31 g of the concentrated sucrose solution and 6 mL of Contaminon N into a centrifuge tube. One gram of toner is added to the dispersion liquid and the toner is disaggregated using a spatula or the like.

The centrifuge tube is shaken with the above-described shaker for 20 minutes at a reciprocation of 350 times per minute. After the shaking, the solution is transferred to a glass tube (50 mL) for swing rotors. Centrifugal separation is performed with a centrifuge at 3500 rpm for 30 minutes. In the glass tube after the centrifugal separation, the toner is present in the uppermost layer and the silica fine particles are present on the aqueous solution side in the lower layer. The aqueous solution in the lower layer is collected. The centrifugal separation is performed to separate the sucrose and the silica fine particles from each other, and the silica fine particles are collected. If necessary, the centrifugal separation is repeatedly performed. After sufficient separation, the dispersion liquid is dried to collect the silica fine particles.

As in the case of the magnetic toner, if the external additives other than the silica fine particles are added, such external additives other than the silica fine particles are also collected. Therefore, the silica fine particles are separated from the collected external additives by using centrifugal separation or the like.

<Method for Measuring Weight-Average Particle Diameter (D4) of Toner>

The weight-average particle diameter (D4) of the toner is calculated as follows (the toner particles are also calculated in the same manner). The measurement instrument is a precision particle distribution analyzer "COULTER COUNTER Multisizer 3" based on a pore electrical resistance method and equipped with a 100 μm aperture tube (registered trademark, manufactured by Beckman Coulter, Inc.). Dedicated software "Beckman Coulter Multisizer 3, Version 3.51" (available from Beckman Coulter, Inc.) included in the analyzer is used to set the measurement conditions and analyze the measurement data. Measurement is performed with the following number of effective measurement channels: 25,000.

An aqueous electrolyte solution usable for the measurement is prepared by dissolving special-grade sodium chloride in ion exchanged water in a concentration of 1% by mass. For example, "ISOTON II" (from Beckman Coulter, Inc.) can be used.

The dedicated software is configured as follows before measurement and analysis. In the "Changing Standard Operating Mode (SOM)" screen of the dedicated software, the Total Count of the Control Mode is set to 50,000 particles. The Number of Runs is set to 1. The Kd value is set to a value obtained using "Standard particle 10.0 μm" (available from Beckman Coulter, Inc.). Pressing the "Threshold/Noise Level Measuring Button" automatically sets the threshold and noise level. The Current is set to 1600 μA. The Gain is set to 2. The Electrolyte is set to ISOTON II. A check mark is placed in "Flush aperture tube after measurement".

In the "Convert Pulses to Size Setting" screen of the dedicated software, the bin interval is set to logarithmic particle diameter. The particle diameter bin is set to 256 particle diameter bins. The particle diameter range is set in the range from 2 μm to 60 μm.

The specific measurement procedure is as follows.

(1) Into a 250-mL glass round-bottom beaker dedicated for Multisizer 3, 200 mL of the aqueous electrolyte solution is charged. The beaker is set to a sample stand. Stirring is performed counterclockwise with a stirrer rod at a speed of 24 rotations per second. The "Aperture Flush" function in the dedicated software is used to remove contaminants and air bubbles from the aperture tube.

(2) Into a 100-mL glass flat-bottom beaker, 30 mL of the aqueous electrolyte solution is charged. To the beaker, 0.3 mL of a dilute solution is added as a dispersant, the dilute solution being prepared by diluting "Contaminon N" (a 10% by mass aqueous solution of a neutral (pH 7) cleanser for cleaning precision analyzers, the solution containing a nonionic surfactant, an anionic surfactant, and an organic builder, available from Wako Pure Chemical Industries, Ltd.) 3 times by mass with ion exchanged water.

(3) An "Ultrasonic Dispersion System Tetora 150" (available from Nikkaki Bios Co., Ltd.) is prepared, the system having an electrical output of 120 W and being equipped with two oscillators each having an oscillation frequency of 50 kHz at a phase offset of 180 degrees. Then, 3.3 L of ion exchanged water is charged into a water tank of the ultrasonic dispersion system, and 2 mL of Contaminon N is added to the water tank.

(4) The beaker prepared in the process (2) is set in a beaker-securing hole of the ultrasonic dispersion system, and the system is operated. The beaker height position is adjusted so that the resonance state of the liquid surface of the aqueous electrolyte solution in the beaker is maximized.

(5) To the aqueous electrolyte solution in the beaker in the process (4), 10 mg of the toner is gradually added while the aqueous electrolyte solution is irradiated with ultrasound, so that the toner is dispersed in the solution. The ultrasonic dispersion treatment is continued for another 60 seconds. The ultrasonic dispersion is appropriately adjusted in such a manner that the water temperature in the water tank is 10° C. or higher and 40° C. or lower.

(6) The aqueous electrolyte solution containing the toner dispersed therein described in the process (5) is added dropwise with a pipette to the round-bottom beaker set in the sample stand described in the process (1). Adjustment is performed in such a manner that the measurement concentration is 5%. The measurement is continued until the number of measured particles reaches 50,000.

(7) The measurement data is analyzed using the dedicated software included in the system to calculate the weight-average particle diameter (D4). When "Graph/Vol %" is selected in the dedicated software, the "average size" in the "Analysis/Volume Statistics (arithmetic mean)" screen indicates the weight-average particle diameter (D4).

<Method for Measuring Number-Average Particle Diameter of Primary Particles of Silica Fine Particles>

The number-average particle diameter of primary particles of the silica fine particles is calculated from an image of silica fine particles on a toner surface taken with a Hitachi S-4800 ultrahigh resolution field-emission scanning electron microscope (available form Hitachi High-Technologies Corporation). Image-capturing conditions with S-4800 are as follows.

(1) Sample Preparation

A conductive paste is lightly applied to a sample stage (an aluminum stage with a size of 15 mm×6 mm). The toner is sprayed onto the surface of the conductive paste. An excess of the toner is removed from the sample stage by air blow. Drying is sufficiently performed. The sample stage is set to a sample holder. The stage height is adjusted to 36 mm with a sample height gauge.

(2) Setting of Observation Conditions with S-4800

The number-average particle diameter of primary particles of the silica fine particles is calculated using an image obtained by backscattered electron image observation with S-4800. In the case of a backscattered electron image, less charge-up of the silica fine particles occurs, compared with a secondary electron image. Thus, the particle diameter of the silica fine particles can be precisely measured.

Liquid nitrogen is poured into an anti-contamination trap attached to a scope body of S-4800 to the point of overflowing. The microscope is left to stand for 30 minutes. The "PCSTEM" of S-4800 is booted up. Flushing (cleaning of an FE chip serving as an electron source) is performed. The acceleration voltage indicator of the control panel on the screen is clicked. The "Flushing" button is pressed to open the Flushing Execution dialog box. After checking that the flushing strength is 2, flushing is executed. It is checked that the emission current due to flushing is in the range of 20 to 40 μA. The sample holder is inserted into a sample chamber on the scope body of S-4800. "Origin point" on the control panel is pressed to move the sample holder to an observation position.

The acceleration voltage indicator is clicked to open the HV setting dialog box. The acceleration voltage is set to [0.8 kV] and the emission current is set to [20 μA]. In the "Basic" tab on the operation panel, the signal selection is set to [SE]. [Up (U)] and [+BSE] are selected as the SE detectors. In the selection box to the right of [+BSE], [L.A. 100] is selected to set the microscope in the mode for observation in a backscattered electron image. In the [Basic] tab on the operation panel, the probe current in the Electron Optics Conditions block is set to [normal]. The focus mode is set to [UHR]. WD is set to [3.0 mm]. The [ON] button of the acceleration voltage indicator on the control panel is pressed to apply an acceleration voltage.

(3) Calculation of Number-Average Particle Diameter (D1) ("da" Described Above) of Silica Fine Particles The magnification indicator on the control panel is dragged to set the magnification to 100,000 (100 k). The [Coarse] focus knob on the operation panel is rotated. Once the image is more or less in focus, the aperture alignment is adjusted. [Align] on the control panel is clicked to display the alignment dialog box. [Beam] is selected. The "Stigma/Alignment" knobs (X, Y) on the operation panel are rotated so as to move the displayed beam to the center of the concentric circles. [Aperture] is then selected. The "Stigma/Alignment" knobs (X, Y) are turned one at a time and adjusted so as to stop or minimize image movement. The aperture dialog box is closed. Autofocus is used to adjust the focus. This operation is repeatedly performed two more times to adjust the focus.

Next, the particle diameters are measured for at least 300 silica fine particles on the toner surface to determine the average particle diameter. Here, some of the silica fine particles are present in the form of aggregates. Thus, the number-average particle diameter (D1) (da) of primary particles of the silica fine particles is obtained by determining the maximum diameters of particles that can be confirmed to be primary particles and calculating the arithmetic mean of the obtained maximum diameters.

<Method for Measuring Average Circularity of Toner Particles>

The average circularity of the toner particles is measured with a flow-type particle image analyzer "FPIA-3000" (manufactured by Sysmex Corporation) under the measurement and analysis conditions used in the calibration process.

The specific measurement method is described below. First, 20 mL of ion exchanged water from which solid impurities and the like have been removed is charged into a glass vessel. To the vessel, 0.2 mL of a dilute solution is added as a dispersant, the dilute solution being prepared by diluting "Contaminon N" (a 10% by mass aqueous solution of a neutral (pH 7) cleanser for cleaning precision analyzers, the solution containing a nonionic surfactant, an anionic surfactant, and an organic builder, available from Wako Pure Chemical Industries, Ltd.) 3 times by mass with ion exchanged water. Then, 0.02 g of the measurement sample is added thereto. The mixture is subjected to a dispersion treatment for 2 minutes with an ultrasonic disperser, thereby preparing a dispersion liquid for measurement. Here, the dispersion liquid is appropriately cooled in such a manner that the temperature of the dispersion liquid is 10° C. or higher and 40° C. or lower. A desktop ultrasonic cleaner/disperser (for example, VS-150, manufactured by Velvo-Clear) having an oscillation frequency of 50 kHz and an electrical output of 150 W is used as the ultrasonic disperser. A predetermined amount of ion exchanged water is charged into the water tank, and then 2 mL of Contaminon N is added to the water tank.

Measurement is performed with the flow-type particle image analyzer equipped with "UPlanApro" (magnification: 10×, numerical aperture: 0.40) as an objective lens. A particle sheath "PSE-900A" (manufactured by Sysmex Corporation) is used as a sheath solution. The dispersion liquid prepared by the procedure described above is introduced into the flow-type particle image analyzer. In the HPF measurement mode, 3000 toner particles are measured in the total count mode. The binarization threshold during particle analysis is set to 85%. The analyzed particle diameter is limited to a circle-equivalent diameter of 1.985 μm or more and less than 39.69 μm. Thus, the average circularity of the toner particles is determined.

In this measurement, automatic focal point adjustment is performed before the start of the measurement using standard latex particles (for example, latex particles prepared by diluting, with ion exchanged water, "RESEARCH AND TEST PARTICLES Latex Microsphere Suspensions 5200A" from Duke Scientific). After that, it is preferable to perform focal point adjustment every 2 hours after the start of measurement.

In the present invention, a flow-type particle image analyzer for which the calibration work has been performed by Sysmex Corporation and for which a calibration certification has been issued by Sysmex Corporation is used. Measurement is performed under the measurement and analysis conditions at the time when the calibration certificate has been issued, except that the diameters of the particles analyzed are limited to a circle-equivalent diameter of 1.985 μm or more and less than 39.69 μm.

The measurement principle employed in the flow-type particle image analyzer "FPIA-3000" (manufactured by Sysmex Corporation) is to capture flowing particles as still images and perform image analysis. A sample that has been added to the sample chamber is fed to a flat sheath flow cell with a sample suctioning syringe. The sample fed into the flat sheath flow cell is sandwiched between flows of the sheath solution to form a flattened flow. The sample passing through the flat sheath flow cell is irradiated with strobe light at 1/60-second intervals, enabling the flowing particles to be captured as still images. Since the flow is flattened, the images are captured in a focused state. The particle images are captured with a CCD camera. The captured images are subjected to image processing with a 512×512 pixel image processing resolution (0.37×0.37 μm per pixel). Contour extraction is performed on each particle image. The projected area S, the circumferential length L, and the like are calculated for the particle image.

The circle-equivalent diameter and the circularity are determined using the area S and the circumferential length L. The circle-equivalent diameter refers to the diameter of a circle that has the same area as the projected area of the particle image. The circularity is defined as a value obtained by dividing the circumference length of the circle determined from the circle-equivalent diameter by the circumferential length of the projected image of the particle and is calculated from the following formula:

$$\text{Circularity}=2\times(\pi\times S)^{1/2}/L$$

When the particle image is circular, the circularity is 1.000. A higher degree of unevenness of the circumference of the particle image results in a lower circularity value. After the calculation of the circularity of each particle, the range of a circularity from 0.200 to 1.000 is divided by 800. The arithmetic mean of the resulting circularities is calculated. The resulting value is defined as the average circularity.

<Method for Measuring Apparent Density of Silica Fine Particles>

The measurement of the apparent density of the silica fine particles is performed as described below. A measurement sample placed on paper is slowly charged into a 100-mL graduated cylinder in such a manner that the volume reaches 100 ml. The difference between the masses of the graduated cylinder before and after the charging of the sample is determined. The apparent density is calculated from the following formula. When the sample is charged into the graduated cylinder, care is taken not to tap the paper.

Apparent density (g/L)=(mass (g) at the time when 100 mL of sample is charged)/0.1

<Method for Measuring True Specific Gravity of Toner and Silica Fine Particles>

The true specific gravities of the toner and the silica fine particles were measured with a dry automated densimeter Autopycnometer (manufactured by Yuasa Ionics). The measurement conditions were described below.

Cell: SM cell (10 mL)

Amount of sample: 2.0 g (toner), 0.05 g (silica fine particles)

This measurement method measures the true specific gravity of solid and liquid on the basis of a vapor-phase substitution method. As with the liquid-phase substitution method, this is based on the Archimedean principle. However, since a gas (argon gas) is used as a substitution medium, the method provides high precision for very small pores.

<Method for Measuring Fixation Ratio of Silicone Oil on Silica Fine Particles on the Basis of Amount of Carbon>

(Extraction of Free Silicone Oil)

(1) Into a beaker, 0.50 g of the silica fine particles and 40 mL of chloroform are charged. The mixture is stirred for 2 hours.

(2) After the stirring is stopped, the mixture is left to stand for 12 hours.

(3) The sample is filtered and washed with 40 mL of chloroform three times.

(Measurement of Amount of Carbon)

A sample is burnt at 1100° C. under a stream of oxygen. The amounts of CO and $CO_2$ generated are measured using the IR absorbance to determine the amount of carbon in the sample. The amounts of carbon are compared before and after the silicone oil is extracted, and the fixation ratio of the silicone oil on the basis of the amount of carbon is calculated as follows.

(1) Into a cylindrical metal mold, 0.40 g of a sample is charged. The sample is pressed.

(2) Then, 0.15 g of the pressed sample is precisely weighed, placed on a board for combustion, and measured with EMA-110 manufactured by Horiba Ltd.

(3) [Amount of carbon after extraction of silicone oil]/[amount of carbon before extraction of silicone oil]×100 is defined as the fixation ratio of the silicone oil on the basis of the amount of carbon. In the case where a surface treatment is performed with the silicone oil after a hydrophobic treatment is performed with a silane compound or the like, the amount of carbon in the sample is first measured after the hydrophobic treatment is performed with the silane compound or the like. After the surface treatment is performed with the silicone oil, the amounts of carbon are compared before and after the extraction of the silicone oil. The fixation ratio on the basis of the amount of carbon derived from the silicone oil is calculated as follows.

(4) [Amount of carbon after extraction of silicone oil]/[(amount of carbon before extraction of silicone oil−amount of carbon after hydrophobic treatment with silane compound or the like)]×100 is defined as the fixation ratio of the silicone oil on the basis of the amount of carbon.

In the case where the hydrophobic treatment is performed with the silane compound or the like after the surface treatment is performed with the silicone oil, the fixation ratio on the basis of the amount of carbon derived from the silicone oil is calculated as follows.

(5) [(Amount of carbon after extraction of silicone oil−amount of carbon after hydrophobic treatment with silane compound or the like)]/[amount of carbon before extraction of silicone oil]×100 is defined as the fixation ratio of the silicone oil on the basis of the amount of carbon.

<Image Forming Apparatus>

Figure 9:
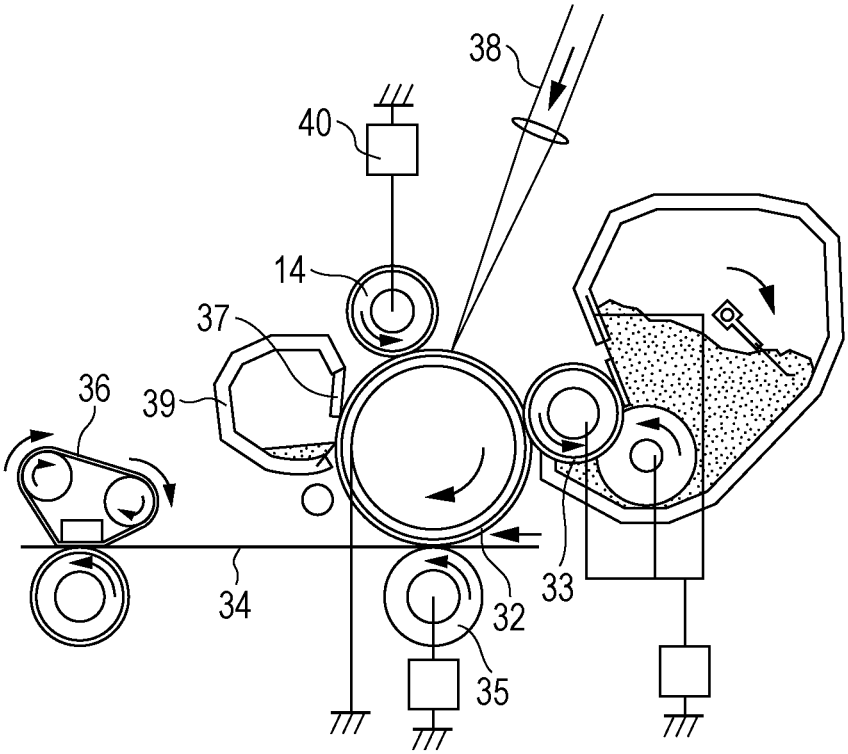
FIG. 9 shows a schematic cross-sectional view according to one aspect of an image forming apparatus according to present invention.

FIG. 9 shows a schematic structure of an example of an image forming apparatus of the present invention.

The image forming apparatus includes a photosensitive member, a charging device (charging means) for the photosensitive member, an exposure device (exposure means) configured to form an electrostatic latent image on a surface of the charged photosensitive member, and a developing device (developing means) configured to supply the photosensitive member on which the electrostatic latent image is formed with a toner to form a toner image on the surface of the photosensitive member. The image forming apparatus shown in FIG. 9 further includes, for example, a transfer device (transfer means) configured to transfer the toner image onto a transfer material, a cleaning device (cleaning means) configured to recover a residual toner on the surface of the photosensitive member, and a fixing device (fixing means) configured to fix the toner image.

A photosensitive member 32 is a rotating drum type photosensitive member having a photosensitive layer on the surface of an electro-conductive substrate. The photosensitive member is rotatably driven at a predetermined peripheral speed (process speed) in the direction indicated by an arrow.

The charging device includes a contact-type charging roller 14 provided in contact with the photosensitive member 32 at a predetermined pressing force. The charging roller 14 is rotated by the rotation of the photosensitive member. As a result of the application of a predetermined voltage from a charging power source 40, the charging roller 14 charges the photosensitive member 32 at a predetermined potential.

As a latent image forming device 38 configured to form an electrostatic latent image on the photosensitive member 32, for example, an exposure device such as a laser beam scanner is used. The uniformly charged photosensitive member is exposed to light corresponding to image information to form an electrostatic latent image.

The developing device includes a developing sleeve or a developing roller 33 disposed close to or in contact with the photosensitive member 32. The electrostatic latent image is developed by reversal development with a toner that has electrostatically been processed to have the same polarity as the charge polarity of the photosensitive member, thereby forming a toner image.

The transfer device includes a contact-type transfer roller 35. The toner image is transferred from the photosensitive member onto a transfer material 34 such as plain paper (the transfer material is transported by a paper feed system including a transport member).

The cleaning device includes a blade-type cleaning member 37 and a recovery container 39. After the transfer, a transfer residual toner left on the surface of the photosensitive member is mechanically scraped and recovered.

The fixing device 36 includes a heated roll or the like. The fixing device 36 fixes the transferred toner image on the transfer material 34 and then delivers the transfer material 34 to the outside of the apparatus.

<Process Cartridge>

Figure 10:
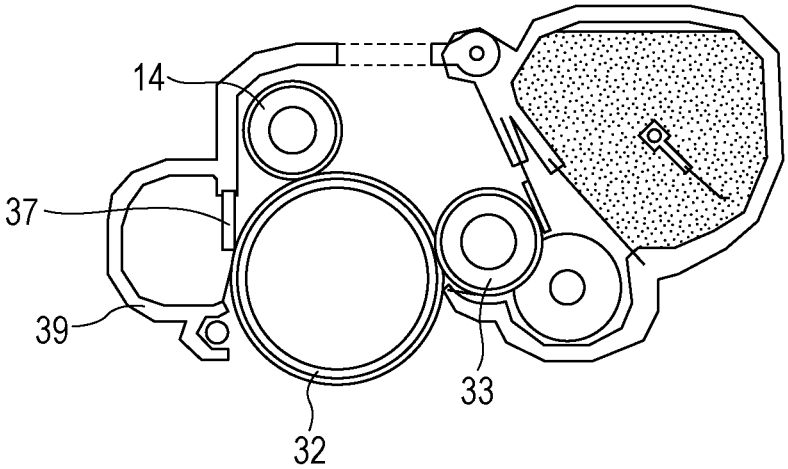
FIG. 10 shows a schematic cross-sectional view according to one aspect of a process cartridge according to the present invention.

A process cartridge (FIG. 10) integrally supporting the photosensitive member, the charging device (charging means), and the developing device (developing means) can also be used, the process cartridge being detachably attached to an image forming apparatus.

The image forming apparatus may include a process cartridge, an exposure device, and a developing device, the process cartridge being the foregoing process cartridge.

EXAMPLES

The present invention will be further described in detail below based on Examples. Prior to the description of Examples, regarding the toner, Production Example a1 of magnetic material 1, Production Example a2 of polyester resin 1, Production Examples a3 and a4 of toner particles 1 and toner particles 2, and Production Examples A1 to A18 of toner will be described. Subsequently, regarding the charging member, Evaluation method for resin particles and charging member, Production Examples B1 to B8 of resin particles, Production Examples C1 and C2 of composite conductive fine particles, and Production Examples D1 to D19 of charging member will be described.

Production Example of Toner

Production Example a1

Production of Magnetic Material 1

To an aqueous solution of ferrous sulfate, 1.00 to 1.10 equivalents of a caustic soda solution on an elemental iron basis, 0.15% by mass of $P_2O_5$ in terms of elemental phosphorus on an elemental iron basis, and 0.50% by mass of $SiO_2$ in terms of elemental silicon on an elemental iron basis were added, thereby preparing an aqueous solution containing ferrous hydroxide. The pH of the aqueous solution containing ferrous hydroxide was adjusted to 8.0. An oxidation reaction was caused at 85° C. while performing air blow, to prepare a slurry containing seed crystals.

Next, 0.90 to 1.20 equivalents of an aqueous solution of ferrous sulfate based on the initial amount of alkali (sodium component in caustic soda) was added to the slurry. The pH of the slurry was kept at 7.6 and an oxidation reaction was caused to proceed while performing air blow, thereby preparing a slurry containing magnetic iron oxide. After filtration and washing, the water-containing slurry was temporarily taken out. At this time, a small amount of the water-containing sample was collected and the water content was measured. The water-containing sample was then poured into another aqueous medium without being dried. The slurry was re-dispersed with a pin mill while being stirred and circulated. The pH of the re-dispersed liquid was adjusted to 4.8. Next, 1.6 parts by mass of a n-hexyltrimethoxysilane coupling agent based on 100 parts by mass of magnetic iron oxide was added thereto under stirring (the amount of magnetic iron oxide was calculated as a value obtained by subtracting the water content from the water-containing sample) to perform hydrolysis. Subsequently, stirring was thoroughly performed. The pH of the dispersion liquid was adjusted to 8.6 and a surface treatment was performed. The resulting hydrophobic magnetic material was filtered with a filter press and washed with a large amount of water. The hydrophobic magnetic material was dried at 100° C. for 15 minutes and then at 90° C. for 30 minutes. The resulting particles were subjected to a disintegration treatment, thereby providing a magnetic material 1 having a volume-average particle diameter of 0.21 μm.

Production Example a2

Production of Polyester Resin 1

The following components were charged into a reaction vessel equipped with a cooling tube, a stirrer, and a nitrogen inlet. The reaction was caused at 230° C. for 10 hours under a stream of nitrogen while water generated was distilled off.

| | |
|---|---|
| Propylene oxide (2 mol) adduct of Bisphenol A | 75 parts by mass |
| Propylene oxide (3 mol) adduct of Bisphenol A | 25 parts by mass |
| Terephthalic acid | 100 parts by mass |
| Titanium-based catalyst (titanium dihydroxybis(triethanolaminate)) | 0.25 parts by mass |

Next, the reaction was caused under a reduced pressure of 5 to 20 mmHg. When the acid value was reduced to 2 mgKOH/g or less, the mixture was cooled to 180° C. Then, 10 parts by mass of trimellitic anhydride was added thereto. The reaction was caused for 2 hours at normal pressure in a sealed state. The product was then taken out, cooled to room temperature, and pulverized to obtain a polyester resin 1. The polyester resin 1 was subjected to gel permeation chromatography (GPC) and found to have a main peak molecular weight (Mp) of 10,500.

Production Example a3

Production of Toner Particles 1

To 720 parts by mass of ion exchanged water, 450 parts by mass of a 0.1 M aqueous solution of $Na_3PO_4$ was added. After the mixture was heated to 60° C., 67.7 parts by mass of a 1.0 M aqueous solution of $CaCl_2$ was added thereto, thereby preparing an aqueous medium containing a dispersion stabilizer.

| | |
|---|---|
| Styrene | 78.0 parts by mass |
| n-Butyl acrylate | 22.0 parts by mass |
| Divinylbenzene | 0.6 parts by mass |
| Iron complex of monoazo dye (T-77, from Hodogaya Chemical Co., Ltd.) | 3.0 parts by mass |
| Magnetic material 1 | 90.0 parts by mass |
| Polyester resin 1 | 5.0 parts by mass |

The components described above were uniformly dispersed and mixed using an attritor (Mitsui Miike Chemical Engineering Machinery) to obtain a polymerizable monomer composition. The resulting polymerizable monomer composition was heated to 60° C., and 15.0 parts by mass of Fischer-Tropsch wax (melting point: 74° C., number-average molecular weight Mn: 500) was added thereto and dissolved therein. After dissolving the Fischer-Tropsch wax in the polymerizable monomer composition, 7.0 parts by mass of dilauroyl peroxide serving as a polymerization initiator was dissolved therein to obtain a toner composition.

The toner composition was added to the foregoing aqueous medium. The mixture was granulated by being stirred at 60° C. in an $N_2$ atmosphere with a TK Homomixer (Tokushu Kika Kogyo Co., Ltd.) at 12,000 rpm for 10 minutes. The reaction was then caused at 74° C. for 6 hours under stirring with a paddle-type impeller.

After the completion of the reaction, the suspension was cooled, washed by the addition of hydrochloric acid, filtered, and then dried to obtain toner particles 1. Table 1 shows the physical properties of the magnetic toner particles 1.

Production Example a4

Production of Toner Particles A2

| | |
|---|---|
| Styrene-acrylic copolymer (the mass ratio of styrene to n-butyl acrylate: 78.0:22.0, main peak molecular weight Mp: 10,000) | 100 parts by mass |
| Magnetic material 1 | 90 parts by mass |
| Iron complex of monoazo dye (T-77, from Hodogaya Chemical Co., Ltd.) | 2 parts by mass |
| Fischer-Tropsch wax (melting point: 74° C., number-average molecular weight Mn: 500) | 4 parts by mass |

The mixture described above was premixed using a Henschel mixer and then melt-kneaded with a twin-screw extruder heated to 110° C. The kneaded mixture was cooled and roughly ground with a hammer mill to obtain a roughly ground toner product. The obtained roughly ground product was mechanically pulverized (finely pulverized) with a mechanical pulverizer Turbo Mill (manufactured by Turbo Industry Ltd., rotor and stator surfaces were plated with a chromium alloy containing chromium carbide (plating thickness: 150 μm, surface hardness HV: 1050)). The finely pulverized product was subjected to classification to remove a fine powder and a coarse powder at the same time with a multi-division classifier that utilizes a Coanda effect (ELBOW-JET classifier manufactured by Nittetsu Mining Co., Ltd.).

A surface modification device Faculty (manufactured by Hosokawa Micron Corporation) was used to perform the surface modification of the raw material toner particles and to remove a fine powder, thereby providing toner particles 2. Regarding the conditions for the surface modification and the removal of the fine powder with the surface modification device, the peripheral speed of a dispersing rotor was 150 m/sec, the amount of the finely pulverized product charged was 7.6 kg per cycle, and the surface modification time (cycle time: time from the end of the supply of the raw material to the opening of a discharge valve) was 82 seconds. The temperature at the time of the discharge of the toner particles was 44° C. Table 1 shows the physical properties of toner particles 2.

TABLE 1

| Toner particles | Weight-average particle diameter (D4) (μm) | Average circularity |
|---|---|---|
| Toner particles 1 | 8.0 | 0.970 |
| Toner particles 2 | 8.0 | 0.938 |

Production Example A1

Production of Toner A1

The toner particles 1 described above were subjected to an external addition and mixing treatment using the apparatus shown in FIG. 7.

In this Example, the apparatus shown in FIG. 7 was used. The inner peripheral portion of the main body casing 21 had a diameter of 130 mm. The processing space 26 had a volume of $2.0\times10^{-3}$ $m^3$. The drive member 24 had a rated power of 5.5 kW. The stirring members 19 had the shape shown in FIG. 8. The width d of an overlapping portion between the stirring members 19*a* and 19*b* in FIG. 8 was set to 0.25D, where the maximum width of the stirring members 19 was assumed to be D. The clearance between the stirring members 19 and the inner periphery of the main body casing 11 was set to 3.0 mm.

Into the apparatus shown in FIG. 7, 100 parts by mass of the toner particles 1 and 0.50 parts by mass of silica fine particles 1 shown in Table 2 (number-average particle diameter of primary particles of a silica raw material: 7 nm, number-average particle diameter of primary particles of silica fine particles after treatment: 8 nm) were charged, the apparatus having the structure described above.

After charging the toner particles and the silica fine particles, premixing was performed in order to uniformly mix the toner particles and the silica fine particles. Regarding the premixing conditions, the power of the drive member 24 was set to 0.10 W/g (rotational speed of drive member 8: 150 rpm), and the treatment time was set to 1 minute.

After the completion of the premixing, an external addition and mixing treatment was performed. Regarding the conditions for the external addition and mixing treatment, the processing time was 5 minutes, and the peripheral speed of the outermost end of the stirring members 19 was adjusted so as to maintain the power of the drive member 24 to be 0.60 W/g (rotational speed of drive member 24: 1400 rpm). Table 3 shows the external addition and mixing treatment conditions.

After the external addition and mixing treatment, the coarse particles and the like were removed using a circular vibrating sieve having a diameter of 500 mm and an opening of 75 μm. Thus, a toner A1 for Examples was obtained. The toner A1 for Examples was magnified and observed with a scanning electron microscope. The number-average particle diameter of primary particles of the silica fine particles on the toner surface was measured and found to be 8 nm. Table 3 shows the external addition conditions and the physical properties of the toner A1.

Production Examples A2 to A18

Production of Toners A2 to A18

Toners A2 to A18 were produced in the same manner as in Production Example of toner A1, except that the type and the number of parts of silica fine particles added, the toner particles, the external addition apparatus, the external addition conditions, and the like were changed as shown in Tables 2 and 3. Table 3 shows the external addition conditions and the physical properties of the toners A2 to A18.

In the case where a Henschel mixer was used as the external addition apparatus, a Henschel mixer FM10C (Mitsui Miike Chemical Engineering Machinery) was used. In some production examples, the premixing process was not performed.

Figure 11:
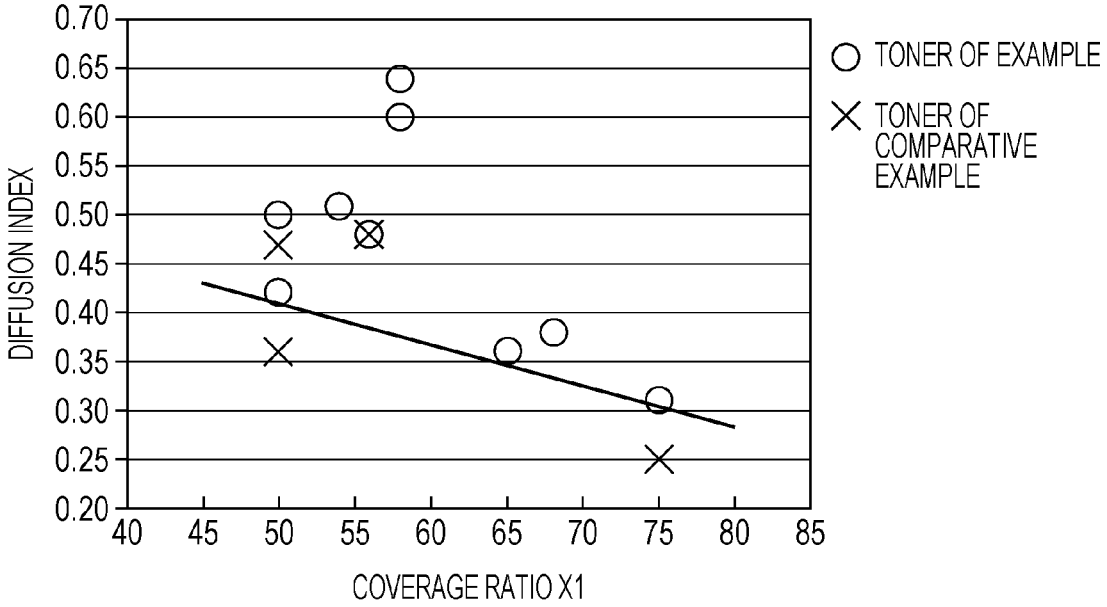
FIG. 11 shows a plot of a coverage ratio X1 versus a diffusion index of the toner according to the present invention.

FIG. 11 is a plot of the coverage ratio X1 versus the diffusion index of the toners A1 to A18. The toners used in Examples are represented by "○". The toners used in Comparative Examples are represented by "x".

TABLE 2

| Silica fine particles | BET specific surface area of silica raw material ($m^2/g$) | Number of parts of silicone oil used for treatment based on 100 parts by mass of silica raw material (parts by mass) | Kinematic viscosity of silicone oil (cSt) | Fixation ratio of silicone oil on the basis of amount of carbon (%) | Apparent density (g/L) |
|---|---|---|---|---|---|
| Silica fine particles 1 | 300 | 20 | 50 | 98 | 25 |
| Silica fine particles 2 | 300 | 20 | 50 | 98 | 60 |
| Silica fine particles 3 | 130 | 18 | 50 | 98 | 33 |
| Silica fine particles 4 | 100 | 17 | 50 | 98 | 40 |
| Silica fine particles 5 | 380 | 28 | 50 | 98 | 20 |
| Silica fine particles 6 | 300 | 15 | 50 | 98 | 25 |
| Silica fine particles 7 | 300 | 40 | 50 | 98 | 25 |
| Silica fine particles 8 | 300 | 20 | 50 | 70 | 25 |
| Silica fine particles 9 | 300 | 13 | 50 | 98 | 25 |
| Silica fine particles 10 | 300 | 45 | 50 | 98 | 25 |
| Silica fine particles 11 | 300 | 20 | 50 | 60 | 25 |
| Silica fine particles 12 | 50 | 15 | 50 | 98 | 55 |

TABLE 3

| Toner | Toner particles | Silica fine particles | Number of parts of silica fine particles added (parts by mass) | Content of silica fine particles (parts by mass) | External addition apparatus | Premixing step | External addition step | Coverage ratio X1 (area %) | Diffusion index | Formula 2 (−0.0042 × X1 + 0.62) |
|---|---|---|---|---|---|---|---|---|---|---|
| Toner A1 | Toner particles 1 | Silica fine particles 1 | 0.50 | 0.50 | Apparatus in FIG. 5 | 0.10 W/g (150 rpm) | 0.60 W/g (1400 rpm) | 50 | 0.50 | 0.41 |
| Toner A2 | Toner particles 1 | Silica fine particles 1 | 0.60 | 0.60 | Apparatus in FIG. 5 | 0.06 W/g (50 rpm) | 0.60 W/g (1400 rpm) | 50 | 0.42 | 0.41 |
| Toner A3 | Toner particles 1 | Silica fine particles 2 | 0.60 | 0.60 | Apparatus in FIG. 5 | 0.10 W/g (150 rpm) | 0.60 W/g (1400 rpm) | 56 | 0.48 | 0.38 |
| Toner A4 | Toner particles 1 | Silica fine particles 4 | 1.30 | 1.30 | Apparatus in FIG. 5 | 0.06 W/g (50 rpm) | 0.60 W/g (1400 rpm) | 58 | 0.64 | 0.38 |
| Toner A5 | Toner particles 1 | Silica fine particles 5 | 0.40 | 0.40 | Apparatus in FIG. 5 | 0.06 W/g (50 rpm) | 0.60 W/g (1400 rpm) | 54 | 0.51 | 0.39 |
| Toner A6 | Toner particles 1 | Silica fine particles 3 | 1.10 | 1.10 | Apparatus in FIG. 5 | 0.06 W/g (50 rpm) | 0.60 W/g (1400 rpm) | 58 | 0.60 | 0.38 |
| Toner A7 | Toner particles 1 | Silica fine particles 1 | 1.20 | 1.20 | Apparatus in FIG. 5 | 0.06 W/g (50 rpm) | 0.60 W/g (1400 rpm) | 75 | 0.31 | 0.31 |
| Toner A8 | Toner particles 1 | Silica fine particles 6 | 0.60 | 0.60 | Apparatus in FIG. 5 | 0.10 W/g (150 rpm) | 0.60 W/g (1400 rpm) | 56 | 0.48 | 0.38 |
| Toner A9 | Toner particles 1 | Silica fine particles 7 | 0.60 | 0.60 | Apparatus in FIG. 5 | 0.10 W/g (150 rpm) | 0.60 W/g (1400 rpm) | 56 | 0.48 | 0.38 |
| Toner A10 | Toner particles 1 | Silica fine particles 8 | 0.60 | 0.60 | Apparatus in FIG. 5 | 0.10 W/g (150 rpm) | 0.60 W/g (1400 rpm) | 56 | 0.48 | 0.38 |

TABLE 3-continued

| Toner | Toner particles | Silica fine particles | Number of parts of silica fine particles added (parts by mass) | Content of silica fine particles (parts by mass) | External addition apparatus | Premixing step | External addition step | Coverage ratio X1 (area %) | Diffusion index | Formula 2 (−0.0042 × X1 + 0.62) |
|---|---|---|---|---|---|---|---|---|---|---|
| Toner A11 | Toner particles 2 | Silica fine particles 1 | 0.90 | 0.90 | Apparatus in FIG. 5 | 0.10 W/g (150 rpm) | 0.60 W/g (1400 rpm) | 68 | 0.38 | 0.33 |
| Toner A12 | Toner particles 1 | Silica fine particles 1 | 0.90 | 0.90 | Apparatus in FIG. 5 | 0.06 W/g (50 rpm) | 0.60 W/g (1400 rpm) | 65 | 0.36 | 0.35 |
| Toner A13 | Toner particles 1 | Silica fine particles 1 | 0.70 | 0.70 | Henschel mixer | no | 4000 rpm | 50 | 0.36 | 0.41 |
| Toner A14 | Toner particles 1 | Silica fine particles 1 | 1.50 | 1.50 | Henschel mixer | no | 4000 rpm | 75 | 0.25 | 0.31 |
| Toner A15 | Toner particles 1 | Silica fine particles 9 | 0.60 | 0.60 | Apparatus in FIG. 5 | 0.10 W/g (150 rpm) | 0.60 W/g (1400 rpm) | 56 | 0.48 | 0.38 |
| Toner A16 | Toner particles 1 | Silica fine particles 10 | 0.60 | 0.60 | Apparatus in FIG. 5 | 0.10 W/g (150 rpm) | 0.60 W/g (1400 rpm) | 56 | 0.48 | 0.38 |
| Toner A17 | Toner particles 1 | Silica fine particles 11 | 0.60 | 0.60 | Apparatus in FIG. 5 | 0.10 W/g (150 rpm) | 0.60 W/g (1400 rpm) | 56 | 0.48 | 0.38 |
| Toner A18 | Toner particles 1 | Silica fine particles 12 | 2.00 | 2.00 | Henschel mixer | no | 4000 rpm | 50 | 0.47 | 0.41 |

<Production Example of Charging Member>

<Methods for Measuring Various Parameters>

[Observation of Cross Section of Resin Particles]

First, the resin particles themselves were embedded using a photo-curable resin such as a visible light-curable embedding resin (trade name: D-800 available from Nisshin EM Corporation or trade name: Epok 812 set available from Okenshoji Co., Ltd.). Subsequently, rough cutting was performed using an ultramicrotome (trade name: LEICA EM UCT available from Leica) equipped with a diamond knife (trade name: DiATOME CRYO DRY available from DIATOME) and a cryosystem (trade name: LEICA EM FCS available from Leica). The center (near the center of gravity of the resin particles) of the resin particle was cut to prepare sections each having a thickness of 100 nm. Subsequently, a staining treatment was performed using a stain such as osmium tetroxide, ruthenium tetroxide, or phosphotungstic acid. The sectional image of the resin particle was captured with a transmission electron micrograph (trade name: H-7100FA manufactured by Hitachi, Ltd.). This process was performed on 100 particles. Herein, the resin was observed in white and the pores were observed in black. The resin for embedment and the stain are suitably selected in accordance with the material of the resin particles. The combination of the resin and the stain is selected so that the pores in the resin particles can be clearly observed. In all Production Examples of the present invention described below, the pores could be clearly observed by using the visible light-curable embedding resin D-800 and ruthenium tetroxide. This process was performed on freely-selected 100 particles. Herein, the resin was observed in white and the pores were observed in somewhat gray.

[Volume-Average Particle Diameter of Resin Particles]

The total area of a cross section of a particle including pores is calculated from the obtained cross sectional image of the particle. The diameter of a circle having an area equal to the total area is determined. The average particle diameter of the 100 particles is calculated from the diameter. The average particle diameter is defined as a volume-average particle diameter of the resin particles.

[Porosity of Resin Particles]

The ratio of the total area of the pores in the cross sectional image to the total area of the cross section of the particle including the pores is calculated from the cross sectional image of the particle obtained in the [Observation of cross section of resin particles]. This process is performed on freely-selected 10 particles. The average of the 10 ratios is defined as a porosity of the resin particles.

The method for calculating the porosity of the resin particles will be described in detail below with reference to FIG. 3.

The center 7 of a resin particle 3 is calculated from a circle having an area equal to the area of the particle in the cross sectional image obtained in the [Observation of cross section of resin particles].

One hundred positions (e.g., position 8) that are shifted from the center 7 toward the outside of the particle by a distance of $(3)^{1/2}/2$ times the particle radius are determined. A region on the center 7 side among regions formed by connecting the 100 positions using straight lines is defined as an internal region 9 of the resin particle. A region on the near-surface side is defined as a near-surface region of the resin particle.

In each of the internal region 9 and the near-surface region 10 of the resin particle, the ratio of the total area of the pores in the cross sectional image to the total area of the particle including the pores is calculated. The average of the ratios is defined as an internal region porosity or a near-surface region porosity.

[Measurement of Three-Dimensional Resin Particle Shape of Particles Contained in Resin Layer Used for Surface of Charging Member]

In a freely-selected projection on the surface of the charging member, cutting is performed from the top side of the projection of the charging member at intervals of 20 nm using a focused ion beam (trade name: FB-2000C manufactured by Hitachi, Ltd.) over a region having a length of 200 μm and a width of 200 μm and extending in parallel with the surface of the charging member. The cross sectional images are captured. The captured images of the same particle are integrated at intervals of 20 nm to calculate the three-dimensional particle shape. This process is performed on freely-selected 100 portions on the surface of the charging member.

[Volume-Average Particle Diameter of Resin Particles Contained in Resin Layer Used for Surface of Charging Member]

Regarding the three-dimensional particle shape obtained by the method described in the [Measurement of three-dimensional resin particle shape of particles contained in resin layer used for surface of charging member], the total volume of the particle including the pores is calculated. Assuming that the resin particle is a solid particle, the total volume is a volume of the resin particle. The diameter of a sphere having a volume equal to the volume of the resin particle is determined. The average of the diameters of 100 resin particles is calculated. The average is defined as a volume-average particle diameter of the resin particles.

[Porosity of Resin Particles Contained in Resin Layer Used for Surface of Charging Member]

The total volume of the pores of the entire resin particle is calculated from the three-dimensional particle shape obtained by the method described in the [Measurement of three-dimensional resin particle shape of particles contained in resin layer used for surface of charging member]. The ratio of the total volume of the pores to the total volume of the resin particle including the pores is calculated. This process is performed on 100 particles. The average of the ratios is defined as a porosity of the entire resin particles.

Figure 12:
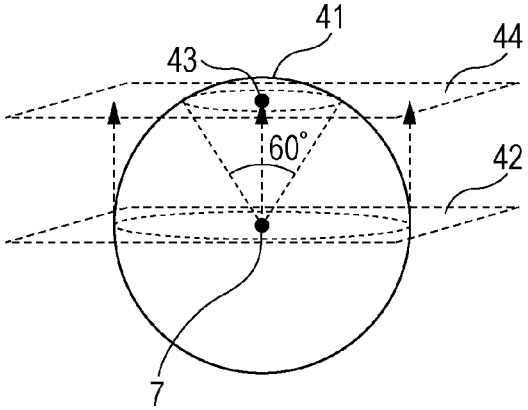
FIG. 12 shows a schematic view three-dimensionally illustrating a resin particle that constitutes a projection on the surface of the charging member.

In the case where the porosity on the surface side of the charging member is different from the porosity inside the charging member, when the resin particle is assumed to be a solid particle, a 11% by volume-occupying region of the solid particle on the surface side of the charging member is determined from the obtained three-dimensional particle shape. FIG. 12 is a schematic view three-dimensionally showing a resin particle 3 constituting a projection on the surface of the charging member. A method for calculating the porosity will be described below with reference to FIG. 12. First, the center 7 of the resin particle 3 is calculated from the three-dimensional particle shape. An imaginary plane 42 that extends in parallel with the surface of the charging member and passes through the center 7 of the resin particle 3 is provided. The plane 42 is moved parallel from the center 7 of the resin particle 3 to a position 43 located on the surface side of the charging member by a distance of $(3)^{1/2}/2$ times the radius of the sphere. In other words, the imaginary plane 42 that passes through the center 7 of the resin particle 3 is moved parallel to a position of an imaginary plane 44. When the resin particle 3 is assumed to be a solid particle, a region 41 which is separated by the plane 44 and is located on the surface side of the charging member is defined as an 11% by volume-region 41 of the solid particle on the surface side of the charging member. In the region, the total volume of the pores is calculated from the three-dimensional particle shape. The ratio of the total volume of the pores to the total volume of the region including the pores is calculated.

[Surface Roughness of Charging Member]

The ten-point height of irregularities Rzjis is measured in conformity with the standard of surface roughness in JIS B 0601-1994 using a surface roughness tester (trade name: SE-3500 manufactured by Kosaka Laboratory Ltd.). The ten-point height of irregularities Rzjis is an average of surface roughness values at six positions freely selected from the charging member. In the measurement, the cutoff value is set to 0.8 mm and the evaluation length is set to 8 mm.

Production Examples B1 to B17 of Resin Particles

Production Example B1

Production of Resin Particles B1

To 400 parts by mass of deionized water, 8.0 parts by mass of tricalcium phosphate was added, thereby preparing an aqueous medium. Subsequently, 38.0 parts by mass of methyl methacrylate serving as a polymerizable monomer, 26.0 parts by mass of ethylene glycol dimethacrylate serving as a cross-linkable monomer, 34.1 parts by mass of normal hexane serving as a first pore-forming agent, 8.5 parts by mass of ethyl acetate serving as a second pore-forming agent, and 0.3 parts by mass of 2,2'-azobisisobutyronitrile were mixed with each other to prepare an oil-based mixture liquid. The oil-based mixture liquid was dispersed in the aqueous medium using a homomixer at 2000 rpm. The mixture was then charged into a polymerization reaction vessel purged with nitrogen and subjected to suspension polymerization under stirring at 250 rpm at 60° C. for 6 hours to obtain an aqueous suspension containing porous resin particles, normal hexane, and ethyl acetate. To the aqueous suspension, 0.4 parts by mass of sodium dodecylbenzenesulfonate was added. The concentration of the sodium dodecylbenzenesulfonate was adjusted so as to be 0.1% by mass in water.

The obtained aqueous suspension was distilled to remove the normal hexane and the ethyl acetate. The resulting aqueous suspension was repeatedly filtered and washed with water, and then dried at 80° C. for 5 hours. A disintegration and classification treatment was performed with an ultrasonic classifier to obtain resin particles B1 having an average particle diameter of 30.5 μm. As a result of the observation of cross sections of the particles by the above-described method, the resin particles B1 were porous particles including a plurality of pores and having a core-shell structure including different structures in the internal region and the near-surface region. In the internal region of the resin particles, the porosity was 20% and the pore size was about 21 nm. In the near-surface region, the near-surface region porosity was 35% and the pore size was about 87 nm.

Production Examples B2 to B13

Production of Resin Particles B2 to B13

Resin particles B2 to B13 were produced in the same manner as in Production Example B1, except that the polymerizable monomer, the cross-linkable monomer, the first pore-forming agent, and the second pore-forming agent for producing the oil-based mixture liquid were changed as shown in Table 4 and the rotational speed of the homomixer was changed as shown in Table 4. The obtained resin particles B2 to B13 were porous particles.

TABLE 4

| Resin particle No. | Type of polymerizable monomer | Amount of polymerizable monomer added/parts by mass | Type of cross-linkable monomer | Amount of cross-linkable monomer added/parts by mass | Type of first pore-forming agent | Amount of first pore-forming agent added/parts by mass | Type of second pore-forming agent | Amount of second pore-forming agent/parts by mass | Rotational speed of homomixer/ppm |
|---|---|---|---|---|---|---|---|---|---|
| Resin particles B1 | Methyl methacrylate | 38.0 | Ethylene glycol dimethacrylate | 26.0 | Normal hexane | 34.1 | Ethyl acetate | 8.5 | 2000 |
| Resin particles B2 | Butyl methacrylate | 38.0 | Ethylene glycol dimethacrylate | 26.0 | Normal hexane | 34.1 | Isopropyl acetate | 8.5 | 1400 |

TABLE 4-continued

| Resin particle No. | Type of polymerizable monomer | Amount of polymerizable monomer added/parts by mass | Type of cross-linkable monomer | Amount of cross-linkable monomer added/parts by mass | Type of first pore-forming agent | Amount of first pore-forming agent added/parts by mass | Type of second pore-forming agent | Amount of second pore-forming agent/parts by mass | Rotational speed of homomixer/ppm |
|---|---|---|---|---|---|---|---|---|---|
| Resin particles B3 | Methyl methacrylate | 32.0 | Ethylene glycol dimethacrylate | 21.9 | Normal hexane | 43.1 | Methyl acetate | 10.8 | 3600 |
| Resin particles B4 | Methyl methacrylate + Styrene | 14.0 14.0 | 1,6-hexanediol dimethacrylate | 19.2 | Normal hexane | 46.1 | Methyl acetate | 11.5 | 1900 |
| Resin particles B5 | Methyl methacrylate | 28.0 | Ethylene glycol dimethacrylate | 19.2 | Normal hexane | 46.1 | Methyl acetate | 11.5 | 2800 |
| Resin particles B6 | Methyl methacrylate + Butyl methacrylate | 16.0 16.0 | Ethylene glycol dimethacrylate | 21.9 | Normal hexane | 43.1 | Isopropyl acetate | 10.8 | 1400 |
| Resin particles B7 | Methyl methacrylate | 28.0 | Ethylene glycol dimethacrylate | 19.2 | Normal hexane | 46.1 | Isopropyl acetate | 11.5 | 1000 |
| Resin particles B8 | Butyl methacrylate | 38.0 | 1,6-hexanediol dimethacrylate | 26.0 | Normal hexane | 34.1 | Isopropyl acetate | 8.5 | 3500 |
| Resin particles B9 | Methyl methacrylate + Styrene | 20.0 5.0 | Ethylene glycol dimethacrylate | 17.1 | Normal hexane | 50.5 | Acetone | 12.6 | 4500 |
| Resin particles B10 | Styrene | 25.0 | Ethylene glycol dimethacrylate | 17.1 | Normal hexane | 50.5 | Acetone | 12.6 | 3800 |
| Resin particles B11 | Styrene | 25 | Ethylene glycol dimethacrylate | 17.1 | Normal hexane | 50.5 | Acetone | 12.6 | 2800 |
| Resin particles B12 | Methyl methacrylate | 33.0 | 1,6-hexanediol dimethacrylate | 17.0 | Methyl acetate | 50 | — | — | 4800 |
| Resin particles B13 | Methyl methacrylate | 20.0 | 1,6-hexanediol dimethacrylate | 10 | Normal hexane | 75 | — | — | 3800 |

Production Example B14

Production of Resin Particles B14

To 300 parts by mass of deionized water, 10.5 parts by mass of tricalcium phosphate and 0.015 parts by mass of sodium dodecylbenzenesulfonate were added, thereby preparing an aqueous medium. Subsequently, 65 parts by mass of lauryl methacrylate, 30 parts by mass of ethylene glycol dimethacrylate, 0.5 parts by mass of poly(ethylene glycol-tetramethylene glycol) monomethacrylate, and 0.5 parts by mass of azobisisobutyronitrile were mixed with each other to prepare an oil-based mixture liquid. The oil-based mixture liquid was dispersed in the aqueous medium using a homomixer at 4000 rpm. The mixture was then charged into a polymerization reaction vessel purged with nitrogen and subjected to suspension polymerization under stirring at 250 rpm at 70° C. for 8 hours. After cooling, hydrochloric acid was added to the resulting suspension to decompose calcium phosphate. The suspension was repeatedly filtered and washed with water, and dried at 80° C. for 5 hours. A disintegration and classification treatment was then performed with an ultrasonic classifier to obtain resin particles B14 having an average particle diameter of 20.2 μm. As a result of the observation of cross sections of the particles by the above-described method, the resin particles B14 were multi-hollow particles which include a plurality of pores with a pore size of about 3500 nm therein and which have a porosity of about 5%.

Production Example B15

Production of Resin Particles B15

To 300 parts by mass of deionized water, 10.5 parts by mass of tricalcium phosphate and 0.015 parts by mass of sodium dodecylbenzenesulfonate were added, thereby preparing an aqueous medium. Subsequently, 65 parts by mass of lauryl methacrylate, 30 parts by mass of ethylene glycol dimethacrylate, 0.15 parts by mass of poly(ethylene glycol-tetramethylene glycol) monomethacrylate, and 0.5 parts by mass of azobisisobutyronitrile were mixed with each other to prepare an oil-based mixture liquid. The oil-based mixture liquid was dispersed in the aqueous medium using a homomixer at 4000 rpm. The mixture was then charged into a polymerization reaction vessel purged with nitrogen and subjected to suspension polymerization under stirring at 250 rpm at 70° C. for 8 hours. After cooling, hydrochloric acid was added to the resulting suspension to decompose calcium phosphate. The suspension was repeatedly filtered and washed with water, and dried at 80° C. for 5 hours. A disintegration and classification treatment was then performed with an ultrasonic classifier to obtain resin particles B15 having an average particle diameter of 15.2 μm. As a result of the observation of cross sections of the particles by the above-described method, the resin particles B15 were multi-hollow particles which include a plurality of pores with a pore size of about 800 nm therein and which have a porosity of about 0.8%.

Production Example B16

Production of Resin Particles B16

Cross-linked polymethyl methacrylate resin particles (trade name: MBX-30 manufactured by SEKISUI PLASTICS CO., Ltd.) were classified to obtain resin particles B16 having a volume-average particle diameter of 25.1 μm. As a result of the observation of cross sections of the particles by the above-described method, the resin particles B16 of this Production Example were solid particles including no pores therein.

Production Example B17

Production of Resin Particles B17

To 300 parts by mass of deionized water, 20 parts by mass of tricalcium phosphate and 0.04 parts by mass of sodium dodecylbenzenesulfonate were added, thereby preparing an aqueous medium. Subsequently, 10 parts by mass of methyl acrylate, 81 parts by mass of styrene, 15 parts by mass of divinylbenzene, 0.8 parts by mass of azobisisobutyronitrile, and 1.2 parts by mass of a surfactant (trade name: Solbase 26000 manufactured by Solbase) were mixed with each other to prepare an oil-based mixture liquid. The oil-based mixture liquid was dispersed in the aqueous medium using a homomixer at 4000 rpm. The mixture was then charged into a polymerization reaction vessel purged with nitrogen and subjected to suspension polymerization under stirring at 250 rpm at 70° C. for 8 hours. After cooling, hydrochloric acid was added to the resulting suspension to decompose calcium phosphate. The suspension was repeatedly filtered and washed with water, and dried at 80° C. for 5 hours. A disintegration and classification treatment was then performed with an ultrasonic classifier to obtain resin particles B17 having an average particle diameter of 20.2 μm. As a result of the observation of cross sections of the particles by the above-described method, the particles were particles including a single hollow therein (hereafter referred to as "single-hollow particles"). The hollow had a pore size of about 5200 nm and a porosity of about 5%.

Table 5 collectively shows the shape, the average particle diameter, the pore size, and the porosity of the produced resin particles.

Production Example of Fine Particles

Production Example C1

Production of Composite Conductive Fine Particles

Under the operation of an edge runner, 140 g of methylhydrogenpolysiloxane was added to 7.0 kg of silica particles (average particle diameter: 15 nm, volume resistivity: $1.8\times10^{12}$ Ω·cm), and they were mixed under stirring at a line load of 588 N/cm (60 kg/cm) for 30 minutes. The stirring speed herein was 22 rpm. Under the operation of the edge runner, 7.0 kg of carbon black (trade name: #52, manufactured by Mitsubishi Chemical Corporation) was added thereto over 10 minutes, and they were mixed under stirring at a line load of 588 N/cm (60 kg/cm) for 60 minutes. After the carbon black was attached to the surfaces of the silica particles coated with the methylhydrogenpolysiloxane, drying was performed with a dryer at 80° C. for 60 minutes to produce composite conductive fine particles. The stirring speed herein was 22 rpm. The produced composite conductive fine particles had an average particle diameter of 15 nm and a volume resistivity of $1.1\times10^{2}$ Ω·cm.

TABLE 5

| Resin particle No. | Particle shape | Average particle diameter/μm | Inside of resin particles | | Near-surface of resin particles | | Near-surface/inside | |
|---|---|---|---|---|---|---|---|---|
| | | | Pore size/nm | Porosity/% | Pore size/nm | Porosity/% | Pore size ratio | Porosity ratio |
| Resin particles B1 | Porous particles (core-shell structure) | 30.5 | 21 | 20 | 87 | 35 | 4.1 | 1.8 |
| Resin particles B2 | Porous particles (core-shell structure) | 35.3 | 15 | 15 | 55 | 32 | 3.7 | 2.1 |
| Resin particles B3 | Porous particles (core-shell structure) | 20.1 | 22 | 21 | 140 | 46 | 6.4 | 2.2 |
| Resin particles B4 | Porous particles (core-shell structure) | 32.0 | 45 | 32 | 145 | 51 | 3.2 | 1.6 |
| Resin particles B5 | Porous particles (core-shell structure) | 26.0 | 23 | 25 | 101 | 41 | 4.4 | 1.6 |
| Resin particles B6 | Porous particles (core-shell structure) | 35.5 | 15 | 18 | 34 | 30 | 2.3 | 1.7 |
| Resin particles B7 | Porous particles (core-shell structure) | 41.0 | 17 | 26 | 38 | 40 | 2.2 | 1.5 |
| Resin particles B8 | Porous particles (core-shell structure) | 21.0 | 30 | 18 | 65 | 32 | 2.2 | 1.8 |
| Resin particles B9 | Porous particles (core-shell structure) | 15.3 | 25 | 39 | 178 | 59 | 7.1 | 1.5 |
| Resin particles B10 | Porous particles (core-shell structure) | 18.8 | 29 | 38 | 180 | 60 | 6.2 | 1.6 |
| Resin particles B11 | Porous particles (core-shell structure) | 26.0 | 31 | 36 | 195 | 61 | 6.3 | 1.7 |
| Resin particles B12 | Porous particles | 8.1 | 132 | 45 | 131 | 40 | 1.0 | 0.9 |
| Resin particles B13 | Porous particles | 25.5 | 20 | 28 | 20 | 28 | 1.0 | 1.0 |
| Resin particles B14 | Multi-hollow particles | 25.2 | 3500 | 5 | 3500 | 5 | 1.0 | 0.9 |
| Resin particles B15 | Multi-hollow particles | 15.2 | 810 | 0.8 | 756 | 0.7 | 0.9 | 0.9 |
| Resin particles B16 | Solid particles | 25.1 | — | — | — | — | — | — |
| Resin particles B17 | Single-hollow particles | 20.2 | 5200 | 5 | — | — | — | — |

Production Example C2

Production of Surface-Treated Titanium Oxide Particles

A slurry was prepared by adding 110 g of isobutyltrimethoxysilane serving as a surface treatment agent and 3000 g of toluene serving as a solvent to 1000 g of acicular rutile-type titanium oxide particles (average particle diameter: 15 nm, length:width=3:1, volume resistivity: $2.3\times10^{10}$ Ω·cm). The slurry was stirred with a stirrer for 30 minutes and then fed to a visco mill in which 80% of the effective inner volume was filled with glass beads having an average particle diameter of 0.8 mm. The slurry was subjected to a wet disintegration treatment at 35±5° C. Toluene was removed from the slurry obtained as a result of the wet disintegration treatment by decompression distillation (bath temperature: 110° C., product temperature: 30 to 60° C., degree of decompression: 100 Torr) using a kneader, and a baking treatment for the surface treatment agent was performed at 120° C. for 2 hours. The particles subjected to the baking treatment were cooled to room temperature and pulverized with a pin mill to produce surface-treated titanium oxide particles. The produced surface-treated titanium oxide particles had an average particle diameter of 15 nm and a volume resistivity of $5.2\times10^{15}$ Ω·cm.

Production Example of Charging Member

Production Example D1

Production of Charging Member D1

(Production of Electro-Conductive Substrate)

A thermosetting adhesive containing 10% by mass of carbon black was applied onto a stainless steel base having a diameter of 6 mm and a length 244 mm and dried to provide an electro-conductive substrate.

(Production of Conductive Rubber Composition)

Eight materials listed in Table 6 below were added to 100 parts by mass of epichlorohydrin rubber (EO-EP-AGE ternary compound, EO/EP/AGE=73 mol %/23 mol %/4 mol %). The mixture was kneaded with a closed mixer adjusted to 50° C. for 10 minutes to prepare a raw material compound.

TABLE 6

| Material | Amount of usage (parts by mass) |
|---|---|
| Epichlorohydrin rubber (EO-EP-AGE ternary compound, EO/EP/AGE = 73 mol %/23 mol %/4 mol %) | 100 |
| Calcium carbonate (trade name: Silver-W manufactured by Shiraishi Kogyo Kaisha, Ltd.) | 80 |
| Adipic acid ester (trade name: Polycizer W305ELS manufactured by DIC Corporation) | 8 |
| Zinc stearate (trade name: SZ-2000 manufactured by SAKAI CHEMICAL INDUSTRY CO., LTD.) | 1 |
| 2-mercaptobenzimidazole (MB) (antioxidant) | 0.5 |
| Zinc oxide (trade name: Zinc oxide Grade No. 2 manufactured by SAKAI CHEMICAL INDUSTRY CO., LTD.) | 2 |
| Quaternary ammonium salt "ADK CIZER LV70" (trade name, manufactured by ADEKA Corporation) | 2 |
| Carbon black "Thermax Flow Form N990" (trade name, manufactured by Canada Cancarb, average particle diameter: 270 nm) | 5 |

EO: ethylene oxide, EP: epichlorohydrin, AGE: allyl glycidyl ether

To the raw material compound, 0.8 parts by mass of sulfur serving as a vulcanizing agent and 1 part by mass of dibenzothiazyl sulfide (DM) and 0.5 parts by mass of tetramethylthiuram monosulfide (TS) serving as vulcanization accelerators were added. Subsequently, the mixture was kneaded for 10 minutes using a two-roll mill cooled to 20° C. to produce a conductive rubber composition. Herein, the gap between the two rolls was adjusted to 1.5 mm.

(Production of Elastic Roller)

The outer peripheral portion of the electro-conductive substrate serving as a central axis was coated with the conductive rubber composition using an extruder equipped with a crosshead so that the conductive rubber composition is formed in a coaxial-cylinder shape. Thus, a rubber roller was obtained. The thickness of the applied rubber composition was adjusted to 1.75 mm.

The rubber roller was heated in an air-heating furnace at 160° C. for 1 hour. Then, the end portions of the elastic layer were removed to decrease the length to 226 mm. Furthermore, secondary heating was performed at 160° C. for 1 hour to produce a roller including a preliminary coating layer with a thickness of 1.75 mm.

The peripheral surface of the produced roller was ground with a cylindrical grinding machine of a plunge cutting system. A vitrified grinding wheel was used as the grinding wheel. The abrasive grains were green silicon carbide (GC) particles having a particle size of 100 mesh. The rotational speed of the roller was 350 rpm. The rotational speed of the grinding wheel was 2050 rpm. The rotational direction of the roller was the same as the rotational direction of the grinding wheel (following direction). The cutting rate was changed in stages from 10 mm/min to 0.1 mm/min until the time when the grinding wheel was ground to ϕ9 mm from the contact with an unground roller. The spark-out time (the time at a cut of 0 mm) was set to 5 seconds. Thus, a conductive elastic roller was produced. The thickness of the elastic layer was set to 1.5 mm. The crown height of the roller was 100 μm.

(Production of Resin Layer Coating Solution D1)

In the first-stage dispersion, methyl isobutyl ketone was added to a caprolactone-modified acrylic polyol solution (trade name: Placcel DC2016 manufactured by DAICEL Corporation) and the solid content was adjusted to 12% by mass. The composite conductive fine particles serving as electro-conductive particles, the surface-treated titanium oxide particles serving as inorganic particles, and modified dimethyl silicone oil, which are listed in the column of Component (1) in Table 7 below, were added to 834 parts by mass of the solution (the solid content of acrylic polyol was 100 parts by mass) to prepare a mixture solution. Subsequently, 188.5 g of the mixture solution was inserted into a glass bottle having an inner volume of 450 mL together with 200 g of glass beads having an average particle diameter of 0.8 mm and serving as media. The dispersion was performed with a paint shaker for 20 hours.

In the second-stage dispersion, after the first-stage dispersion, a component (2) and the resin particles B1 listed in Table 7 were added. In a blocked isocyanate mixture, which is the component (2) listed in Table 7, the isocyanate content was set so as to satisfy "NCO/OH=1.0". After the addition, dispersion was performed for 5 minutes and the glass beads were removed to produce a resin layer coating solution d1. The specific gravity of the coating solution was 0.9260. The median size D50 of an aggregate containing the electro-conductive particles and the inorganic particles in the coating solution was 180 nm. The median size D50 of the aggregate was measured with a dynamic light scattering device (trade name: Nanotrac UPA manufactured by NIKKISO CO., LTD.). The coating solution was diluted 100 times using methyl isobutyl ketone. The measurement was performed twice for 5 minutes, and the average of the measurement results was defined as the median size.

TABLE 7

| | Material | Amount of usage (parts by mass) |
|---|---|---|
| Component (1) | Caprolactone-modified acrylic polyol solution (trade name: Placcel DC2016 manufactured by DAICEL Corporation) | 100 |
| | Composite conductive fine particles (produced in Production Example C1) | 60 |
| | Surface-treated titanium oxide particles (produced in Production Example C2) | 50 |
| | Modified dimethyl silicone oil (trade name: SH28PA manufactured by Dow Corning Toray Co., Ltd.) | 0.08 |
| Component (2) | Blocked isocyanate mixture (mixture of butanone oxime blocked hexamethylene diisocyanate (HDI) and butanone oxime blocked isophorone diisocyanate (IPDI) at a ratio of 7:3) | 80.14 |
| Resin particles | Resin particles B1 | 50 |

HDI (trade name: Duranate TPA-B80E manufactured by Asahi Kasei Corp.)
IPDI (trade name: VESTANAT B1370 manufactured by Degussa-Huels AG)

(Formation of Resin Layer)

The elastic roller was immersed in the coating solution by a dipping method while the longitudinal direction was treated as a vertical direction. The immersion time was 9 seconds. The initial pulling-up speed was 20 mm/s, the final pulling-up speed was 2 mm/s, and the pulling-up speed between the initial pulling-up speed and the final pulling-up speed was changed linearly with respect to time. The coated product was air-dried at 23° C. for 30 minutes. The coated product was then dried with a hot-air circulating dryer at 80° C. for 1 hour and furthermore at 160° C. for 1 hour to cure the coating film. Thus, a charging member D1 including a resin layer formed on the peripheral portion of the elastic layer was obtained. The resin layer had a thickness of 5.2 μm. The thickness of the resin layer was measured at a position where resin particles were not present.

Production Examples D2 to D27

Production of Charging Members D2 to D27

Table 8 shows the materials and physical properties of resin layer coating solutions d2 to d27 for producing charging members D2 to D27. The charging members D2 to D27 were produced in the same manner as in Production Example D1, except that the materials were changed to the materials listed in Table 8 below. Table 9 shows the physical properties of the produced charging members.

When carbon black was used as the conductive fine particles, the amount of the carbon black added was 29.7 parts by mass based on 100 parts by mass of the acrylic polyol solid content. The isocyanate content was set so as to satisfy "NCO/OH=1.0".

TABLE 8

| Resin layer coating solution No. | First-stage dispersion: Conductive fine particles | First-stage dispersion: Inorganic particles | First-stage dispersion: Isocyanate | Second-stage dispersion: Resin particle No. | Second-stage dispersion: Number of parts of resin particle added/parts by nass | Second-stage dispersion: Isocyanate | Median size: D50 of conductive fine particles or aggregate/nm |
|---|---|---|---|---|---|---|---|
| Resin layer coating solution d1 | Composite conductive fine particles | Surface-treated titanium oxide particles | — | Resin particles B1 | 50 | IPDI/HDI mixture | 182 |
| Resin layer coating solution d2 | Composite conductive fine particles | Surface-treated titanium oxide particles | — | Resin particles B1 | 50 | IPDI | 203 |
| Resin layer coating solution d3 | Composite conductive fine particles | Surface-treated titanium oxide particles | IPDI | Resin particles B1 | 50 | — | 305 |
| Resin layer coating solution d4 | Composite conductive fine particles | Surface-treated titanium oxide particles | — | Resin particles B1 | 10 | IPDI/HDI mixture | 183 |
| Resin layer coating solution d5 | Composite conductive fine particles | Surface-treated titanium oxide particles | — | Resin particles B1 | 30 | IPDI/HDI mixture | 182 |
| Resin layer coating solution d6 | Composite conductive fine particles | — | — | Resin particles B1 | 50 | IPDI/HDI mixture | 253 |
| Resin layer coating solution d7 | Carbon black | Surface-treated titanium oxide particles | — | Resin particles B1 | 50 | IPDI/HDI mixture | 112 |
| Resin layer coating solution d8 | Carbon black | Silica | — | Resin particles B1 | 50 | IPDI/HDI mixture | 135 |
| Resin layer coating solution d9 | Carbon black | — | — | Resin particles B1 | 40 | IPDI/HDI mixture | 123 |
| Resin layer coating solution d10 | Carbon black | — | — | Resin particles B1 | 40 | IPDI | 121 |
| Resin layer coating solution d11 | Carbon black | — | IPDI | Resin particles B1 | 40 | — | 251 |
| Resin layer coating solution d12 | Composite conductive fine particles | Surface-treated titanium oxide particles | — | Resin particles B2 | 50 | IPDI/HDI mixture | 182 |
| Resin layer coating | Composite conductive | Surface-treated titanium | — | Resin particles | 50 | IPDI/HDI | 178 |

TABLE 8-continued

| Resin layer coating solution No. | First-stage dispersion: Conductive fine particles | First-stage dispersion: Inorganic particles | First-stage dispersion: Isocyanate | Second-stage dispersion: Resin particle No. | Second-stage dispersion: Number of parts of resin particle added/parts by nass | Second-stage dispersion: Isocyanate | Median size D50 of conductive fine particles or aggregate/nm |
|---|---|---|---|---|---|---|---|
| solution d13 | fine particles | oxide particles | | B3 | | mixture | |
| Resin layer coating solution d14 | Composite conductive fine particles | Surface-treated titanium oxide particles | — | Resin particles B4 | 50 | IPDI/HDI mixture | 183 |
| Resin layer coating solution d15 | Composite conductive fine particles | Surface-treated titanium oxide particles | — | Resin particles B5 | 50 | IPDI/HDI mixture | 179 |
| Resin layer coating solution d16 | Composite conductive fine particles | Surface-treated titanium oxide particles | — | Resin particles B6 | 50 | IPDI/HDI mixture | 179 |
| Resin layer coating solution d17 | Composite conductive fine particles | Surface-treated titanium oxide particles | — | Resin particles B7 | 50 | IPDI/HDI mixture | 182 |
| Resin layer coating solution d18 | Composite conductive fine particles | Surface-treated titanium oxide particles | — | Resin particles B8 | 50 | IPDI/HDI mixture | 183 |
| Resin layer coating solution d19 | Composite conductive fine particles | Surface-treated titanium oxide particles | — | Resin particles B9 | 50 | IPDI/HDI mixture | 184 |
| Resin layer coating solution d20 | Composite conductive fine particles | Surface-treated titanium oxide particles | — | Resin particles B10 | 50 | IPDI/HDI mixture | 181 |
| Resin layer coating solution d21 | Composite conductive fine particles | Surface-treated titanium oxide particles | — | Resin particles B11 | 50 | IPDI/HDI mixture | 181 |
| Resin layer coating solution d22 | Composite conductive fine particles | Surface-treated titanium oxide particles | — | Resin particles B12 | 50 | IPDI/HDI mixture | 183 |
| Resin layer coating solution d23 | Composite conductive fine particles | Surface-treated titanium oxide particles | — | Resin particles B13 | 50 | IPDI/HDI mixture | 182 |
| Resin layer coating solution d24 | Composite conductive fine particles | Surface-treated titanium oxide particles | — | Resin particles B14 | 50 | IPDI/HDI mixture | 188 |
| Resin layer coating solution d25 | Composite conductive fine particles | Surface-treated titanium oxide particles | — | Resin particles B15 | 50 | IPDI/HDI mixture | 185 |
| Resin layer coating solution d26 | Carbon black | — | IPDI/HDI mixture | Resin particles B16 | 50 | — | 155 |
| Resin layer coating solution d27 | Carbon black | — | IPDI/HDI mixture | Resin particles B17 | 50 | — | 158 |

Carbon black (trade name: #52 manufactured by Mitsubishi Chemical Corporation)
Silica (trade name: AEROSIL 300SP manufactured by AEROSIL)

TABLE 9

| Production Example No. | Charging member No. | Resin layer coating solution No. | Resin particles in resin layer: Resin particle No. | Resin particles in resin layer: Volume-average particle diameter/μm | Resin particles in resin layer: Number of pores (state of pores) | Resin particles in resin layer: Porosity: Entire particle | Resin particles in resin layer: Porosity: Top side of projection | Resin particles in resin layer: Pore size (nm): Inside | Resin particles in resin layer: Pore size (nm): Top side of projection | Charging member: Surface roughness Rz/μm |
|---|---|---|---|---|---|---|---|---|---|---|
| Production Example D1 | Charging member D1 | Resin layer coating solution d1 | Resin particle B1 | 29.9 | Plural (core-shell structure) | 0.91 | 6 | 44 | 96 | 30.9 |
| Production Example D2 | Charging member D2 | Resin layer coating solution d2 | Resin particle B1 | 30.1 | Plural (core-shell structure) | 0.91 | 6 | 44 | 96 | 30.9 |
| Production Example D3 | Charging member D3 | Resin layer coating solution d3 | Resin particle B1 | 30.2 | Plural (core-shell structure) | 0.91 | 6 | 44 | 96 | 31.1 |
| Production Example D4 | Charging member D4 | Resin layer coating solution d4 | Resin particle B1 | 29.9 | Plural (core-shell structure) | 0.91 | 6 | 44 | 96 | 30.7 |
| Production Example D5 | Charging member D5 | Resin layer coating solution d5 | Resin particle B1 | 29.7 | Plural (core-shell structure) | 0.91 | 6 | 44 | 96 | 30.6 |
| Production Example D6 | Charging member D6 | Resin layer coating solution d6 | Resin particle B1 | 29.9 | Plural (core-shell structure) | 0.91 | 6 | 44 | 96 | 31.1 |
| Production Example D7 | Charging member D7 | Resin layer coating solution d7 | Resin particle B1 | 29.8 | Plural (core-shell structure) | 0.91 | 6 | 44 | 96 | 30.9 |
| Production Example D8 | Charging member D8 | Resin layer coating solution d8 | Resin particle B1 | 29.9 | Plural (core-shell structure) | 0.91 | 6 | 44 | 96 | 30.7 |
| Production Example D9 | Charging member D9 | Resin layer coating solution d9 | Resin particle B1 | 30.5 | Plural (core-shell structure) | 0.91 | 6 | 44 | 96 | 31.5 |
| Production Example D10 | Charging member D10 | Resin layer coating solution d10 | Resin particle B1 | 30.2 | Plural (core-shell structure) | 0.91 | 6 | 44 | 96 | 31.2 |
| Production Example D11 | Charging member D11 | Resin layer coating solution d11 | Resin particle B1 | 29.7 | Plural (core-shell structure) | 0.91 | 6 | 44 | 96 | 30.7 |
| Production Example D12 | Charging member D12 | Resin layer coating solution d12 | Resin particle B2 | 32.3 | Plural (core-shell structure) | 0.72 | 5.5 | 32 | 61 | 34.1 |

TABLE 9-continued

| | | | Resin particles in resin layer | | | | | | | |
|---|---|---|---|---|---|---|---|---|---|---|
| | | | | Volume-average | | Porosity | | Pore size (nm) | | Charging member |
| Production Example No. | Charging member No. | Resin layer coating solution No. | Resin particle No. | particle diameter/μm | Number of pores (state of pores) | Entire particle | Top side of projection | Inside | Top side of projection | Surface roughness Rz/μm |
| Production Example D13 | Charging member D13 | Resin layer coating solution d13 | Resin particle B3 | 20.0 | Plural (core-shell structure) | 1.6 | 12 | 46 | 145 | 21.0 |
| Production Example D14 | Charging member D14 | Resin layer coating solution d14 | Resin particle B4 | 29.8 | Plural (core-shell structure) | 2 | 15 | 95 | 150 | 30.5 |
| Production Example D15 | Charging member D15 | Resin layer coating solution d15 | Resin particle B5 | 25.1 | Plural (core-shell structure) | 1.8 | 10 | 48 | 111 | 26.8 |
| Production Example D16 | Charging member D16 | Resin layer coating solution d16 | Resin particle B6 | 35.3 | Plural (core-shell structure) | 1.1 | 5.1 | 23 | 37 | 37.1 |
| Production Example D17 | Charging member D17 | Resin layer coating solution d17 | Resin particle B7 | 40.3 | Plural (core-shell structure) | 2.1 | 5.3 | 26 | 42 | 41.1 |
| Production Example D18 | Charging member D18 | Resin layer coating solution d18 | Resin particle B8 | 20.5 | Plural (core-shell structure) | 0.63 | 5.2 | 45 | 72 | 21.8 |
| Production Example D19 | Charging member D19 | Resin layer coating solution d19 | Resin particle B9 | 15.1 | Plural (core-shell structure) | 2.3 | 18 | 38 | 196 | 16.8 |
| Production Example D20 | Charging member D20 | Resin layer coating solution d20 | Resin particle B10 | 18.1 | Plural (core-shell structure) | 2.2 | 19 | 44 | 198 | 19.5 |
| Production Example D21 | Charging member D21 | Resin layer coating solution d21 | Resin particle B11 | 25.3 | Plural (core-shell structure) | 2.4 | 22 | 47 | 200 | 26.8 |
| Production Example D22 | Charging member D22 | Resin layer coating solution d22 | Resin particle B12 | 8.3 | Plural (core-shell structure) | 0.8 | 0 | 105 | 0 | 9.6 |
| Production Example D23 | Charging member D23 | Resin layer coating solution d23 | Resin particle B13 | 25.2 | Plural | 1.5 | 1.5 | 45 | 47 | 26.7 |
| Production Example D24 | Charging member D24 | Resin layer coating solution d24 | Resin particle B14 | 25.2 | Plural | 5 | 5 | 3560 | 3580 | 24.4 |
| Production Example D25 | Charging member D25 | Resin layer coating solution d25 | Resin particle B15 | 15.2 | Plural | 0.8 | 0.7 | 810 | 756 | 13.2 |
| Production Example D26 | Charging member D26 | Resin layer coating solution d26 | Resin particle B16 | 25.1 | Zero | — | — | — | — | 22.3 |
| Production Example D27 | Charging member D27 | Resin layer coating solution d27 | Resin particle B17 | 20.5 | one | 5 | — | 5210 | — | 20.6 |

Example 1

[Durability Test]

A monochrome laser printer (trade name: LBP6300 manufactured by CANON KABUSHIKI KAISHA), which was an image forming apparatus having the structure shown in FIG. 9, was modified so as to have a process speed of 370 mm/sec. Furthermore, a voltage was applied to a charging member from the outside. The voltage applied was an alternating voltage. The peak-to-peak voltage (Vpp) was 1600 V. The frequency (f) was 1350 Hz. The direct voltage (Vdc) was −560 V. Images were formed at a resolution of 600 dpi. As a process cartridge, a process cartridge for the printer was used.

All toner was removed from the process cartridge, and the process cartridge was cleaned. The toner A1 produced in Production Example A1 was charged in a weight equal to the weight of the toner removed from the process cartridge.

Figure 13:
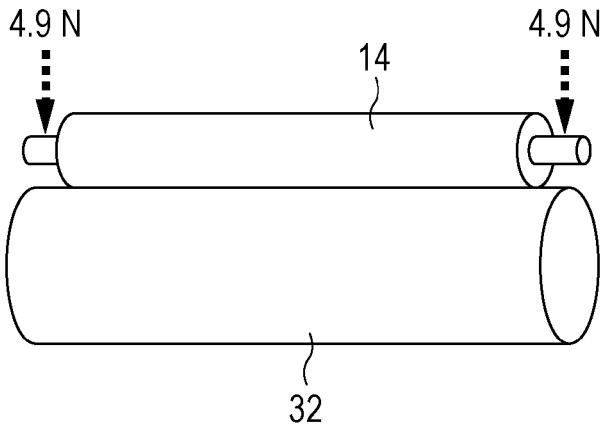
FIG. 13 shows a schematic view illustrating the contact state between a photosensitive member and the charging member according to the present invention.

A charging member included as an accessory of the process cartridge was removed from the process cartridge. The charging member D1 produced in Production Example D1 was attached to the process cartridge. As shown in FIG. 13, the charging member was brought into contact with a photosensitive member at a spring-loaded pressing force of 4.9 N at each end portion, i.e., at 9.8 N at both end portions in total.

After the process cartridge was left to stand in a low-temperature and low-humidity environment (7.5° C./30% RH environment) for 24 hours, the smudge resistance on the surface of the charging member was evaluated by the following durability test.

Specifically, horizontal-line images of 2 dots in width and 186 dots in space in a direction perpendicular to the rotational direction of the photosensitive member were formed in a two-sheet intermittent durability test (durability test in which the rotation of the printer is stopped for 3 seconds every two sheets). A halftone image (a horizontal-line image of 1 dot in width and 2 dots in space in a direction perpendicular to the rotational direction of the photosensitive member) was output before the durability test and after 3000 (3K) sheets, 6000 (6K) sheets, 9000 (9K) sheets, and 10000 (10K) sheets of the horizontal-line images were output. The evaluation was performed using the halftone images. As described above, when the smudge on the surface of the charging member becomes worse, the discharge performance degrades and lateral streak images are observed on the halftone images or abnormal discharge is generated from smudges and spot-like images are observed on the halftone images. The evaluation was performed by visually observing the halftone images. The lateral streak images and the spot-like images were evaluated on the basis of the criteria below. Table 10 shows the evaluation results.

Rank 1: Lateral streak images (spot-like images) are not formed.

Rank 2: Only minor lateral streak images (spot-like images) are observed.

Rank 3: Lateral streak images (spot-like images) are partly observed at a pitch of the charging roller, but such images pose practically no problems.

Rank 4: Lateral streak images (spot-like images) are clearly observed, and the degradation of image quality is recognized.

Furthermore, the surface of the charging member after the durability test was visually observed. The degree of smudge on the surface was evaluated on the basis of the criteria below. Table 10 shows the evaluation results.

Rank 1: No smudges are present.

Rank 2: Smudges are very occasionally present.

Rank 3: Smudges are occasionally present.

Rank 4: Smudges are present in a large amount.

[Evaluation of in-Nip Discharge Intensity]

Figure 14:
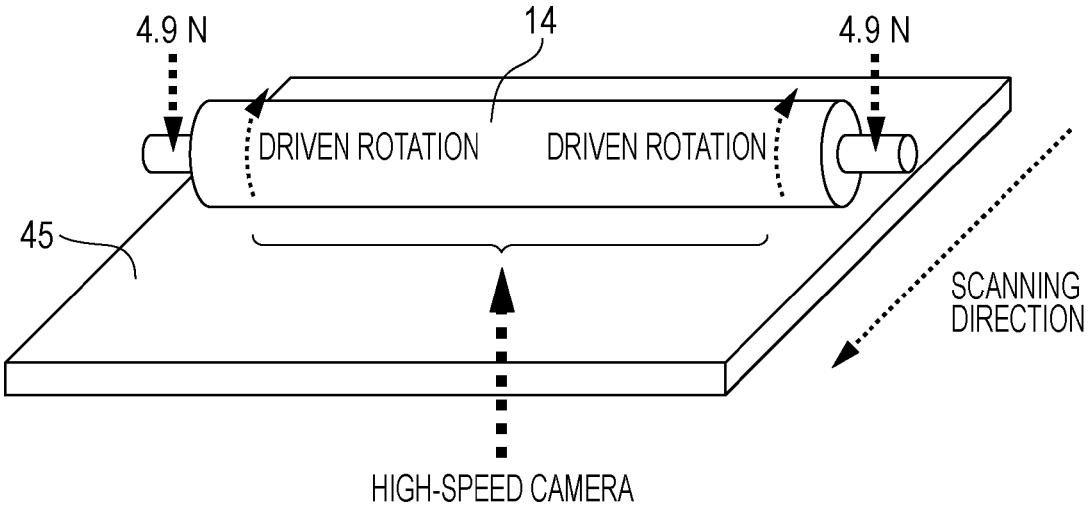
FIG. 14 shows a schematic view according to one aspect of the evaluation for the in-nip discharge intensity of the charging member according to the present invention.

A 5-μm ITO film was formed on a surface of a glass plate (length: 300 mm, width: 240 mm, thickness: 4.5 mm). Only a 17-μm charge transport layer was formed on a surface of the ITO film. As shown in FIG. 14, a tool with which a charging member 14 can be brought into contact with a front surface of a glass plate 45 subjected to the film formation at a spring-loaded pressing force of 4.9 N at each end portion, i.e., at 9.8 N at both end portions in total was produced. Furthermore, this tool allowed the glass plate 45 to scan at 200 mm/s. The glass plate 45 was regarded as the photosensitive member, and the observation was performed from the lower side (the side opposite the front surface of the glass plate 45) of the contact portion using a high-speed camera (product name: FASTCAM-SA1.1 manufactured by Hamamatsu Photonics K.K.) through a high-speed gate (product name: I.I. Unit C9527-2 manufactured by Hamamatsu Photonics K.K.). Thus, the intensity of the in-nip discharge of the charging member 14 was checked. The voltage applied to the charging member 14 was an alternating voltage. The peak-to-peak voltage (Vpp) was 1600 V. The frequency (f) was 1350 Hz. The direct voltage (Vdc) was −560 V. The measurement was conducted in a low-temperature and low-humidity environment (7.5° C./30% RH environment).

Regarding the in-nip discharge, moving images were captured for 0.3 seconds at a capturing speed of 3000 fps, and an image obtained by averaging the moving images was output. In the image capturing, the sensitivity was appropriately adjusted to adjust the brightness of the captured image. The output images before and after the durability test were compared and evaluated on the basis of the criteria below. Table 10 shows the evaluation results.

Rank 1: Stable discharge is observed in the entire nip.

Rank 2: Unstable discharge is observed in part of the nip, but this causes no problems.

Rank 3: Discharge is unstable in the entire nip.

Rank 4: Discharge is week and unstable in the entire nip.

Examples 2 to 33

The evaluation was performed in the same manner as in Example 1, except that the combination of the toner and the charging member was changed as shown in Table 10. Table 10 shows the results.

Comparative Examples 1 to 8

The evaluation was performed in the same manner as in Example 1, except that the combination of the toner and the charging member was changed as shown in Table 10. Table 10 shows the results. In each of Comparative Examples, a large amount of smudge was present on the surface of the charging member after the durability test, the in-nip discharge was weak, the lateral streak images and the spot-like images were clearly observed, and the degradation of image quality was recognized.

TABLE 10

| | | | Durability evaluation | | | | | | | | | | Observation of smudge on surface | In-nip discharge |
|---|---|---|---|---|---|---|---|---|---|---|---|---|---|---|
| | | | Before durability test | | 3000 sheets | | 6000 sheets | | 9000 sheets | | 10000 Sheets | | of charging | of charging |
| Example No. | Charging member No. | Toner No. | Rank of lateral streak image | Rank of spot-like image | Rank of lateral streak image | Rank of spot-like image | Rank of lateral streak image | Rank of spot-like image | Rank of lateral streak image | Rank of spot-like image | Rank of lateral streak image | Rank of spot-like image | member after durability test | member after durability test |
| Example 1 | Charging member D1 | Toner A1 | 1 | 1 | 1 | 1 | 1 | 1 | 1 | 1 | 1 | 1 | 1 | 1 |
| Example 2 | Charging member D12 | Toner A7 | 1 | 1 | 1 | 1 | 1 | 1 | 1 | 1 | 1 | 1 | 1 | 1 |
| Example 3 | Charging member D13 | Toner A10 | 1 | 1 | 1 | 1 | 1 | 1 | 1 | 1 | 1 | 1 | 1 | 1 |
| Example 4 | Charging member D7 | Toner A11 | 1 | 1 | 1 | 1 | 2 | 2 | 2 | 2 | 2 | 2 | 2 | 2 |
| Example 5 | Charging member D12 | Toner A1 | 1 | 1 | 1 | 1 | 1 | 1 | 1 | 1 | 1 | 1 | 1 | 1 |
| Example 6 | Charging member D7 | Toner A2 | 2 | 2 | 2 | 2 | 2 | 2 | 2 | 2 | 2 | 2 | 3 | 3 |
| Example 7 | Charging member D7 | Toner A3 | 1 | 1 | 1 | 1 | 1 | 1 | 1 | 2 | 2 | 2 | 2 | 2 |
| Example 8 | Charging member D7 | Toner A4 | 2 | 2 | 2 | 2 | 2 | 2 | 2 | 2 | 2 | 2 | 3 | 3 |
| Example 9 | Charging member D4 | Toner A1 | 1 | 1 | 1 | 1 | 1 | 1 | 1 | 1 | 2 | 2 | 1 | 1 |

TABLE 10-continued

| | | | Durability evaluation | | | | | | | | | | Observation of smudge on surface | In-nip discharge |
|---|---|---|---|---|---|---|---|---|---|---|---|---|---|---|
| | | | Before durability test | | 3000 sheets | | 6000 sheets | | 9000 sheets | | 10000 Sheets | | of charging | of charging |
| Example No. | Charging member No. | Toner No. | Rank of lateral streak image | Rank of spot-like image | Rank of lateral streak image | Rank of spot-like image | Rank of lateral streak image | Rank of spot-like image | Rank of lateral streak image | Rank of spot-like image | Rank of lateral streak image | Rank of spot-like image | member after durability test | member after durability test |
| Example 10 | Charging member D4 | Toner A9 | 1 | 1 | 1 | 1 | 1 | 1 | 1 | 1 | 2 | 2 | 1 | 1 |
| Example 11 | Charging member D7 | Toner A2 | 2 | 2 | 2 | 2 | 2 | 2 | 2 | 2 | 2 | 2 | 3 | 3 |
| Example 12 | Charging member D7 | Toner A4 | 2 | 2 | 2 | 2 | 2 | 2 | 2 | 2 | 2 | 2 | 3 | 3 |
| Example 13 | Charging member D3 | Toner A5 | 1 | 1 | 2 | 1 | 2 | 1 | 2 | 2 | 2 | 2 | 2 | 2 |
| Example 14 | Charging member D3 | Toner A6 | 1 | 1 | 2 | 1 | 2 | 1 | 2 | 2 | 2 | 2 | 2 | 2 |
| Example 15 | Charging member D14 | Toner A6 | 1 | 1 | 1 | 1 | 1 | 1 | 1 | 1 | 2 | 2 | 1 | 1 |
| Example 16 | Charging member D15 | Toner A11 | 1 | 1 | 1 | 1 | 1 | 1 | 1 | 1 | 2 | 2 | 1 | 1 |
| Example 17 | Charging member D5 | Toner A11 | 1 | 1 | 1 | 1 | 1 | 2 | 2 | 2 | 2 | 2 | 2 | 2 |
| Example 18 | Charging member D6 | Toner A1 | 1 | 1 | 1 | 1 | 1 | 1 | 1 | 1 | 2 | 2 | 1 | 2 |
| Example 19 | Charging member D16 | Toner A2 | 1 | 1 | 2 | 2 | 2 | 2 | 2 | 2 | 2 | 2 | 3 | 3 |
| Example 20 | Charging member D17 | Toner A8 | 1 | 1 | 1 | 1 | 1 | 1 | 1 | 1 | 2 | 2 | 1 | 2 |
| Example 21 | Charging member D18 | Toner A4 | 1 | 1 | 2 | 2 | 2 | 2 | 2 | 2 | 2 | 2 | 3 | 3 |
| Example 22 | Charging member D19 | Toner A5 | 1 | 1 | 1 | 1 | 1 | 2 | 2 | 2 | 2 | 2 | 2 | 2 |
| Example 23 | Charging member D20 | Toner A6 | 1 | 1 | 1 | 1 | 1 | 2 | 2 | 2 | 2 | 2 | 2 | 2 |
| Example 24 | Charging member D2 | Toner A8 | 1 | 1 | 1 | 1 | 1 | 1 | 1 | 1 | 1 | 2 | 1 | 1 |
| Example 25 | Charging member D9 | Toner A11 | 1 | 1 | 2 | 2 | 2 | 2 | 2 | 2 | 2 | 2 | 2 | 3 |
| Example 26 | Charging member D21 | Toner A5 | 1 | 1 | 2 | 2 | 2 | 2 | 2 | 2 | 2 | 2 | 2 | 3 |
| Example 27 | Charging member D22 | Toner A5 | 1 | 1 | 2 | 2 | 2 | 2 | 2 | 2 | 2 | 2 | 2 | 3 |
| Example 28 | Charging member D23 | Toner A6 | 1 | 1 | 2 | 2 | 2 | 2 | 2 | 2 | 2 | 2 | 2 | 3 |
| Example 29 | Charging member D24 | Toner A6 | 1 | 1 | 2 | 2 | 2 | 2 | 2 | 2 | 2 | 2 | 2 | 3 |
| Example 30 | Charging member D8 | Toner A11 | 1 | 1 | 1 | 2 | 2 | 2 | 2 | 2 | 2 | 2 | 2 | 3 |
| Example 31 | Charging member D10 | Toner A2 | 2 | 2 | 2 | 2 | 2 | 2 | 3 | 2 | 3 | 3 | 3 | 3 |

TABLE 10-continued

| | | | Durability evaluation | | | | | | | | | | Observation of smudge on surface of charging member after durability test | In-nip discharge of charging member after durability test |
|---|---|---|---|---|---|---|---|---|---|---|---|---|---|---|
| | | | Before durability test | | 3000 sheets | | 6000 sheets | | 9000 sheets | | 10000 Sheets | | | |
| Example No. | Charging member No. | Toner No. | Rank of lateral streak image | Rank of spot-like image | Rank of lateral streak image | Rank of spot-like image | Rank of lateral streak image | Rank of spot-like image | Rank of lateral streak image | Rank of spot-like image | Rank of lateral streak image | Rank of spot-like image | | |
| Example 32 | Charging member D11 | Toner A4 | 2 | 2 | 2 | 2 | 2 | 2 | 3 | 2 | 3 | 3 | 3 | 3 |
| Example 33 | Charging member D25 | Toner A12 | 2 | 2 | 2 | 2 | 2 | 2 | 3 | 2 | 3 | 3 | 3 | 3 |
| Comparative Example 1 | Charging member D26 | Toner A13 | 2 | 3 | 2 | 3 | 3 | 3 | 4 | 4 | 4 | 4 | 4 | 4 |
| Comparative Example 2 | Charging member D26 | Toner A14 | 2 | 3 | 2 | 3 | 3 | 3 | 4 | 4 | 4 | 4 | 4 | 4 |
| Comparative Example 3 | Charging member D26 | Toner A15 | 2 | 3 | 2 | 3 | 3 | 3 | 4 | 4 | 4 | 4 | 4 | 4 |
| Comparative Example 4 | Charging member D26 | Toner A16 | 2 | 3 | 2 | 3 | 3 | 3 | 4 | 4 | 4 | 4 | 4 | 4 |
| Comparative Example 5 | Charging member D26 | Toner A17 | 2 | 3 | 2 | 3 | 3 | 3 | 4 | 4 | 4 | 4 | 4 | 4 |
| Comparative Example 6 | Charging member D26 | Toner A18 | 2 | 3 | 2 | 3 | 3 | 3 | 4 | 4 | 4 | 4 | 4 | 4 |
| Comparative Example 7 | Charging member D24 | Toner A18 | 2 | 2 | 2 | 2 | 3 | 2 | 3 | 3 | 4 | 4 | 3 | 4 |
| Comparative Example 8 | Charging member D27 | Toner A18 | 3 | 2 | 3 | 2 | 3 | 2 | 3 | 3 | 4 | 4 | 3 | 4 |

The present invention is not limited to the foregoing embodiments. Various changes and modifications may be made without departing from the spirit and scope of the present invention. Therefore, the following claims are attached in order to make the scope of the present invention public.

According to the present invention, the generation of lateral streak images due to a decrease in the in-nip discharge intensity can be suppressed while at the same time the generation of spot-like images due to abnormal discharge caused by smudges on the surface of a charging member can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2013/067722, filed Jun. 27, 2013, which is hereby incorporated by reference herein in its entirety.

The invention claimed is:

1. An image forming apparatus comprising:

a photosensitive member;

a charging member for charging the photosensitive member;

an exposure member for forming an electrostatic latent image on a surface of the charged photosensitive member; and a developing member for supplying the photosensitive member on which the electrostatic latent image is formed with a toner to form a toner image on the surface of the photosensitive member, wherein:

the charging member comprises an electro-conductive substrate and an electro-conductive resin layer, the electro-conductive resin layer comprising a binder resin C and resin particles that roughen an exterior surface of the charging member, each of the resin particles having a plurality of pores inside thereof, and a surface of the charging member has a plurality of projections derived from the resin particles, and the projections are deformable, and wherein:

the toner comprises toner particles, each of which contains a binder resin T and a colorant, and inorganic fine particles, the inorganic fine particles are silica fine particles, the toner contains the silica fine particles in an amount of 0.40 parts by mass or more and 1.50 parts by mass or less based on 100 parts by mass of the toner particles, the silica fine particles are treated with 15.0 parts by mass or more and 40.0 parts by mass or less of a silicone oil based on 100 parts by mass of a silica raw material, and a fixation ratio (%) of the silicone oil on the basis of an amount of carbon is 70% or more, and a coverage ratio X1 of a surface of the toner by the silica fine particles, as determined by X-ray photoelectron spectrometer (ESCA), is 50.0 area % or more and 75.0 area % or less, and when a theoretical coverage ratio by the silica fine particles is X2, a diffusion index represented by the following formula 1 satisfies the following formula 2:

$$\text{diffusion index}=X1/X2 \quad \text{(formula 1)}$$

$$\text{diffusion index} \geq -0.0042 \times X1+0.62 \quad \text{(formula 2).}$$

2. The image forming apparatus according to claim 1, wherein the electro-conductive resin layer has an aggregate containing carbon black and inorganic particles.

3. The image forming apparatus according to claim 2, wherein the aggregate contains two or more types of inorganic particles.

4. The image forming apparatus according to claim 2, wherein the carbon black has an average particle diameter of 5 nm or more and 300 nm or less.

5. The image forming apparatus according to claim 1, wherein each of the resin particles has a porosity of 2.5% by volume or less as a whole.

6. The image forming apparatus according to claim 5, wherein the resin particle has a region whose porosity $V_{11}$ is 5% by volume or more and 20% by volume or less, wherein the region is farthest from the electro-conductive substrate in the resin particle, and assuming that the resin particle is a solid particle having no pores, the region corresponds to a 11% by volume-occupying region of the solid particle.

7. The image forming apparatus according to claim 6, wherein the porosity $V_{11}$ is 5.5% by volume or more and 15% by volume or less.

8. The image forming apparatus according to claim 6, wherein a pore size $R_{11}$ in the region of the resin particle, the region being farthest from the electro-conductive substrate, is 30 nm or more and 200 nm or less as a mean pore size, and assuming that the resin particle is a solid particle having no porosity, the region corresponds to a 11% by volume-occupying region of the solid particle.

9. The image forming apparatus according to claim 8, wherein the pore size $R_{11}$ is 60 nm or more and 150 nm or less as the mean pore size.

10. The image forming apparatus according to claim 1, wherein the charging member has a ten-point height of irregularities (Rzjis) of 8 μm or more and 100 μm or less.

11. The image forming apparatus according to claim 1, wherein the charging member has an average spacing between irregularities on the charging member (RSm) of 20 μm or more and 300 μm or less.

12. The image forming apparatus according to claim 1, wherein the resin particle is formed of acrylic resin, styrene resin, or styrene-acrylic resin.

13. The image forming apparatus according to claim 1, wherein a content of the resin particles in the electro-conductive resin layer is 2 parts by mass or more and 100 parts by mass or less based on 100 parts by mass of the binder resin C.

14. The image forming apparatus according to claim 13, wherein the content of the resin particle in the resin layer is 5 parts by mass or more and 80 parts by mass or less based on 100 parts by mass of the binder resin C.

15. The image forming apparatus according to claim 1, wherein the resin particle has a volume-average particle diameter of 10 μm or more and 50 μm or less.

16. A process cartridge detachably attachable to the image forming apparatus according to claim 1, wherein the process cartridge integrally supports the photosensitive member, the charging means, and the developing means.

* * * * *